US005719015A

United States Patent [19]

Mihayashi et al.

[11] Patent Number: 5,719,015

[45] Date of Patent: *Feb. 17, 1998

[54] SILVER HALIDE PHOTOGRAPHIC MATERIAL AND METHOD FOR PROCESSING THE SAME

[75] Inventors: Keiji Mihayashi; Kiyoshi Nakazyo, both of Kanagawa, Japan

[73] Assignee: Fuji Photo Film Co., Ltd., Kanagawa, Japan

[ * ] Notice: The term of this patent shall not extend beyond the expiration date of Pat. No. 5,580,707.

[21] Appl. No.: 645,586

[22] Filed: May 14, 1996

Related U.S. Application Data

[63] Continuation of Ser. No. 314,277, Sep. 30, 1994, abandoned.

[30] Foreign Application Priority Data

Sep. 30, 1993 [JP] Japan ..... 5-224717

[51] Int. Cl.[6] ..... G03C 1/06; G03C 1/815; G03C 1/825

[52] U.S. Cl. ..... 430/517; 430/531; 430/533; 430/634; 430/635; 430/513; 430/514; 430/515; 430/516; 430/518; 430/522

[58] Field of Search ..... 430/531, 533, 430/634, 635, 513, 514, 515, 516, 517, 518, 522

[56] References Cited

U.S. PATENT DOCUMENTS

| | | | |
|---|---|---|---|
| 4,078,933 | 3/1978 | Sugiyama et al. | 430/518 |
| 4,141,735 | 2/1979 | Schrader et al. | 96/75 |
| 4,855,221 | 8/1989 | Factor et al. | 430/517 |
| 5,213,957 | 5/1993 | Adachi | 430/522 |
| 5,232,825 | 8/1993 | Hattori et al. | 430/513 |
| 5,300,415 | 4/1994 | Sato et al. | 430/517 |
| 5,326,689 | 7/1994 | Murayama | 430/533 |
| 5,368,997 | 11/1994 | Kawamoto | 430/533 |
| 5,370,980 | 12/1994 | Yamada et al. | 430/517 |

FOREIGN PATENT DOCUMENTS

| | | | |
|---|---|---|---|
| 572275 | 12/1993 | European Pat. Off. . | |
| 8804794 | 6/1988 | WIPO | G03C 1/84 |

*Primary Examiner*—Geraldine Letscher
*Attorney, Agent, or Firm*—Sughrue, Mion, Zinn, Macpeak & Seas, PLLC

[57] ABSTRACT

A silver halide photographic material comprising a support having thereon at least one silver halide light-sensitive layer and at least one light-insensitive layer, wherein the support comprises a poly(alkylene aromatic dicarboxylate) having a glass transition temperature of from 50° C. to 200° C. and is heat-treated at a temperature of not lower than 40° C., but lower than the glass transition temperature for 0.1 to 1500 hours after molding the polymer into the support and before the coating of the silver halide light-sensitive layer, and said at least one light-insensitive layer contains a dispersion of crystallites of at least one dye represented by general formula (I):

$$D\text{—}(X)_y \qquad (I)$$

wherein D represents a moiety having a chromophoric group; X represents a dissociable proton or a group having a dissociable proton which is bonded to D either directly or through a bivalent bonding group; and y represents an integer of 1 to 7.

A method for processing the material wherein the material is color developed at 40° to 60° C.

22 Claims, 1 Drawing Sheet

SILVER HALIDE PHOTOGRAPHIC MATERIAL AND METHOD FOR PROCESSING THE SAME

This is a Continuation of U.S. Ser. application Ser. No. 08/314,277, filed Sep. 30, 1994, now abandoned.

FIELD OF THE INVENTION

This invention relates to a silver halide photographic material and a method for processing the same. More particularly, it relates to a silver halide photographic material which is free from the problem of winding curl, enables the handleability of the film to be made easy and can reduce the formation of residual color after processing, and a method for processing the same.

BACKGROUND OF THE INVENTION

Silver halide photographic materials (hereinafter sometimes referred to as photographic material) are prepared by coating at least one undercoat layer, at least one silver halide light-sensitive layer and at least one nonlight-sensitive layer on a plastic film support.

Examples of the plastic film conventionally used include cellulose polymers such as typically triacetyl cellulose (hereinafter referred to as TAC) and polyester polymers such as typically polyethylene terephthalate (hereinafter referred to as PET). These materials are described in, for example, *Research Disclosure* No. 307105 (1989 November) XVII.

Photographic materials, particularly photographic materials for photographing include sheet-form films such as cut films and roll films which are housed in a 35 mm patrone, charged into cameras and used for photographing.

PET has excellent mechanical strength, particularly high modulus, and hence it has such characteristics that bending elasticity corresponding to TAC of 122 μm can be obtained by PET of 100 μm or 90 μm. However, when PET is used in a roll form, winding curl severely remains. When films having no property to disappear the winding curl are used, problems are apt to be caused, for example, unevenness in processing is caused, scratch marks are formed, and films are folded during processing, or scratch marks are formed at the stage of printing an image on photographic paper after processing, and problems with regard to out-of-focus and jamming during conveyance are caused.

In view of the above, TAC is conventionally used as the support material for roll films because TAC does not have optical anisotropy and has high transparency and such excellent properties that since TAC has relatively high water absorptivity due to its molecular structure, the molecular chain of TAC is fluidized and rearranged by water absorption and as a result, winding curl formed during long-term storage in the wound-up form as the roll film is smoothed.

The photographic materials have been used for various purposes in recent years, and cameras have been remarkably miniaturized. It has been demanded to miniaturize patrones with the miniaturization of the cameras.

There are two problems when the patrones are miniaturized.

The first problem is that the thickness of the supports of the photographic materials must be reduced to miniaturize the patrones, and the mechanical strength of the supports is lowered when the thicknesses of the supports are reduced. Particularly, the bending elasticity thereof is reduced in proportion to the cube of the thickness of the support. Generally, the photographic materials are coated with gelatin. The gelatin-coated layers shrink under low humidity conditions, and curl (U-shaped) is formed in the width direction. Accordingly, it is necessary that the supports have bending elasticity capable of withstanding shrinkage stress.

The second problem is that a heavily wound-up shape is left during long-term storage with the miniaturization of the patrones or spools. For example, the wound-up diameter of the film is 14 mm which is the smallest wound-up diameter of the roll film with 36 exposures in the patrone in conventional 135 system. When the diameter is reduced to 12 mm or smaller, or 9 mm or smaller to miniaturize the patrone, the heavily wound-up shape is left, and various troubles are caused. For example, when the films are processed in miniature laboratories, the films are rolled up because only one ends thereof are fixed and other ends are not fixed. The feed of processing solutions to the rolled-up area is delayed, and unevenness in processing is caused. Further, the films are crushed by rollers in the miniature laboratories, and folded or scratched.

Further, when the unexposed film taken out of the patrone is wound up into a roll and charged into the supply chamber, for example, a long film (e.g., 36 frames) is used, the number of times of winding is large, and the film is closely wound up (the wound-up film is hardly loosen). Further, the diameter of the innermost film in the supply chamber is small. Accordingly, when a long film is used, the beginning end of the film from which the film is wound (the tip end of the film) is heavily curled. After completion of photographing, the heavily curled tip end of the film housed in the patrone is closely contacted with the inner wall of the patrone by curling, and it is very difficult that the tip end is drawn out by tools to carry out development. Accordingly, it is necessary that the film has a curl disappearing property.

It is known that the photographic materials are provided with a layer which absorbs light having a specific wavelength to prevent halation or irradiation, to filter a light absorption, or to control the sensitivity. This is generally put to practical use by a method wherein an antihalation layer for preventing undesired light from being scattered is provided on the side which is nearer the support than the silver halide emulsion layers, or a method wherein a yellow filter layer is provided on the side which is nearer the support than the blue-sensitive silver halide emulsion layer of the color photographic material, but which is farther away from the support than the green-sensitive and red-sensitive silver halide emulsion layers thereof to cut the sensitivity inherent to these color-sensitive emulsions.

Usually, fine grains of colloidal silver are used in these light absorbing layers. However, it is known that the colloidal silver grains have side effects of increasing fog and lowering the desilvering rate.

In order to solve the above-described problems there has been proposed to use organic dyes in place of colloidal silver.

For example, U.S. Pat. Nos. 2,548,564, 3,625,694 and 4,124,386 disclose a method wherein hydrophilic polymers having an opposite charge to that of the dissociated anionic dye are coexisted as a mordant in the same layer to thereby localize the dye molecule in a specific layer.

JP-A-5-45789 (the term "JP-A" as used herein means an "unexamined published Japanese patent application"), JP-A-5-45794 (corresponding to U.S. Pat. No. 5,288,600) and JP-A-5-53241 disclose a method wherein oil-soluble dyes are finely dispersed in high-boiling organic solvents or dispersed in latex, and the dispersion is localized in a specific layer as yellow filter dyes.

However, it was found that another problems are caused that the dyes are insufficiently decolorized, undesired absorption is remained as residual color after processing to increase $D_{min}$, or that the dyes are insufficiently fixed to a specific layer to diffuse into other layers during storage to thereby cause the fluctuation of photographic characteristics, though an increase in fog or a lowering in the desilvering rate can be prevented.

Further, JP-A-63-27838 (corresponding to EP 252,550A), JP-A-63-197943 (corresponding to WO 88/4794), JP-A-3-167546 (corresponding to U.S. Pat. No. 5,213,957), European Patents 274,723A, 276,566A and 430,186A and WO(PCT) 88/4794 disclose a method wherein a solid dispersion of dye crystallite particles is used in a specific layer. When the solid dispersion of dye crystallite is used, an increase in fog can be prevented, and the fixing of the dye to the specific layer can be improved. However, it was found that though decolorizability is somewhat improved, the degree of decolorization is still insufficient, and residual color which can not be easily removed is formed.

SUMMARY OF THE INVENTION

An object of the present invention is to provide a silver halide photographic material which has a support having improved properties with regard to the problem of winding curl and to thereby improve handleability and reduce troubles during development processing and printing, and furthermore, which enables the formation of residual color to be reduced.

Another object of the present invention is to provide a method for processing the above-described silver halide photographic material.

The above-described objects of the present invention have been achieved by the following silver halide photographic material and the following method for processing the silver halide photographic material.

(1) A silver halide photographic material comprising a support having thereon at least one under-coat layer, at least one silver halide light-sensitive layer and at least one light-insensitive layer, wherein the support comprises a poly(alkylene aromatic dicarboxylate) having a glass transition temperature of from 50° C. to 200° C. and is heat-treated at a temperature of not lower than 40° C. but lower than the glass transition temperature for 0.1 to 1500 hour after molding the polymer into the support and before the coating of the silver halide light-sensitive layer, and said at least one light-insensitive layer contains a dispersion of crystallites of at least one dye represented by the following general formula (I)

$$D-(X)_y \qquad (I)$$

In general formula (I), D represents a moiety containing a chromophoric group; X represents a dissociable proton or a group having a dissociable proton which is bonded to D either directly or through a bivalent bonding group; and y represents an integer of 1 to 7.

(2) A method for processing a silver halide photographic material as described in (1) above, wherein the processing temperature for development processing after imagewise exposure is from 40° C. to 60° C.

DETAILED DESCRIPTION OF THE INVENTION

Figure 2:
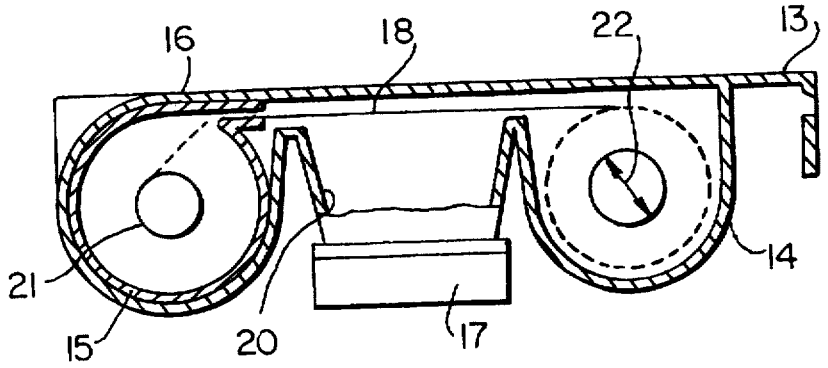
FIG. 2 shows a top view of the unit of another type of a film integrated camera.

First, the poly(alkylene aromatic dicarboxylate) used in the present invention (hereinafter referred to as polyester of the present invention) will be illustrated below.

Various polyesters can be used as the polyester of the present invention. However, polyesters mainly composed of benzenedicarboxylic acids or naphthalenedicarboxylic acids and diols, particularly polyethylene terephthalate (PET) and polyethylene naphthalate are preferred from the standpoint of well balanced properties between the difficult formation of winding curl, mechanical strength (such as tensile strength, tear strength, and bending strength) and costs. The term "naphthalate" as used herein refers to a naphthalenedicarboxylate.

The polyesters of the present invention are formed by using aromatic dicarboxylic acids and diols as essential ingredients.

The aromatic dicarboxylic acids are dicarboxylic acids having at least one benzene nucleus. Specific examples of the aromatic dicarboxylic acids include terephthalic acid, isophthalic acid, phthalic acid, phthalic anhydride, naphthalenedicarboxylic acid (1,2-, 1,3-, 1,4-, 1,5-, 1,6-, 1,7-, 1,8-, 2,3-, 2,4-, 2,5-, 2,6-, and 2,7-naphthalene dicarboxylic acid may be used and among them 1,4-, 1,5-, 2,6- and 2,7-naphthalene dicarboxylic acids are preferred.), biphenyl-4, 4'-dicarboxylic acid, tetrachlorophthalic anhydride and the following compounds.

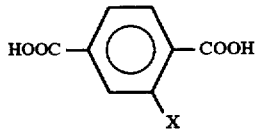

(X: halogen atom such as Cl, Br, I and F),

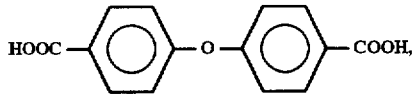

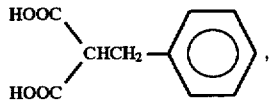

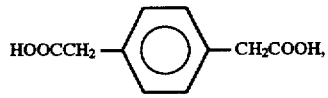

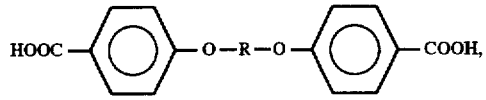

(R: $C_1$–$C_5$ alkylene)

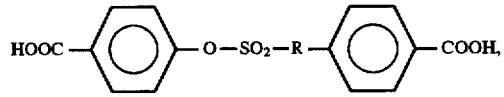

(R: $C_1$–$C_5$ alkylene)

-continued

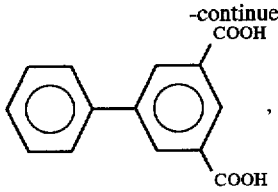

Dibasic acids may be optionally used together with the above-described aromatic dicarboxylic acids used as essential ingredients. Examples of the dibasic acids which can be optionally used as comonomers include succinic acid, glutaric acid, adipic acid, sebacic acid, succinic anhydride, maleic acid, fumaric acid, maleic anhydride, itaconic acid, citraconic anhydride, tetrahydrophthalic anhydride, 3,6-endomethylenetetrahydrophthalic anhydride, 1,4-cyclohexanedicarboxylic acid and the following compounds.

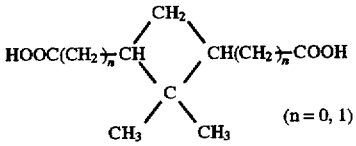

(n = 0, 1)

$HOOC-R-SO_2-R-COOH$ (R: $C_3$–$C_5$ alkylene)

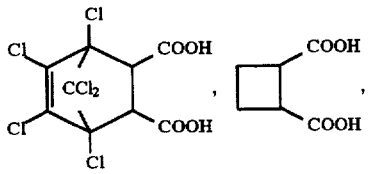

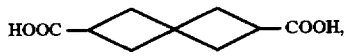

In the polyester of the present invention the aromatic dicarboxylic acid is preferably contained in an amount of at least 50 mol %, more preferably at least 80 mol %, and most preferably 100 mol % based on the total amount of acids in the polyester.

Examples of the diols include ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcinol, hydroquinone, 1,4-benzenedimethanol and the following compounds.

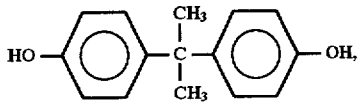

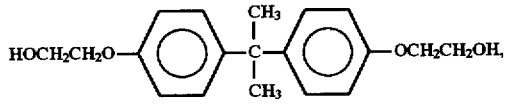

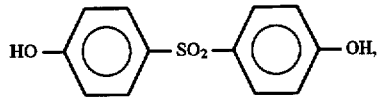

-continued

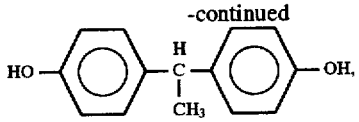

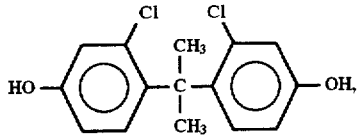

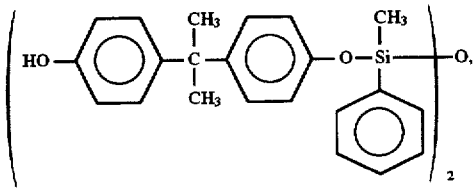

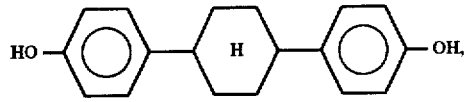

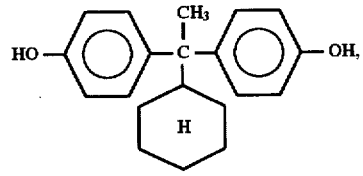

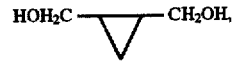

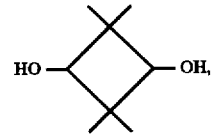

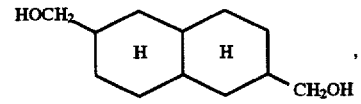

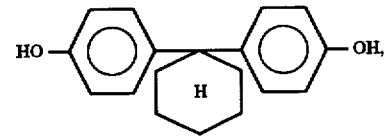

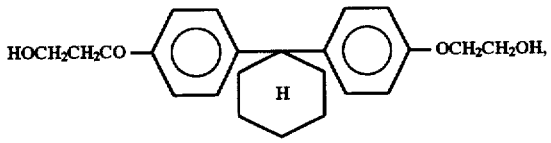

Further, monofunctional or tri- or polyfunctional compounds (preferably tri- to penta-functional) having hydroxy group or acid group (—COOH) may be optionally copolymerized. Furthermore, compounds having both hydroxy group and carboxyl group (or ester) in the molecule may be optionally copolymerized. Examples of the compounds include the following compounds.

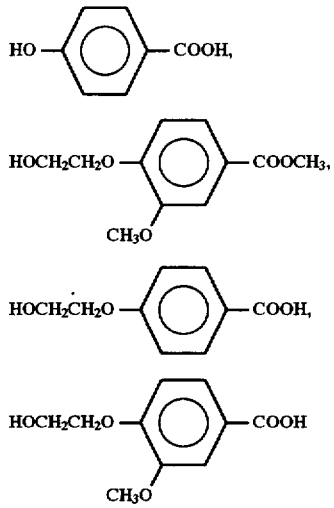

A monofunctional compound having a hydroxy group or a carboxy group may be used to controle the polymerization degree. For such an aim the compound having a hydroxy group or a carboxy group is usually used in an amount of from 0.1 to 3 mol % based on the amount of the diol compound or the aromatic dicarboxylic acid, respectively.

Each amount of a tri-functional hydroxy compound, a tri-carboxylic acid, and a compound having both hydroxy group and carboxyl group (or ester) is preferably not more than 10 mol %, more preferably not more than 5 mol %, and most preferably not more than 2 mol %, based on the diol compound or the aromatic dicarboxylic acid.

Of the polyesters mainly composed of the diols and the dicaboxylic acids, there are preferred homopolymers such as poly(ethylene terephthalate), poly(ethylene naphthalate) and poly(cyclohexanedimethanol terephthalate) (PCT) and copolymers obtained by copolymerizing 2,6-naphthalenedicarboxylic acid (NDCA), terephthalic acid (TPA), isophthalic acid (IPA), o-phthalic acid (OPA) or biphenyl-4,4'-dicarboxylic acid (PPDC) as the particularly preferred essential aromatic dicarboxylic acid with ethylene glycol (EG), cyclohexanedimethanol (CHDM), neopentyl glycol (NPG), bisphenol A (BPA) or biphenol (BP) as the diol and p-hydroxybenzoic acid (PHBA) or 6-hydroxy-2-naphthalenecarboxylic acid (HNCA) as the hydroxycarboxylic acid comonomer.

Of these polyesters, there are more preferred copolymer of terephthalic acid and naphthalenedicarboxylic acid (the mixing ratio by mol of terephthalic acid and naphthalenedicarboxylic acid being preferably 0.9:0.1–0.1:0.9, more preferably 0.8:0.2–0.2:0.8) with ethylene glycol; the copolymer of terephthalic acid with ethylene glycol and bisphenol A (the mixing ratio by mol of ethylene glycol and bisphenol A being preferably 0.6:0.4–0:1.0, more preferably 0.5:0.5–0.1:0.9); the copolymer of isophthalic acid, biphenyl-4,4'-dicarboxylic acid, terephthalic acid and ethylene glycol (the ratio by mol of isophthalic acid to terephthalic acid being preferably 0.1–0.5 to 1, more preferably 0.2–0.3 to 1; the ratio by mol of biphenyl-4,4'-dicarboxylic acid to terephthalic acid being 0.1–0.5 to 1, more preferably 0.2–0.3 to 1); the copolymer of terephthalic acid, neopentyl glycol and ethylene glycol (the ratio by mol of neopentyl glycol to ethylene glycol being 1:00.6:0.4, more preferably 0.9:0.1–0.7:0.3); the copolymer of terephthalic acid, ethylene glycol and biphenol (the ratio by mol of ethylene glycol to biphenol being 0:1.00.8:0.2, more preferably 0.1:0.9–0.7:0.3); and the copolymer of p-hydroxybenzoic acid, ethylene glycol and terephthalic acid (the ratio by mol of ethylene glycol to p-hydroxybenzoic acid being preferably 1:0–0.1:0.9, more preferably 0.9:0.1–0.2:0.8).

These homopolymers and copolymers can be synthesized by conventional polyester synthesis methods. For example, the polyesters can be synthesized by directly subjecting the acid component and the glycol component to an esterification reaction. When the acid component is used in the form of a dialkyl ester, the acid component and the glycol component are subjected to an ester exchange reaction, and the reaction mixture is heated under reduced pressure to remove an excess of the glycol component, thereby obtaining the polyester. The acid component may be used in the form of an acid halide and may be reacted with the glycol component. If desired, a catalyst for the ester exchange reaction or a catalyst for the polymerization reaction may be used. A heat-resistant stabilizer may be added. These polyester synthesis methods are described in, for example, *Kobunshi Jikken Gaku*, Vol. 5 "Polycondensation and Polyaddition", pp. 103 to 136 (Kyoritsu Shuppan 1980) and *Gosei Kobunshi V*, pp. 187 to 286 (Asakura Shoten 1971).

These polyesters have a weight average molecular weight of preferably 10,000 to 500,000, more preferably 30,000 to 300,000.

Further, these polyesters may be blended with another type of polyesters (polyesters of the present invention and/or polyesters other than those of the present invention) or may be prepared by copolymerizing monomers for preparing another types of polyesters to improve adhesion between the polyesters and another types of polyesters. Monomers having an unsaturated bond may be copolymerized, and the resulting polyesters may be radical crosslinked to improve the adhesion.

The amount of the polyester (other than the polyester of the present invention) is preferably from 0.1 to 50 wt %, more preferably from 1 to 10 wt % based on the total amount of polyesters, and the amount of the monomer having an unsaturated bond is preferably 0.1 to 10 wt %, and more preferably 2 to 5 wt % based on the total amount of the polyester.

Polymer blends obtained by mixing two or more of the resulting polymers can be easily molded by the methods described in JP-A-49-5482, JP-A-64-4325, JP-A-3-192718 and *Research Disclosure* 283,739–41, 284,779–82 and 294, 807–14.

The glass transition temperature (Tg) in the present invention is defined as the arithmetic mean value of a temperature at which the sample begins to be biased from the base line and a temperature at which the sample is returned to a new base line when 10 mg of the sample film is heated at a heating rate of 20° C./min in a helium nitrogen gas stream and measured by using a differential scanning calorimeter (DSC) provided that when heat absorption peaks appear, the temperature at which the maximum value of the heat absorption peak is shown is referred to as Tg.

The polyesters of the present invention have a Tg of not lower than 50° C. The polyesters are generally handled not with great care and are often exposed to a temperature of 40° C. in the open air in the height of summer in particular. In view of the above, it is preferred from the standpoint of safety that the polyesters of the present invention have a Tg of not lower than 55° C., more preferably not lower than 70° C., particularly preferably not lower than 80° C. This is because the effect of improving the problem of winding curl obtained by the heat treatment is lost when the polyesters are exposed to a temperature which is higher than the glass transition temperature. It is necessary that the polyesters have a glass transition temperature which is not lower than a temperature at which the polyesters are used under severe conditions by users, that is, a temperature which is higher than 40° C. in summer.

The upper limit of the glass transition temperature is 200° C. Films having good transparency can not be obtained from the polyesters having a glass transition temperature of higher than 200° C.

Specific examples of the polyesters which can be preferably used in the present invention include, but are not limited to, the following compounds.

Examples of Polyester Compounds

| | | |
|---|---|---|
| P-0: | Terephthalic Acid (TPA)/Ethylene Glycol (EG) MR (Molar Ratio) = 100/100 (PET) MW = 350,000 | Tg = 80° C. |
| P-1: | 2,6-Naphthalenedicarboxylic Acid (NDCA)/Ethylene Glycol (EG) MR = 100/100 (PEN) MW = 300,000 | Tg = 119° C. |
| P-2: | Terephthalic Acid (TPA)/Cyclohexanedimethanol (CHDM) MR = 100/100 MW = 200,000 | Tg = 93° C. |
| P-3: | TPA/Bisphenol A (BPA) MW = 100/100 MW = 150,000 | Tg = 192° C. |
| P-4: | 2,6-NDCA/TPA/EG MR = 50/50/100 MW = 100,000 | Tg = 92° C. |
| P-5: | 2,6-NDCA/TPA/EG MR = 75/25/100 MW = 150,000 | Tg = 102° C. |
| P-6: | 2,6-NDCA/TPA/EG/BPA MR = 50/50/75/25 MW = 150,000 | Tg = 112° C. |
| P-7: | TPA/EG/BPA MR = 100/50/50 MW = 100,000 | Tg = 105° C. |
| P-8: | TPA/EG/BPA MR = 100/25/75 MW = 150,000 | Tg = 135° C. |
| P-9: | TPA/EG/CHDM/BPA MR = 100/25/25/50 MW = 200,000 | Tg = 115° C. |
| P-10: | IPA/PPDC/TPA/EG MR = 20/50/30/100 MW = 70,000 | Tg = 95° C. |
| P-11: | NDCA/NPG/EG MR = 100/70/30 MW = 120,000 | Tg = 105° C. |
| P-12: | TPA/EG/BP MR = 100/20/80 MW = 150,000 | Tg = 115° C. |
| P-13: | PHBA/EG/TPA MR = 200/100/100 MW = 80,000 | Tg = 125° C. |
| P-14: | PEN/PET MR = 60/40 MW = 120,000 | Tg = 95° C. |
| P-15: | PEN/PET MR = 80/20 MW = 150,000 | Tg = 104° C. |
| P-16: | PAr/PEN MR = 50/50 MW = 150,000 | Tg = 142° C. |
| P-17: | PAr/PCT MR = 50/50 MW = 120,000 | Tg = 118° C. |
| P-18: | PAr/PET MR = 60/40 MW = 100,000 | Tg = 101° C. |
| P-19: | PEN/PET/PAr MR = 50/25/25 MW = 80,000 | Tg = 108° C. |
| P-20: | TPA/5-Sulfoisophthalic Acid (SIP)/EG MR = 95/5/100 MW = 70,000 | Tg = 65° C. |

The support of the present invention is usually molded by melt extrusion of the polyester to form a film, subjecting to simultaneous or successive biaxial stretching, and then heat setting and heat relaxation. Such a method is disclosed, for example, in JP-A-50-109715 and JP-A-50-95374.

The thickness of the polyester support (film base) of the present invention is preferably from 50 to 100 μm more preferably from 75 to 90 μm. When the thickness is less than 50 μm, some supports have tendency to not withstand the shrinkage stress of the light-sensitive layers when dried, while the thickness of more than 100 μm does not meet the requirements of the reduction in the thickness to compact film units. However, when the photographic materials are used in a sheet-form photographic materials, the thickness may be more than 100 μm. The upper limit is preferably 300 μm.

All of the polyesters of the present invention have bending modulus of elasticity which is higher than that of TAC, and the thicknesses of the films can be reduced. Of the polyesters, PET and PEN have high bending elasticity. When PET or PEN is used, the thickness can be reduced to 100 μm or below, though TAC requires a thickness of 122 μm.

It is essential that the polyester supports of the present invention are heat-treated. The heat treatment is carried out at a temperature of not lower than 40° C., but lower than the glass transition temperature for 0.1 to 1500 hours preferably for 0.2 to 1,000 hours, more preferably for 0.3 to 500 hours. The effect of the heat treatment can be more rapidly obtained at a higher heat treatment temperature. However, when the heat treatment temperature is higher than the glass transition temperature, the molecule in the films is disordered, the free volume is increased, and the molecule is apt to be fluidized. Namely, films which are liable to easily form winding curl are formed. Accordingly, it is necessary that the heat treatment is carried out at a temperature at which the polyester does not cause glass transition, preferably at a temperature not higher than the temperature lower than the transition temperature by 3° C., more preferably by 5° C.

The relative humidity during the heat-treatment substantially does not affect the effects of the present invention. The heat-treatment of the present invention usually conducted at about 30 to 80% RH.

The heat treatment is carried out until the ANSI curl value measured after winding the film on a 18 mmϕ core (when the heat-treatment of the film is carried out in a state of a roll as stated hereinafter, the film is wound around the core so that the outword positioned surface upon the heat-treatment is positioned outword) and core setting it for 2 hours at 80° C. becomes less than 100, preferably less than 50. In the case of polyester P-1 film having a thickness of 85 μm, it is preferred to heat treat for from 3 to 300 hours when the heat treatment is carried out at 90° C., and for from 0.5 to 100 hours at 110° C.

It is preferred that the heat treatment of the present invention is carried out before the undercoat layer is coated after the polyester is molded into the support and the temperature thereof is (preferably) once lowered to a temperature of lower than 40° C. or that the heat treatment is carried out before the silver halide light-sensitive layers are coated after the undercoat layer is coated and the temperature is (preferably) lowered to a temperature of lower than 40° C.

It is desirable that the heat treatment is carried out at a temperature of slightly lower than the glass transition temperature to shorten the heat treatment time. The heat treatment is carried out at a temperature of preferably not lower than 40° C., but lower than the glass transition temperature, more preferably at a temperature lower by 30° C. than the glass transition temperature or higher, but lower than the glass transition temperature, still more preferably lower by 15° C. than the glass transition temperature or higher, but lower than the glass transition temperature.

When the heat treatment is carried out under the above-described temperature conditions, the effect of the heat treatment can be seen after 0.1 hour treatment. However, even when the heat treatment is carried out for 1500 hours or longer, such a longer treatment gives almost no increased benefits. Accordingly, it is preferred that the heat treatment is carried out for at least 0.1 hour, but for not longer than 1500 hours.

The heat-treatment of the present invention is conducted under the temperature for a period of time as described above until the ANSI curl value becomes less than 100.

In the heat treatment of the polyester of the present invention, the polyester may be previously heated at a temperature of not lower than Tg for a short time (at a temperature preferably higher by 20° to 100° C., more preferably 30° to 50° C. than Tg, preferably for 5 minutes to 3 hours more preferably 5 minutes to 1 hour), and then heat-treated at a temperature of not lower than 40° C., but lower than the glass transition temperature to shorten the heat treatment time. (After heating at a temperature of not lower than Tg, the temperature may be once lowered to a temperature of 40° or lower prior to the heat treatment at from 40° C. to Tg is conducted. Such a heat treatment is considered effective to obtain the effect of the present invention because molecular movement becomes active by such a heat treatment which results in the amorphus structure of the polyester to be apt to be changed to compact structure.) With regard to the heating method, the heat treatment may be carried out by allowing a roll of film to be made the support of the present invention to stand in a heating warehouse or by conveying the film roll through a heating zone. The latter is preferred when manufacturability is taken into consideration. It is preferred that the core of the roll is hollow to efficiently transmit heat to the film, or the core have such a structure that an electric heater is provided therein or a high temperature fluid is passed therethrough to heat the polyester support.

The outer diameter of the core is preferably from 15 to 200 cm, and more preferably 20 to 100 cm. It is preferred that material for the core is not deformed or the strength thereof is not reduced by heat, though there is no particular limitation to the material. Examples of the materials include stainless steel and glass fiber-containing resins.

It is preferred that the film is wound around a core so that the surface of the film which becomes outword side upon use thereof is positioned inword.

The atmosphere of the heat treatment of the support is not limited, however, it is usually conducted in air.

It is preferred that various additives are incorporated in the polyester of the present invention to enhance the performance of the polyesters as the photographic supports.

The polyester films may contain ultraviolet light absorbers to prevent the films to fluoresce and to impart aging stability. It is desirable that ultraviolet light absorbers having no absorption in the region of visible light are used. The ultraviolet light absorbers are used in an amount of usually 0.01 to 20% by weight, preferably 0.05 to 10% by weight based on the weight of the polyester film. When the amount is less than 0.01% by weight, an effect of preventing the polyester film from being deteriorated by ultraviolet light can not be expected. Examples of the ultraviolet light absorbers include benzophenone compounds such as 4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone and 2,2'-dihydroxy-4,4'-dimethoxybenzophenone, benztriazole compounds such as 2-(2'-hydroxy-5-methylphenyl) benztriazole, 2-(2'-hydroxy-3',5'-di-t-butylphenyl) benztriazole and 2-(2'-hydroxy-3'-di-t-butyl-5'-methylphenyl)benztriazole; salicylic acid compounds such as phenyl salicylate and methyl salicylate; and triazine compounds such as 2,4,6-tris[2'-hydroxy-4'-(2"-ethylhexyloxy)phenyl]triazine and 2-phenyl-4,6-di[2'-hydroxy-4'-(2"-ethylhexyloxy)phenyl]triazine.

One of problems caused by the polyesters is edge fog due to high refractive index when the polyester films of the present invention are used as the supports for the photographic materials.

The polyesters of the present invention has a high refractive index. Particularly, the aromatic polyesters have a refractive index of as high as 1.6 to 1.7. On the other hand, gelatin which is a main component of a light-sensitive layer coated on the support has a refractive index of 1.50 to 1.55 which is lower than that of the support. Accordingly, when light enters the film through the edge of the film, light is apt to be reflected at the interface between the base and the emulsion layer. Accordingly, the polyester films cause a problem so-called light piping phenomenon (edge fogging).

Conventional methods for preventing the light piping phenomenon from occurring include a method wherein inert inorganic particles are incorporated in the films and a method wherein dyes are added.

The method for preventing the light piping phenomenon from occurring which can be preferably used in the present invention is the method wherein the dyes which does not greatly increase film haze are added into the support.

It is preferred from the standpoint of the general properties of the photographic materials that the dyes for use in dyeing the films have such a color tone that the films are dyed gray, though there is no particular limitation with regard to the dyes to be used. Further, it is desirable that the dyes have excellent heat resistance to the film forming temperature of the polyesters and are well compatible with the polyesters.

In the view of the above, commercially available dyes for polyesters such as Diaresin dyes (products of Mitsubishi Kasei KK) and Kayaset dyes (products of Nippon Kayaku KK) can be mixed with the polyesters in order to attain the objects.

The dyeing density is preferably from 0.01 to 0.10, more preferably from 0.03 to 0.07 when the color density in the region of visible light is measured by Macbeth color densitometer.

Easy slipperiness can be imparted to the polyester films of the present invention according to use. The incorporation of inert inorganic compounds by kneading into the films or the coating of surfactants on the films are generally made as easy slipperiness imparting means, though there is no particular limitation with regard to the easy slipperiness imparting means.

Examples of the inert inorganic particles include $SiO_2$, $TiO_2$, $BaSO_4$, $CaCO_3$, talc and kaolin. In addition to the easy slipperiness imparting means wherein inert particles are externally added to the polyester synthesis reaction system, there can be used an easy slipperiness imparting means wherein catalyst particles, such as antimony oxide, calcium acetate, and trimethoxy titanium particles added during the polyester polymerization reaction are internally precipitated out. The size of the particles is preferably from 0.1 to 3.0 μm, and more preferably from 0.2 to 1.5 μm, and the amount of the particles is preferably from 5 to 100 mg/m$^2$, and more preferably from 10 to 50 mg/m$^2$.

It is desirable that particles having a refractive index near that of the polyester films, such as $SiO_2$ are used as inert particles externally added or catalyst particles capable of relatively reducing the particle size thereof are used as particles internally precipitated out because transparency is an important factor for the supports for the photographic materials, though there is no particular limitation with regard to the easy slipperiness imparting means.

When easy slipperiness is imparted by kneading, it is preferred that a layer to which easy slipperiness is imparted is laminated to obtain the transparency of the film. More specifically, two or more extruders and feed blocks are used or co-extrusion is carried out by multi-manifold dies to carry out lamination.

The surfaces of the polymer films are hydrophobic. Accordingly, when the polymer films are used as the supports, it is very difficult that photographic layers comprising protective colloid mainly composed of gelatin (e.g., light-sensitive silver halide emulsion layers, interlayers, filter layers, etc.) are firmly bonded to the supports. Methods conventionally used to solve the problem can be used. Examples of the methods include:

(1) a method wherein the support is subjected to a surface activation treatment such as a reagent treatment, a mechanical treatment, a corona discharge treatment, a flame treatment, an ultraviolet light treatment, a high frequency treatment, a glow discharge treatment, an actinic plasma treatment, a laser treatment, a mixed acid treatment, or an ozonization treatment to activate the surface of the support, and the photographic emulsions are directly coated thereon; and (2) a method wherein an undercoat layer is provided on the surface of the support after the surface treatment or without the surface treatment, and the photographic emulsion layers are coated thereon (e.g., described in U.S. Pat. Nos. 2,698,241, 2,764,520, 2,864,755, 3,462,335, 3,475,193, 3,143,421, 3,501,301, 3,460,944 and 3,674,531, U.K. Patents 788,365, 804,005 and 891,469, JP-B-48-43122 (the term "JP-B" as used herein means an "examined Japanese patent publication") and JP-B-51-446).

The heat-treatment may be conducted either before or after treatments (1), or before or after providing an undercoat layer on the support.

It is believed that the surface treatment has an effect of forming somewhat polar groups on the surface of the support which is originally hydrophobic and an effect of increasing the crosslinking density of the surface. As a result, the affinity of the surface of the support with polar groups contained in the undercoating solution is increased or the fastness of the adherend surface is increased.

Methods for forming the undercoat layer include a multilayer method wherein a layer capable of well bonding to the support as the first layer (hereinafter referred to as first undercoat layer) is provided on the support, and a hydrophilic resin layer capable of well bonding to the photographic layers as the second layer (hereinafter referred to as second undercoat layer) is provided on the first layer; and a single layer method wherein only one layer of a resin layer having both hydrophobic group and hydrophilic group is coated on the support.

Of the surface treatment methods described in (1) above, the corona discharge treatment is the most known method and can be carried out by any of conventional methods such as methods described in JP-B-48-5043 (corresponding to U.S. Pat. No. 3,549,406), JP-B-47-51905 (corresponding to U.S. Pat. No. 3,582,338), JP-A-47-28067, JP-A-49-83767 (corresponding to U.S. Pat. No. 3,950,206), JP-A-51-41770 and JP-A-51-131576 (corresponding to U.S. Pat. No. 4,055,685). Discharge frequency is in the range of 50 Hz to 5,000 KHz, preferably 5 KHz to 100 KHx. When discharge frequency is too low, stable discharge can not made, and pinholes are formed on the support to be treated, while when discharge frequency is too high, an extra device for impedance matching is required, and hence the cost of the discharge device is increased. With regard to the treating strength of the material to be treated, 0.001 to 5 KV·A·min/$m^2$ is suitable, and 0.01 to 1 KV·A·min/$m^2$ is preferred to improve the wettability of supports. The gap clearance between the electrode and the leading roll is 0.5 to 2.5 mm, preferably 1.0 to 2.0 mm.

The glow discharge treatment which is the most effective surface treatment in many cases can be carried out by any of conventional methods such as the methods described in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,638, 3,309,299, 3,424,735, 3,462,335, 3,475,307 and 3,701,299, U.K. Patent 997,093 and JP-A-53-129262.

The glow discharge treatment is generally carried out under a pressure of 0.005 to 20 Torr, preferably 0.02 to 2 Torr. When pressure is too low, the surface treatment effect is reduced, while when pressure is too high, overcurrent flows, spark is liable to occur, there is danger, and there is a fear that the materials are broken. Discharge occurs when high voltage is applied to at least a pair of metallic plates or metallic poles which are spaced away from each other in a vacuum tank. Voltage to be applied varies depending on the composition of atmospheric gas and pressure. Usually, stable stationary glow discharge occurs at a voltage of 500 to 5,000 V under the above-described pressure range conditions. Particularly preferred voltage range for improving adhesion is 2,000 to 4,000 V. A preferred discharge frequency is from direct current to 5,000 MHz, preferably 50 Hz to 20 MHz as in conventional methods. Discharge treatment strength for obtaining desired adhesive properties preferably is 0.01 to 5 KV·A·min/$m^2$, more preferably 0.15 to 1 KV·A·min/$m^2$.

The undercoating method described in (2) above has been eagerly studied. As materials for the first undercoat layer in the multi-layer coating method, copolymers of monomers such as vinyl chloride, vinylidene chloride, butadiene, methacrylic acid, acrylic acid, itaconic acid and maleic anhydride and many polymers such as polyester imines, epoxy resins, grafted gelatin, and nitrocellulose can be used. As the second undercoat layer, gelatin can be used.

In the single layer method, the support may be swollen and subjected to interfacial mixing with a hydrophilic undercoating polymer to obtain good adhesion.

Examples of the hydrophilic undercoating polymer which can be used in the present invention include water-soluble polymers, cellulose esters, and latex polymers. Examples of the water-soluble polymers include water-soluble polyesters, gelatin, gelatin derivatives, casein, agar-agar, sodium alginate, starch, polyvinyl alcohol, polyacrylic acid copolymers and maleic anhydride copolymers. Examples of cellulose esters include carboxymethyl cellulose and hydroxyethyl cellulose. Examples of the latex polymers include vinyl chloride copolymers, vinylidene chloride copolymers, acrylic ester copolymers, vinyl acetate copolymers and butadiene copolymers. Of these compounds, gelatin is most preferred.

Examples of compounds which can be used to swell the supports used in the present invention include resorcinol, chlororesorcinol, methylresorcinol, o-cresol, m-cresol, p-cresol, phenol, o-chlorophenol, p-chlorophenol, dichlorophenol, trichlorophenol, mono-chloroacetic acid, dichloroacetic acid, trifluoroacetic acid and chloral hydrate. Of these compounds, resorcinol and p-chlorophenol are preferred.

Conventional hardening agents for gelatin can be used for the undercoat layers of the present invention.

Examples of the hardening agents for gelatin which can be used in the present invention include chromium salts (e.g., chromium alum), aldehydes (e.g., formaldehyde, glutaric aidehyde), isocyanates, epichlorohydrin resins, cyanuric chloride compounds (e.g., compounds described in JP-B-47-6151, JP-B-47-33380, JP-B-54-25411 and JP-A-56-130740), vinyl sulfone or sulfonyl compounds (e.g., compounds described in JP-B-47-24259, JP-B-50-35807, JP-A-49-24435, JP-A-53-41221 and JP-A-59-18944), carbamoyl ammonium salt compounds (e.g., compounds described in JP-B-56-12853, JP-B-58-32699, JP-A-49-51945, JP-A-51-59625 and JP-A-61-9641), amidinium salt compounds (e.g., compounds described in JP-A-60-225148), carbodiimide compounds (e.g., compounds described in JP-A-51-126125 and JP-A-52-48311), pyridinium salt compounds (e.g., compounds described in JP-B-58-50699, JP-A-52-54427, JP-A-57-44140 and JP-A-57-46538) and compounds described in Belgian Patent 825,726, U.S. Pat. No. 3,321,313, JP-A-50-38540, JP-A-52-93470, JP-A-56-43353 and JP-A-58-113929.

The undercoat layers of the present invention may contain inorganic or organic fine particles as matting agents in such an amount that the transparency and graininess of the image are substantially not deteriorated by the particles.

Examples of inorganic fine particles which can be used as the matting agents include silica ($SiO_2$), titanium dioxide ($TiO_2$), calcium carbonate and magnesium carbonate.

Examples of organic fine particles which can be used as the matting agents include polymethyl methacrylate, cellulose acetate propionate, processing solution-soluble compounds described in U.S. Pat. No. 4,142,894 and polymers described in U.S. Pat. No. 4,396,706.

These fine particle matting agents have an average particle size of 1 to 10 μm.

In addition thereto, the undercoat layers may optionally contain various additives such as surfactants, antistatic agents, antihalation agents, coloring dyes, pigments, coating aids an anti-fogging agents. When the undercoating solution is used for the first undercoat layer in the present invention, it is not necessary that etching agents such as resorcinol, chloral hydrate and chlorophenol are contained in the undercoating solution. However, the etching agents may be optionally contained in the undercoating solution, if desired.

The undercoating solution may be coated by any of conventional coating methods such as dip coating, air knife coating, curtain coating, roller coating, wire bar coating, gravure coating and extrusion coating using hopper described in U.S. Pat. No. 2,681,294. If desired, two or more layers can be simultaneously coated by the methods described in U.S. Pat. Nos. 2,761,791, 3,508,947, 2,941,898 and 3,526,528 and *Coating Engineering*, page 253 written by Yuji Harasaki (published by Asakura Shoten 1973).

Binders for back layers may be hydrophobic polymers. Alternatively, the binders may be hydrophilic polymers as used for the undercoat layers.

Further, the back layers of the photographic materials of the present invention may contain anti-static agents, slip agents, matting agents, surfactants, dyes and ultraviolet light absorbers. Any of conventional antistatic agents may be used. Examples of the antistatic agents which can be used in the back layers of the present invention include anionic polymer electrolytes such as high-molecular materials containing a carboxyl acid, a calboxylic acid salt or sulfonic acid salt (e.g., high-molecular materials described in JP-A-48-22017, JP-B-46-24159, JP-A-51-30725, JP-A-51-129216 and JP-A-55-95942), cationic high-molecular materials described in JP-A-49-121523, JP-A-48-91165 and JP-B-49-24582, and anionic and cationic surfactants such as compounds described in JP-A-49-85826, JP-A-49-33630, U.S. Pat. Nos. 2,992,108 and 3,206,312, JP-A-48-87826, JP-B-49-11567, JP-B-49-11568 and JP-A-55-70837.

Most preferred antistatic agents used in the back layers of the present invention is at least one crystalline metal oxide selected from the group consisting of ZnO, $TiO_2$, $SnO_2$, $Al_2O_3$, $In_2O_3$, $SiO_2$, MgO, BaO, $MoO_3$ and $V_2O_5$ or a compound oxide thereof. These oxides are used in the form of fine particles.

The fine particles of the electrically conductive crystalline oxides or the compound oxides thereof have a volume resistivity of preferably $10^7$ Ωcm or below, more preferably $10^5$ Ωcm or below. The lower limit is preferably $10^3$ Ωcm. The particle size thereof is preferably 0.002 to 0.7 μm, particularly preferably 0.005 to 0.3 μm.

The silver halide color photographic materials obtained by using the above-described supports may be provided with a magnetic recording layer for recording various information. Conventional ferromagnetic substances can be used. The magnetic recording layer may be provided on the upper layer (e.g., the protective layer or the uppermost layer) of the light-sensitive layer-coated side of the support layer. However, it is preferred that the magnetic recording layer is provided on the back side of the support. The magnetic recording layer can be provided by coating or printing. Further, the photographic materials may be provided with a space for optically recording to record various information.

It is preferred that the size of the hollow part or the spool in the central part of the film housed in a camera is smaller. However, when the size is smaller than 3 mm, the photographic characteristics are greatly deteriorated by the pressure of the photographic material itself, and hence such a small size can not be put to practical use. The size of the hollow part or the spool in the central part of the film housed in the camera is preferably at least 3 mm in the present invention. The upper limit is preferably 12 mm. The size is more preferably 3 to 10 mm, particularly preferably 4 to 9 mm.

As illustrated above, there are used the supports comprising a poly(alkylene aromatic dicarboxylate) polymer having a glass transition temperature of 50° to 200° C., heat-treated at a temperature of not lower than 40° C., but lower than the glass transition temperature either before the coating of the undercoat layer or before the coating of the silver halide light-sensitive layers after the coating of the undercoat layer. When the silver halide photographic materials are prepared by using the supports of the present invention and used as the photographic films, the drawing-out workability of the tip of the films rolled up can be improved, unevenness in development, marring and rear end folding can be prevented from occurring during processing, and marring and out of focus during printing can be reduced.

When the crystallite dispersion of the dye of the present invention is contained in at least one light-insensitive layer of the silver halide photographic material wherein the above-described support is used, an effect of reducing residual color after development processing and an effect of providing a good image quality can be obtained.

The dye of the present invention may be used as a filter dye or an antihalation dye. The dye may be used with colloidal silver.

The dyes represented by the following general formula (I) will be illustrated in greater detail below.

$$D\text{—}(X)_y \qquad (I)$$

In general formula (I), D represents a moiety having a chromophoric group; X represents a dissociable proton or a group having a dissociable proton which is bonded to D either directly or through a bivalent bonding group; and y represents an integer of 1 to 7.

The compound having a moiety containing chromophoric group represented by D can be chosen from among conventional dye compounds.

Examples of the compounds include oxonol dyes, merocyanine dyes, cyanine dyes, arylidene dyes, azomethine dyes, triphenylmethane dyes, azo dyes, anthraquinone dye and indoaniline dyes.

The dissociable proton or the group having a dissociable proton represented by X is not dissociated when the compounds of general formula (I) are added to the silver halide photographic material of te present invention, and X makes the compounds of general formula (I) to have such characteristics that the compounds of general formula (I) are substantially water-insoluble (i.e., the solubility of the compounds is not more than 0.3 g per 100 g water having a pH of 5 to 7 at 25° C.), and when the photographic materials are subjected to development processing, X is dissociated, thereby making the compounds of general formula (I) substantially water-soluble. Examples of the group include a carboxyl group, a sulfonamido group, an alkylsulfamoyl group, an arylsulfamoyl group, a sulfonylcarbamoyl group, a carbonylsulfamoyl group (e.g., $RSO_2NH$—, $RNHSO_2$—, $RSO_2NHCO$—, and $RCONHSO_2$—, respectively, wherein R represents an alkyl group preferably having from 1 to 6 carbon atoms (such as methyl, ethyl and n-butyl) or an aryl group preferably having from 6 to 10 carbon atoms), an enol group of oxonol dyes, and a phenolic hydroxyl group.

Of the compounds of general formula (I), compounds represented by the following general formulas (II), (III), (IV) and (V) are more preferred.

$$A^1{=}L^1{\leftrightharpoons}L^2{=}L^3{\rightharpoonup}_m Q \quad \text{(II)}$$

$$A^1{=}L^1{\leftrightharpoons}L^2{=}L^3{\rightharpoonup}_n A^2 \quad \text{(III)}$$

$$A^1{\rightleftharpoons}L^1{-}L^2{\rightharpoonup}_p B^1 \quad \text{(IV)}$$

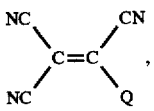

(V)

wherein $A^1$ and $A^2$ each represents an acid nucleus; $B^1$ represents a basic nucleus; Q represents an aryl group or a heterocyclic group; $L^1$, $L^2$ and $L^3$ each represents a methine group; m represents 0, 1 or 2; n and p each represents 0, 1, 2 or 3 provided that the compounds of general formulas (II) to (V) have at least one group selected from the group consisting of a carboxyl group, a sulfonamido group, an alkylsulfamoyl group, an arylsulfamoyl group, a sulfonylcarbamoyl group, a carbonylsulfamoyl group, (e.g., $RSO_2NH$—, $RNHSO_2$—, $RSO_2NHCO$— and $RCONHSO_2$—, respectively, wherein R represents an alkyl group preferably having from 1 to 6 carbon atoms (such as methyl, ethyl and n-butyl) or an aryl group preferably having from 6 to 10 carbon atoms), an enol group of oxonol dyes, and a phenolic hydroxyl group and do not have other water-soluble group (e.g., sulfo group, phospho group).

The acid nucleus represented by $A^1$ and $A^2$ is preferably a moiety of a cyclic keto-methylene compound or a moiety of a compound having a methylene group sandwiched between electron attractive groups.

Examples of the cyclic keto-methylene compound include 5- to 7-membered compounds having at least one of $$-CH_2-\overset{\overset{\displaystyle O}{\|}}{C}- \text{ and } -CH_2\overset{\overset{\displaystyle S}{\|}}{C}-$$

at least one of N, O and S atoms, such as 2-pyrazoline-5-one, rhodanine, hydantoin, thiohydantoin, 2,4-oxazolidinedione, isoxazolone, barbituric acid, thiobarbituric acid, indanedione, dioxopyrazolopyridine, hydroxypyridone, pyrazolidinedione and 2,5-dihydrofuran-2-one. These compounds may be substituted.

The compound having a methylene group sandwiched between electron attractive groups can be represented by $Z^1CH_2Z^2$, wherein $Z^1$ and $Z^2$ each represents —CN, $-SO_2R^1$, $-COR^1$, $-COOR^2$, $-CONHR^2$, $-SO_2NHR^2$, $-C[{=}C(CN)_2]R^1$ or $-C[{=}C(CN)_2]NHR^1$; $R^1$ represents an alkyl group (preferably having 1 to 6 carbon atoms), an aryl group, or a heterocyclic group (examples of the aryl group and the heterocyclic group are the same as those represented by Q, respectively); and $R^2$ represents a hydrogen atom or a group represented by $R^1$. These groups may be substituted.

The basic nucleus represented by $B^1$ is preferably a 5- to 7-membered heterocyclic group containing at least one N atom or further containing at least one of N, S, and O atoms, and the group may be condensed with a benzene ring. Examples of the nucleus include pyridine, quinoline, indolenine, oxazole, imidazole, thiazole, benzoxazole, benzimidazole, benzthiazole, oxazoline, naphthoxazole and pyrrole rings. These rings may be substituted.

Examples of the aryl group represented by Q include phenyl group and naphthyl group. These groups may be substituted. The heterocyclic group represented by Q is preferably a 5- to 7-membered heterocyclic group containing at least one of N, O and S atoms. The heterocyclic group may be condensed with a benzene ring. Examples of the heterocyclic group include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzquinoline, thiadiazole, pyrrolothiazole, pyrrolopyridazine, tetrazole, oxazole, coumarin and coumarone rings. These rings may be substituted.

The methine group represented by $L^1$, $L^2$ and $L^3$ may be substituted. The substituent groups may be combined together to form a five-membered or six-membered ring (e.g., cyclopentene, cyclohexene).

The above-described groups may be substituted by any of substituents, so long as the compounds of general formulas (I) to (V) are substantially not made soluble in water at a pH of to 7.

Examples of the substituent which can be used include a carboxyl group, a sulfonamido group such as an alkylsulfonamido and an arylsulfonamido having 1 to 10 carbon atoms (e.g., methylsulfonamido, phenylsulfonamido, butylsulfonamido, n-octylsulfonamido), a sulfamoyl group having 0 to 10 carbon atoms (unsubstituted sulfamoyl; alkylsulfamoyl and arylsulfamoyl, e.g., methylsulfamoyl, phenylsulfamoyl, butylsulfamoyl), a sulfonylcarbamoyl group such as an alkylsulfonylcarbamoyl group and an arylsulfonylcarbamoyl group having 2 to 10 carbon atoms (e.g., methylsulfonylcarbamoyl, propylsulfonylcarbamoyl, phenylsulfonylcarbamoyl), an acylsulfamoyl group (in the present invention an acyl group or moiety includes an aliphatic and aromatic acyl groups or moieties) having 1 to 10 carbon atoms (e.g., acetylsulfamoyl, propionylsulfamoyl, pivaloylsulfamoyl, benzoylsulfamoyl), a linear or cyclic alkyl group having 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, 2-diethylaminoethyl), an alkenyl group having 2 to 8 carbon atoms (e.g., vinyl, allyl), an alkoxy group having 1 to 8 carbon atoms (e.g., methoxy, ethoxy, butoxy), a halogen atom (e.g., F, Cl, Br), an amino group having 0 to 10 carbon atoms (e.g., unsubstituted amino, dimethylamino, diethylamino, carboxyethylamino), an ester group (i.e., an alkoxycarbonyl group and an aryloxycarbonyl group) having 2 to 10 carbon atoms (e.g., methoxycarbonyl), an amido group (including an aliphatic and aromatic amido groups) having 1 to 10 carbon atoms (e.g., acetylamido, benzamido), a carbamoyl group having 1 to 10 carbon atoms (e.g., unsubstituted carbamoyl, methylcarbamoyl, ethylcarbamoyl), an aryl group having 6 to 10 carbon atoms (e.g., phenyl, naphthyl, 4-carboxyphenyl, 3-carboxyphenyl, 3,5-dicarboxyphenyl, 4-methylsulfonamidophenyl, 4-butylsulfonamidophenyl), an aryloxy group having 6 to 10 carbon atoms (e.g., phenoxy, 4-carboxypehnoxy, 3-methylphenoxy, naphthoxy), an alkylthio group having 1 to 8 carbon atoms (e.g., methylthio, ethylthio, octylthio), an arylthio group having 6 to 10 carbon atoms (e.g., phenylthio, naphthylthio), an acyl group having 1 to 10 carbon atoms (e.g., acetyl, benzoyl, propanoyl), a sulfonyl group such as an alkylsulfonyl group and an arylsulfonyl group having 1 to 10 carbon atoms (e.g., methylsulfonyl, phenylsulfonyl), a ureido group having 1 to 10 carbon atoms (e.g., ureido, methylureido), a urethane group (i.e., an alkoxycarbonylamino group and an aryloxycarbonylamino group) having 2 to 10 carbon atoms (e.g., methoxycarbonylamino, ethoxycarbonylamino), a cyano group, a hydroxy group, a nitro group and a heterocyclic group such as those defined for Q (e.g., 5-carboxybenzoxazole ring, pyridine ring, sulforane ring, pyrrole ring, pyrrolidine ring, morpholine ring, piperazine ring, pyrimidine ring, furan ring). As discrosed in these examples for the substituents, the substituents may be further substituted with at least one of substituents such as an alkyl group, an aryl group, an alkoxy group, an aryloxy group, an alkylsulfonamido group, an arylsulfonamido group, an acyl group, an alkylcarbonamido group, an arylcarbonamido group, an alkylsulfamoyl group, an arylsulfamoyl group, an acyloxy group, an alkoxy carbonyl group, and aryloxycarbonyl group.

The dyes represented by formulae (I) to (V) preferably have a maximum absorption wavelength of from 400 to 500 nm, more preferably from 430 to 480 nm when the dyes are used as yellow dyes, from 500 to 600 nm, more preferably from 520 to 580 nm when the dyes are used as magenta dyes, and from 630 to 730 nm, more preferably from 650 to 710 nm when the dyes are used as cyan dyes.

Specific examples of the compounds of general formulas (I) to (V) which can be used in the present invention include the following compounds.

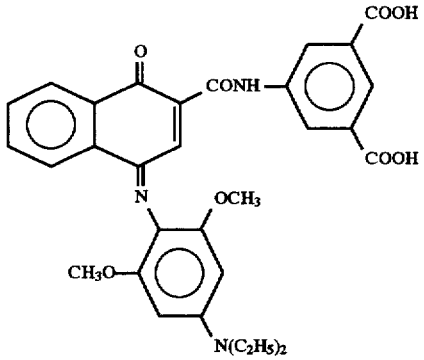

(I-1)

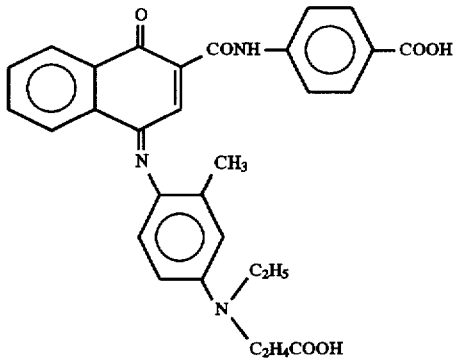

(I-2)

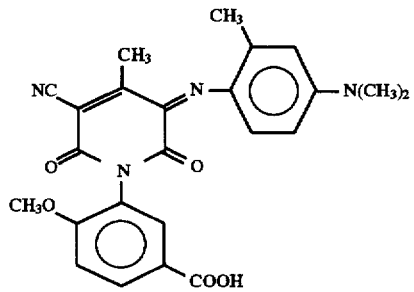

(I-3)

-continued
(I-4)
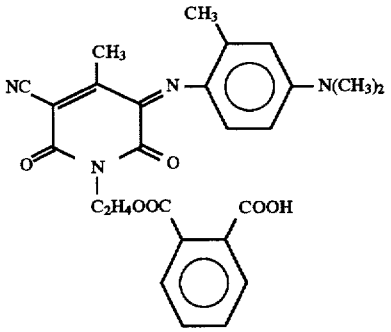
(II-1)
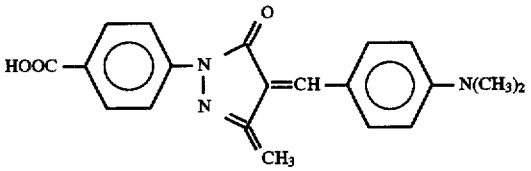
(II-2)
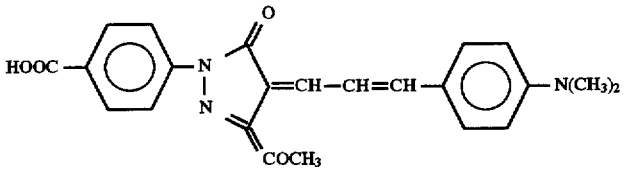
(II-3)
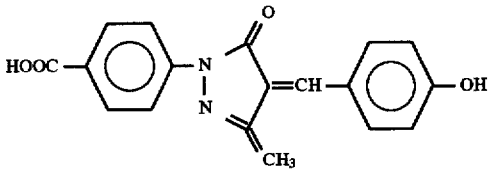
(II-4)
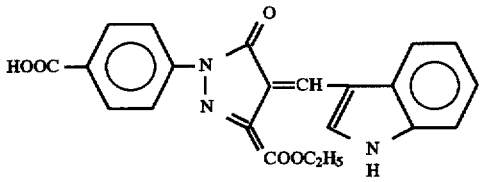
(II-5)
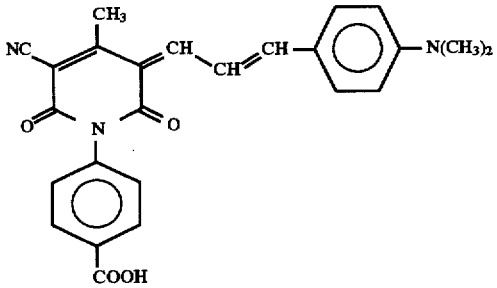
(II-6)
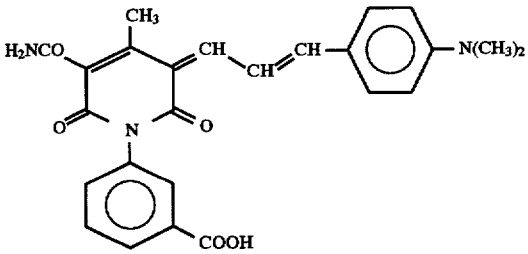

-continued
(II-7)
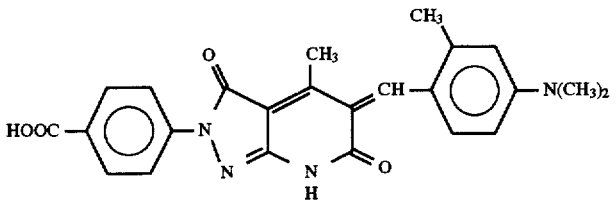
(II-8)
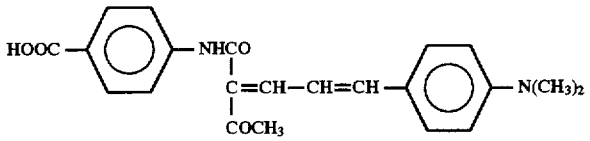
(II-9)
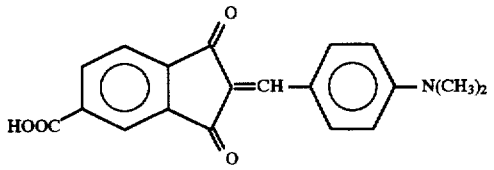
(II-10)
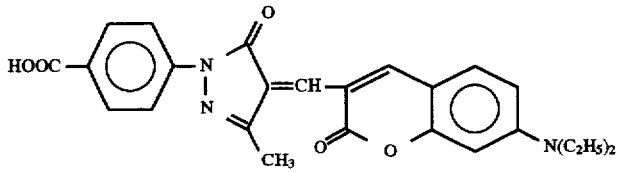
(II-11)
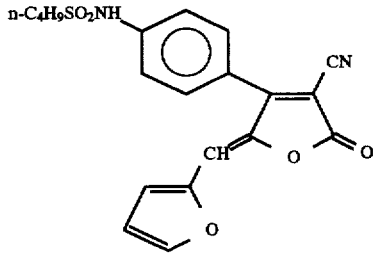
(II-12)
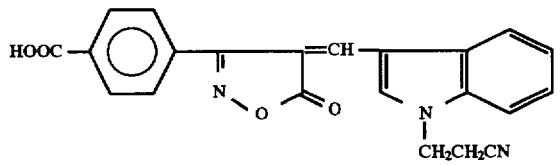
(II-13)
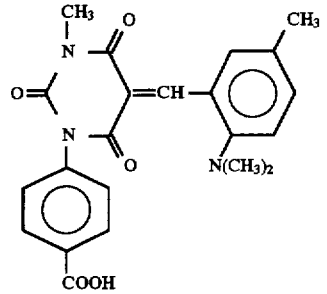
(II-14)
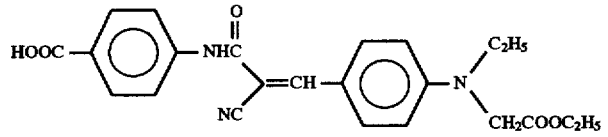

-continued
(II-15)
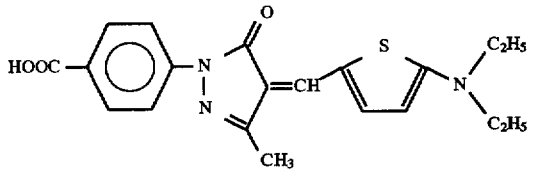
(II-16)
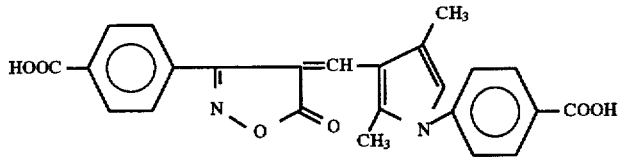
(II-17)
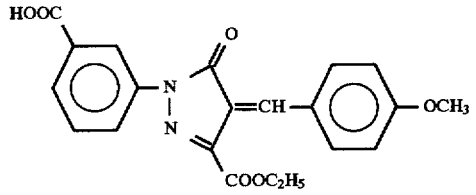
(II-18)
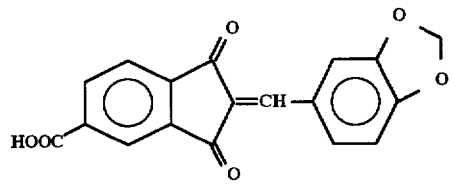
(II-19)
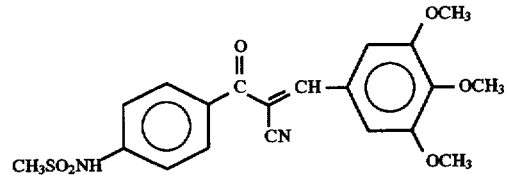
(II-20)
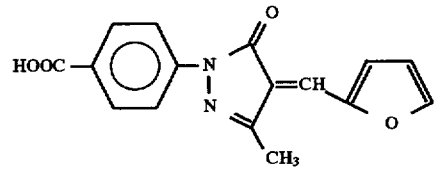
(II-21)
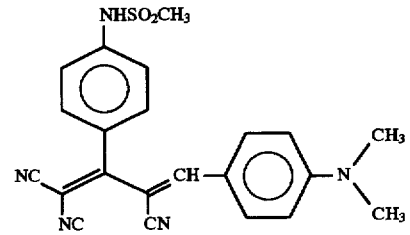
(II-22)
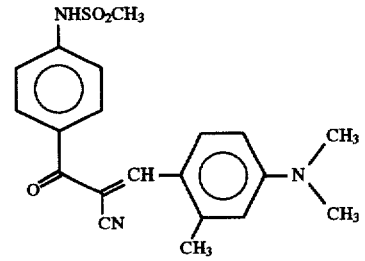

-continued
(II-23)
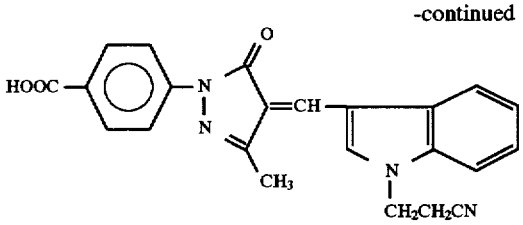
(II-24)
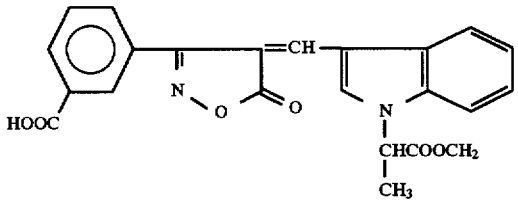
(III-1)
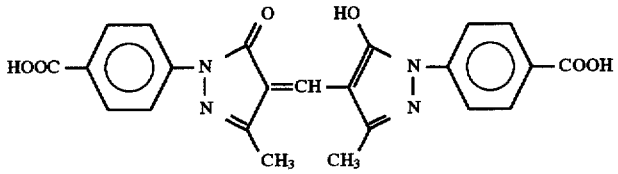
(III-2)
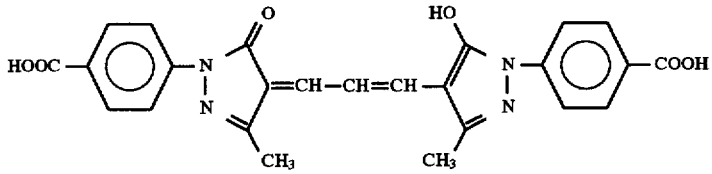
(III-3)
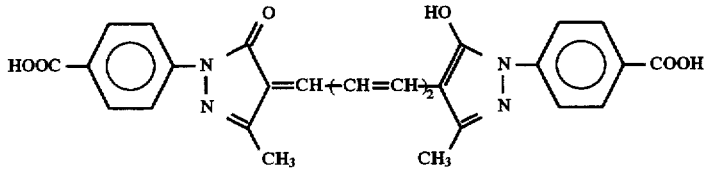
(III-4)
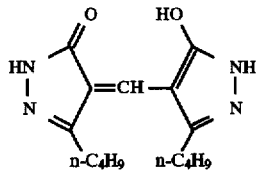
(III-5)
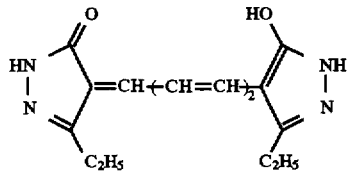
(III-6)
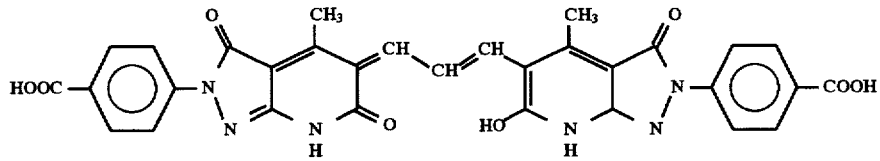
(III-7)
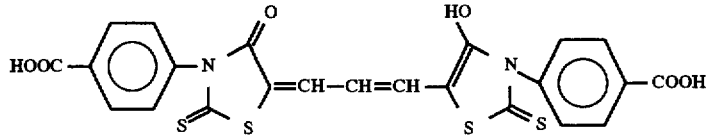

-continued
(III-8)
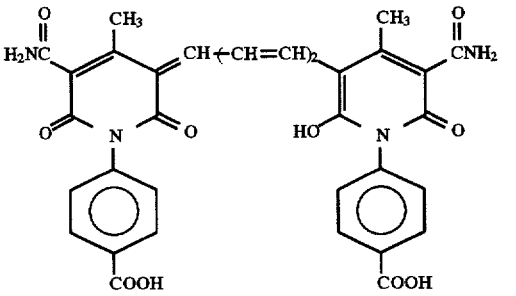
(III-9)
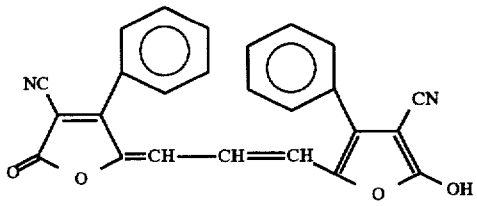
(III-10)
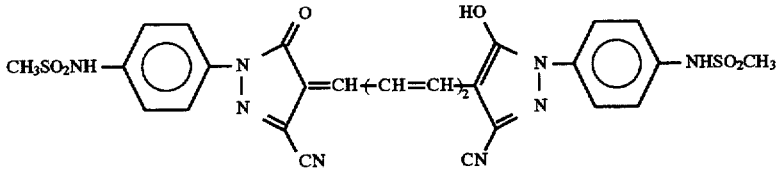
(III-11)
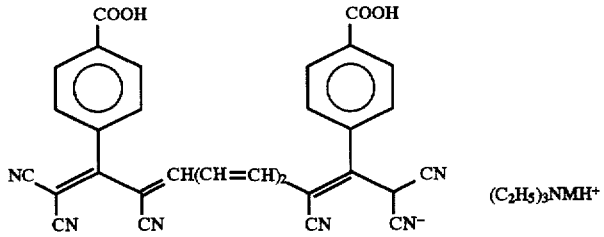
(III-12)
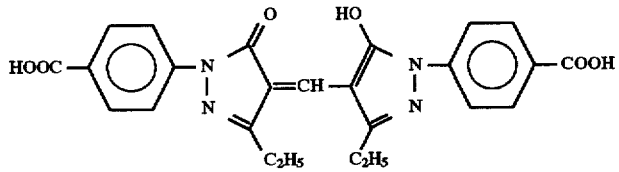
(III-13)
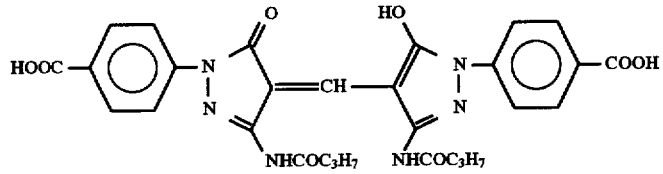
(IV-1)
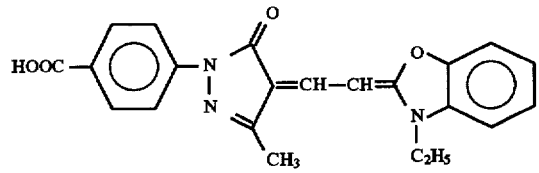
(IV-2)
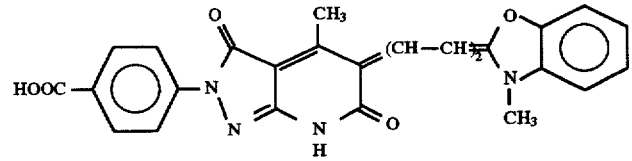

-continued
(IV-3)
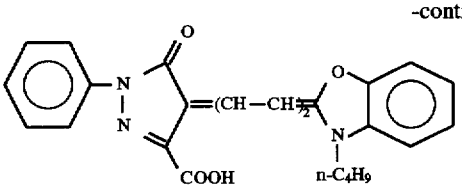
(IV-4)
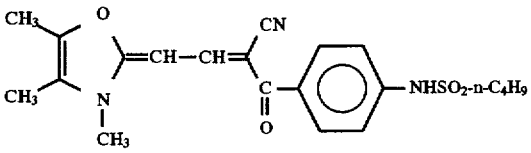
(IV-5)
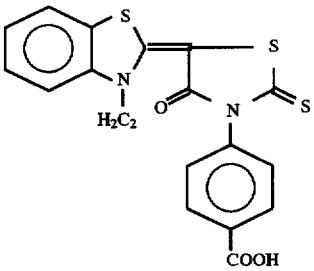
(IV-6)
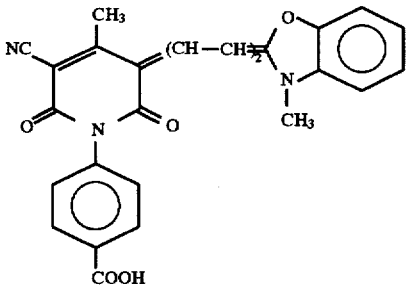
(IV-7)
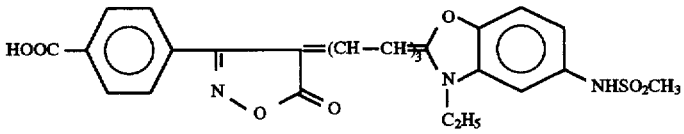
(V-1)
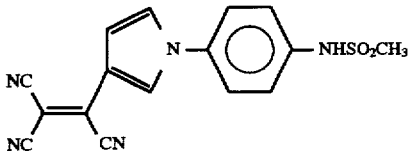
(V-2)
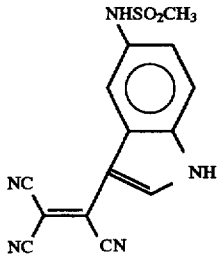
(V-3)
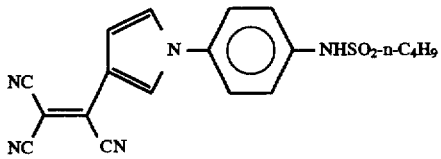

The dyes used in the present invention can be synthesized by the methods described in WO (PCT) 88/04794, European Patents (EP) 274,473A1, 276,566 and 299,435, JP-A-52-92716, JP-A-55-155350, JP-A-55-155351, JP-A-61-205934, JP-A-48-68623, U.S. Pat. Nos. 2,527,583, 3,486,897, 3,746,539, 3,033,798, 4,130,429 and 4,040,842, JP-A-2-282244, JP-A-3-7931 and JP-A-3-167546 or referring thereto.

The dyes of general formula (I) are used as the solid dispersions of fine powders (crystallite particles). The solid dispersions of the fine particles (crystallite particles) of the dyes can be mechanically prepared in the presence of a dispersant (optionally in an appropriate solvent such as water, an alcohol) by using conventional pulverizing means (e.g., ball mill, vibrating ball mill, planetary ball mill, sand mill, colloid mill, jet mill, roller mill). Further, the solid dispersions can be prepared by a method wherein the dyes are dissolved in an appropriate solvent by using a dispersing surfactant, and the resulting solution is added into a poor solvent for the dyes to thereby precipitate out crystallite, or a method wherein the dyes are first dissolved by controlling the pH, and then crystallized by changing the pH to obtain fine particles (crystallite). The layer containing the fine dye particles can be provided on the support in the following manner. The thus obtained fine dye particle (crystallite) is dispersed in an appropriate binder to prepare the nearly uniform solid dispersion and the resulting solid dispersion is coated on the support. Alternatively, the dissociated dyes in the form of a salt are coated on the support, and acidic gelatin is overcoated thereon to obtain the solid dispersion at the time of coating, thereby providing the layer containing the fine dye particles.

Any of binders which can be used for the light-sensitive emulsion layers and the light-insensitive layers can be used without any particular limitation. However, gelatin and synthetic polymers are usually used. The dispersing surfactant which can be used includes conventional surfactants. However, anionic, nonionic and amphoteric surfactants are preferred. Particularly, the use of anionic and/or nonionic surfactants is preferred.

The fine dye particles in the solid dispersions preferably have an average particle size of from 0.005 to 10 μm, more preferably from 0.01 to 1 μm, more preferably from 0.01 to 0.5 μm, particularly preferably from 0.01 to 0.1 μm.

The dispersions of the crystallites of the dyes of general formula (I) are contained in the light-insensitive layers according to the hue of the dyes. In the case of the photographic materials wherein an antihalation layer is provided between the support and the silver halide light-sensitive layer and a plurality of the light-insensitive layers are provided, for example, in the case of the color photographic materials for photographing, the yellow filter layer is provided between the blue-sensitive silver halide light-sensitive layer and the green-sensitive silver halide light-sensitive layer, the magenta filter layer is provided between the green-sensitive silver halide light-sensitive layer and the red-sensitive silver halide light-sensitive layer, and the antihalation layer is provided between the support and the red-sensitive silver halide light-sensitive layer. It is preferred that the crystallite dispersions of te dyes of general formula (I) of the present invention are contained in these light-insensitive layers. A layer containing the crystallite dispersions of the dye of general formula (I) may be provided as the back layer on the opposite side of the support to the silver halide light-sensitive and the light-insensitive layer-coated side.

Generally, yellow dyes of formula (I) are incorporated into a yellow filter layer and/or an untihalation layer, magenta dyes of formula (I) are incorporated into a magenta filter layer and/or an untihalation layer, and cyan dyes of formula (I) are incorporated into an untihalation layer.

It is preferred that when the light-insensitive layers are provided as the functional layers as described above, all of the layers contain the crystallite dispersions of the dyes of general formula (I) in the present invention.

The crystallite dispersions of the dyes of general formula (I) are preferably used in an amount of from $5.0\times10^{-5}$ to 5.0 g, more preferably from $5.0\times10^{-4}$ to 2.0 g, particularly preferably from $5.0\times10^{-3}$ to 1.0 g per $m^2$ of the photographic material. Two or more dyes may be contained in the same layer. The same dye may be contained in two or more layers. If desired, conventional other dyes may be used (preferably in an amount of from $5.0\times10^{-5}$ to 0.3 g/$m^2$) together with the dyes of general formula (I) for the same or different aims. Other dyes may be used according to conventional methods.

In conventional method, so-called mordant method wherein the hydrophilic polymers having an opposite charge to that of the dissociated anionic dyes are allowed to coexist as the mordant in the same layer to thereby fix the dye molecules, and in a conventional method wherein oil-soluble dyes are finely dispersed in water or a gelatin solution by using high-boiling organic solvents, and the resulting dispersion is used or a latex dispersion is used, there are caused problems that dyes are insufficiently fixed and as a result the dyes diffuse into other layers, an photographic characteristics are adversely affected (e.g., desensitization is caused), and that decolorizability is insufficient and as a result, undesired absorption is left behind as residual color after development processing and the image quality is deteriorated. However, when the crystallite dispersions of the dyes of general formula (I) according to the present invention are used, the above-described problems can be improved. Further, when the crystallite dispersions of the dyes of general formula (I) are applied to the photographic materials obtained by using the supports comprising a poly(alkylene aromatic dicarboxylate) heat-treated in the manner as described above, decolorizability can be improved and photographic materials having improved properties with regard to residual color can be provided.

The thickness of the emulsion layer in the photographic material may be made to be small because of the improved curling characteristic and a high mechanical strength of the support. The thickness of the emulsion layer can be selected freely in the present invention.

Gelatin is generally used as the binder in the silver halide light-sensitive layers and the light-insensitive layers of the photographic materials of the present invention. In addition thereto, gelatin derivatives, modified gelatin and gelatin having a specific molecular weight distribution described in JP-A-60-80838 can be used as the binders. Further, synthetic or natural polymers can be used.

Usually, gelatin used as binder for the photographic materials contains calcium salt originating from the starting material or manufacturing process.

It is preferred that the total amount of calcium contained in the silver halide light-sensitive layers and the light-insensitive layers of the photographic material is not more than 65 mg per $m^2$ of the photographic material. Preferably, the lower limit is such that the photographic material is free from calcium. However, the lowest amount is usually at least 1 mg from the economical point of view. The term "total amount of calcium" as used herein refers to the amount by weight of the entire-containing calcium compounds such as calcium ions and calcium salts in terms of calcium atom. The amount of calcium can be determined, for example, by ICP (Induced Combined Plasma) emission spectroscopy.

The total amount of calcium in the present invention is more preferably not more than 55 mg, but not less than 2 mg, particularly preferably not more than 50 mg, but not less than 5 mg.

A method wherein the content of calcium contained in the photographic material is defined is disclosed in, for example, JP-A-4-67033 which relates to inprovement of problem of color photographic paper with regard to residual color stain formed by using the crystallite dispersions of dyes. On the other hand, the present invention relates to that a heat-treated support comprising a poly(alkylene aromatic dicarboxylate) is used, and at least one layer of the nonlight-sensitive layers provided on the support contain the crystallite dispersion of the dye of general formula (I). Further, the total amount of calcium contained in the nonlight-sensitive layers and the silver halide light-sensitive layers of the photographic material is limited to not more than 65 mg per $m^2$ of the photographic material, whereby the stability of the crystallite dispersion of the dye incorporated in the photographic material with time can be improved, and there can be obtained an effect of reducing residual color after development processing.

In the present invention more improved effects can be obtained when the total amount of calcium contained in the layer(s) containing the crystallite dispersions of the dyes is further reduced. For this purpose, the content of calcium is preferably not more than 5 mg, more preferably not more than 3 mg, still more preferably not more than 2 mg per $m^2$ of one layer of the light-insensitive layers. The lowest amount is usually 1 mg.

The content of calcium contained in the photographic material can be reduced by using materials having a low calcium content such as additives (e.g., couplers, etc.) in the coating solutions to be coated on the support in the preparation of the photographic material. The content of calcium can be reduced by subjecting silver halide emulsions containing gelatin and gelatin compositions such as hydrophobic coupler dispersions to noodle washing, dialysis or ultrafiltration. Generally, the calcium content of gelatin is reduced by ion exchange treatment, and this method is preferably used. The ion exchange treatment of gelatin is carried out by bringing a gelatin solution into contact with a cation exchange resin in the preparation of gelatin or in the use thereof. Gelatin having a low calcium content is acid-processed gelatin into which calcium is hardly incorporated during the preparation thereof.

The photographic materials wherein at least one layer of the light-insensitive layers contains the crystallite dispersions of the dye of general formula (I), obtained by using the heat-treated supports comprising a poly(alkylene aromatic dicarboxylate) according to the present invention can be applied to black and white photographic materials such as black and white negative films, microfilms and X-ray films and general-purpose and movie color photographic materials such as color negative films, reversal films, movie color negative films, color positive films and movie positive films.

The above-described black and white photographic materials are prepared by providing the undercoat layers, the silver halide light-sensitive layers and the light-insensitive layers on the above-described supports. Various additives to be used in these constituent layers and processing methods described in JP-A-2-58041 and JP-A-2-68539 can be preferably applied to the above-described black and white photographic materials. Places where the additves and the processing methods are described are listed below.

| Item | Places |
|---|---|
| 1. Silver halide Emulsion and Preparation thereof | the 6th line from the bottom of right lower column of page 8 to the 12th line of right upper column of page 10 of JP-A-2-68539 (corresponding to U.S. Pat. No. 5,118,600) |
| 2. Chemical Sensitization Method | the 13th line of right upper column to the 16th line of left lower column of page 10 of JP-A-2-68539; and selenium sensitization method described in Japanese Patent Application No. 3-189532 (corresponding to EP 514,675A) |
| 3. Anti-fogging Agent Stabilizer | the 17th line of left lower column of page 10 to the 7th line of left upper column of page 11 of JP-A-2-68539; and the 2nd line of left lower column of page 3 to left lower column of page 4 of JP-A-2-68539 |
| 4. Spectrally Sensitizing Dye | the 4th line of right lower column of page 4 to right lower column of page 8 of JP-A-2-68539; and the 8th line of left lower column to the 19th line of right lower column of page 12 of JP-A-2-58041 |
| 5. Surfactant, Antistatic Agent | the 14th line of left upper column of page 11 to the 9th line of left upper column of page 12 of JP-A-2-68539; and the 14th line of left lower column of page 2 to the 12th line of page 5 of JP-A-2-58041 |
| 6. Matting Agent, Plasticizer, Lubricant | the 10th line of left upper column to the 10th line of right upper column of page 12 of JP-A-2-68539; and the 13th line of left lower column of page 5 to the 3rd line of left lower column of page 10 of JP-A-2-58041 |
| 7. Hydrophilic Colloid | the 11th line of right upper column to the 16th line of left lower column of page 12 of JP-A-2-68539 |
| 8. Hardening Agent | the 17th line of left lower column of page 12 to the 6th line of right upper column of page 13 of JP-A-2-68539 |
| 9. Development Processing Method | the 14th line of left upper column to the 13th line of page 15 of JP-A-2-68539 |

When the present invention is applied to color photographic materials for photographing, silver halide emulsions, various additives and processing methods described in European Patent No. 528,435A (the 55th line of page 49 to the 16th line of page 55; and the 20th line of page 55 to the 43rd line of page 58) can be preferably applied to the present invention.

The silver halide photographic material of the present invention may be a silver halide color photographic material comprising a support having thereon at least one undercoat layer, at least one red-sensitive silver halide light-sensitive layer containing at least one cyan coupler, at least one green-sensitive silver halide light-sensitive layer containing at least one magenta coupler, at least one blue-sensitive light-sensitive layer containing at least one yellow coupler and at least one non-sensitive layer.

The photographic materials of the present invention may contain anionic latex polymers described in European Patent (EP) No. 535,535A. The latex polymer-containing layer is provided on the side which is farther away from the support than two silver halide emulsion layers having different color sensitivity so that the layer is allowed to function as a barrier layer which reflects an anionic development restrainer released from DIR compound, whereby an inter image effect (IIE) can be increased or the restrainer can be prevented from flowing into processing solutions.

The latex polymers are the copolymers of vinyl monomers and have preferably at least 1% by weight, more preferably 1 to 20% by weight, still more preferably 3 to 10% by weight of a monomer having an anionic pendant group (e.g., sulfo, sulfino, carboxyl, oxysulfo, phosphono or a salt thereof).

Layers to which the latex polymers are added are preferably the nonlight-sensitive layers, particularly preferably the protective layer (when two or more protective layers are provided, it is preferred that the latex polymers are added to the first protective layer which is nearest to the support) or the yellow filter layer.

The latex polymers are used in an amount of 0.1 to 3.0 $g/m^2$, preferably 0.3 to 2.0 $g/m^2$, more preferably 0.5 to 1.5 $g/m^2$.

Specific examples of the latex polymers include the following compounds (parenthesized numerals represent percentage by weight of each monomer).

L-1: n-Butyl Acrylate/2-Acrylamido-2-methylpropanesulfonic Acid/2-Acetoacetoxyetyl Methacrylate (88:5:7)

L-2: n-Butyl Acrylate/Styrene/Methyl Acrylamide/2-Acrylamido-2-methylpropanesulfonic Acid (59:25:8:8)

L-3: n-Butyl Acrylate/2-Acrylamido-2-methylpropanesulfonic Acid (95:5)

L-4: n-Butyl Acrylate/Styrene/2-Acrylamido-2-methylpropanesulfonic Acid (85:10:5)

L-5: n-Butyl Acrylate/Styrene/2-Acrylamido-2-methylpropanesulfonic Acid (65:30:5)

The photographic materials of the present invention may be provided with a reflection layer containing a polymer having $1\times10^{-5}$ to $4\times10^{-3}$ mol/g of an ion forming functional group described in European Patent (EP) No. 539,729A, said reflection layer having an effect of reflecting a development restrainer released from DIRP compound.

The polymer layer is provided as a nonlight-sensitive layer between two silver halide emulsion layers having different color sensitivity and is allowed to function as a barrier to the diffusion of an anionic development restrainer, whereby an inter image effect (IIE) can be decreased or an effect of DIR compound on the layer containing the same can be increased to improve sharpness.

The polymers are the copolymers of vinyl monomers and comprise at least one hydrophobic vinyl monomer (e.g., acrylates, methacrylates, acrylamides, methacrylamides) and at least one hydrophilic monomer having an ion forming functional group (e.g., primary amino, sulfo, sulfino, carboxy, oxysulfo, phosphono, oxyphosphono or a salt thereof). The polymers may have a functional group capable of crosslinking with gelatin to thereby prevent the polymers from diffusing in the layer.

Layers to which the polymers are added are preferably the light-insensitive layers, particularly preferably an interlayer between the red-sensitive silver halide emulsion layer and the green-sensitive silver halide emulsion layer or an interlayer between the green-sensitive silver halide emulsion layer and the blue-sensitive silver halide emulsion layer. The polymers may be added to a light-sensitive emulsion layer and a layer between silver halide emulsion layers having different sensitivity, but the same color sensitivity.

The polymers are used in an amount of 0.1 to 2.0 $g/m^2$, preferably 0.2 to 1.5 $g/m^2$, more preferably 0.5 to 1.0 $g/m^2$.

Specific examples of the polymers include the following polymers (parenthesized numerals represent percent by weight of each monomer).

IP-1: N-Isopropylacrylamide/N-(3-Aminopropyl) methacrylamide Hydrochloride (90:10)

IP-2: N-t-Butylacrylamide/N-(3-Aminopropyl) methacrylamide Hydrochloride (80:20)

IP-3: N-t-Butylacrylamide/Allylamine Hydrochloride (92:8)

IP-4: N-Butyl Methacrylate/Aminoethyl Methacrylate Hydrochloride/Hydroxyethyl Methacrylate (50:30:20)

IP-5: N-Butyl Methacrylate/Sodium Salt of Sulfoethyl Methacrylate/2-Acetoacetoxyethyl Methacrylate/Hydroxyethyl Methacrylate (60:5:10:25)

IP-6: N-t-Butylacrylamide/Allylamide/N-2-Carboxyethylacrylamide/N-(3-Aminopropyl) methacrylamide Hydrochloride (65:20:5:10)

Examples of the stages of latex dispersion methods, the effects thereof and impregnating latexes are described in U.S. Pat. No. 4,199,363 and West German Patent Application (OLS) Nos. 2,541,274 and 2,541,230.

Developing agents which can be preferably used in color developing solutions used in the present invention include those described in European Patents 530681A (the 54th line of page 92 to the 23rd line of page 93) and 528435A. The color development temperature of the present invention is preferably 40° to 60° C. This is because when such a high temperature as described above is used, the color development time can be shortened so that processing can be rapidly conducted and at the same time, residual color after processing can be reduced. The processing temperature is preferably 40° to 55° C. A temperature range of from 40° to 50° C. is preferred from the standpoint of retaining the above-described effect and the stability and control of the color developing solutions.

The processing temperature of processing solutions (such as bleaching solution, bleach-fixing solution, fixing solution, stabilizing solution, and water-washing liquid) for use in color development processing other than the color developing solutions is in the range of from 20° to 60° C. without particular limitation. A higher temperature may be used to expedite processing or to shorten the processing time. Alternatively, a lower temperature may be used to improve the image quality and the stability of the processing solutions. The processing temperature is preferably in the range of 30° to 60° C.

In addition to the matters described in European Patent 528,435A, it is preferred that compounds described in U.S. Pat. No. 4,414,309 are added as compounds capable of reacting with formaldehyde to fix it, thereby preventing photographic performance from being deteriorated by formaldehyde gas. Yellow couplers which can be preferably used in the present invention include couplers described in U.S. Pat. No. 5,118,599 and European Patents 447,969A and 482,552A. Magenta couplers which can be preferably used include couplers described in U.S. Pat. No. 4,595,650, WO (PCT) 92/18901, WO (PCT) 92/18902, WO (PCT) 92/18903 and WO (PCT) 93/02392. DIR couplers which can be preferably used include couplers described in European Patents 520,496A, 522,371A and 525,396A.

It is preferred that the color developing solutions contain preservatives such as disodium salt of N,N-bis (sulfonatoethyl)hydroxylamine, development accelerators such as amines (e.g., triethanolamine) and fluorescent brighteners.

Examples of bleaching agents which can be used in the bleaching processing include iron (III) complex salts of aminopolycarboxylic acids such as iminodiacetic acid monopropionic acid, N-(2-carboxyphenyl)iminodiacetic acid, ethylenediamine-N,N'-disuccinic acid and 1,3-propylenediamine-N,N'-disuccinic acid. The bleaching agents are used in an amount of 0.03 to 1 mol/liter. Bleaching solutions or bleach-fixing solutions containing the iron (III) complex salts of the aminopolycarboxylic acids have a pH of usually 3 to 8, preferably 3.5 to 6.0. More preferably, the bleaching solutions have a pH of 3.8 to 5.0. It is preferred that the bleaching solutions and the bleach-fixing solutions contain rehalogenating agents such as sodium bromide, potassium bromide, ammonium bromide, and potassium chloride to accelerate the oxidation of silver. Further, it is preferred that the bleaching solutions and the bleach-fixing solutions contain organic acids having an acid dissociation constant (pKa) of 2 to 5 such as malonic acid, citric acid, succinic acid and glutaric acid to prevent bleach stain. The organic acids are used at a concentration of 0.1 to 2.0 mol/liter. Furthermore, it is preferred that the bleaching solutions and the bleach-fixing solutions contain nitrates such as ammonium nitrate and sodium nitrate as metal corrosion inhibitors.

Dye stabilizers which can be preferably used in the final bath for stabilization include N-methylol compounds such as N-methylol-1,2,4-triazole, N-methylol pyrazole and dimethylol urea and azolylmethylamines such as 1,4-bis(1,2,4-triazole-1-yl-methyl)piperazine. These dye image stabilizers are described in JP-A-4-270344, JP-A-4-313753, JP-A-4-359249 and JP-A-5-34889.

A preferred method for intensifying stirring in the desilverization stage is described in JP-A-3-33847 (the 6th line of right upper column to the 2nd line of left lower column of page 8).

It is preferred that bleaching is conducted with aeration. Aeration is described in Z-121, Using Process, C-41 the third edition (1982), pages BL-1 to BL-2 (published by Eastman Kodak Co.).

The silver halide photographic materials of the present invention can be applied to film units with lens described in JP-B-2-32615 and JP-B-U-3-39784 (the term "JP-B-U" as used herein means an "examined Japanese utility model publication").

The present invention is now illustrated in greater detail by reference to the following examples which, however, are not to be construed as limiting the invention in any way.

EXAMPLE 1

(1) Material of Support and Preparation of Support

Each support used in this Example was prepared in the following manner.

PEN: One hundred parts by weight of commercially available poly(ethylene 2,6-naphthalate) (M.W.=150,000) and 2 parts by weight of ultraviolet light absorber (Tinuvin P.326, a product of Geigy) were dried in a conventional manner, molten at 300° C., extruded through a T-die, stretched 3.3 times at 140° C. in the longitudinal direction and then 3.3 times at 130° C. in the crosswise direction and heat set at 200° C. for 6 seconds to obtain a film of 90 μm in thickness.

PET: Commercially available poly(ethylene terephthalate) (M.W.=150,000) film obtained by extrusion was biaxially stretched (3.3 times, at 110° C.) in a conventional manner and heat set (at 200° C. for 6 seconds) to obtain a film of 90 μm in thickness.

TAC: Triacetyl cellulose was prepared by a conventional solution casting process (cast on a flat smooth band) using a solution (methylene chloride/methanol=82/8 by weight; 13 wt % of TAC; 15 wt % of plasticizer composed of TPP/BDP=2/1 by weight, wherein TPP being triphenyl phosphate and BDP being biphenyl diphenyl phosphate).

PEN/PET=4/1 by weight

PEN (M.W.=150,000) pellet and PET (M.W.=150,000) pellet were previously dried in vacuo at 150° C. for 4 hours, melt extruded at 280° C. through a biaxially kneading extruder and pelletized. The resulting polyester was molded into a film under the same conditions as those for PEN.

(2) Coating of Undercoat Layer

Both sides of each support were subjected to corona discharge treatment. Subsequently, an undercoat layer was provided on the the side of the support which was higher temperature during stretching by coating the following undercoating solution having the following composition. The corona discharge treatment was carried out by using solid state corona discharge processor 6 KVA model (a product of Pilar). The support of 30 cm in width was treated at a treating rate of 20 m/min. Current and voltage were read out during treatment, and it was found that a treatment of 0.375 KV·A·min/m$^2$ was made. Discharge frequency during treatment was 9.6 KHz, and the gap clearance between the electrode and the leading roll was 1.6 mm.

| | |
|---|---|
| Gelatin | 3 g |
| Distilled Water | 250 ml |
| Sodium α-Sulfo-di-2-ethylhexyl Succinate | 0.05 g |
| Formaldehyde | 0.02 g |

The TAC support was provided with the following undercoat layer having the following composition.

| | |
|---|---|
| Gelatin | 0.2 g |
| Salicylic Acid | 0.1 g |
| Methanol | 15 ml |
| Acetone | 85 ml |
| Formaldehyde | 0.01 g |

The drying of these undercoat layer was conducted at 80° C. for 10 minutes.

(3) Coating of Back Layer

After the undercoat layer was provided, a back layer having the following composition was coated on the support opposite to the undercoat layer-coated side.

(3-1) Preparation of Electrically Conductive Fine Particle Dispersion (Tin Oxide-Antimony Oxide Composite Material Dispersion)

230 parts by weight of stannic chloride hydrate and 23 parts by weight of antimony trichloride were dissolved into 3,000 parts by weight of ethanol to obtain a uniform solution. An aqueous solution of 1N sodium hydroxide was added dropwise to the resulting solution until the pH of the solution reached 3 to obtain a colloidal co-precipitate of stannic oxide and antimony oxide. The resulting co-precipitate was allowed to stand at 50° C. for 24 hours to obtain a reddish brown colloidal precipitate.

The reddish brown precipitate was centrifuged. Water was added to the precipitate, and the precipitate was washed with water by centrifugation to remove an excess of ion. This operation was repeated three times to remove an excess of ion.

Two hundreds parts by weight of the colloidal precipitate which was free from an excess of ion was redispersed in 1,500 parts by weight of water, and the dispersion was atomized into a calcination furnace heated to 600° C. to obtain a bluish fine powder of a tin oxide-antimony oxide composite material having an average particle size of 0.1 μm. The fine powder had a resistivity of 25 Ω·cm.

The pH of a mixed solution of 40 parts by weight of the fine powder and 60 parts by weight of water was adjusted to 7.9. Subsequently, the mixed solution was coarsely dispersed by an agitator and then dispersed in a horizontal sand mill (Dynomill, a product of Willya Bachofen AG) until the residence time reached 30 minutes to prepare the desired dispersion.

(3-2) Preparation of Back Layer

The following Formulation A was coated onto the support in a thickness of 0.3 μm, and dried at 115° C. for 60 seconds. Furthermore, the following Formulation B was coated onto the thus obtained coating in a thickness of 1 μm and dried at 115° C. or 3 minutes.

| Formulation A | |
|---|---|
| The above-described Electrically Conductive Fine Powder Dispersion | 10 parts by weight |
| Gelatin | 1 part by weight |
| Water | 27 parts by weight |
| Methanol | 60 parts by weight |
| Resorcinol | 2 parts by weight |
| Polyoxyethylene Nonylphenyl Ether | 0.01 part by weight |
| **Coating Solution (B) of Coating Layer** | |
| Cellulose Triacetate | 1 part by weight |
| Acetone | 70 parts by weight |
| Methanol | 15 parts by weight |
| Dichloromethylene | 10 parts by weight |
| p-Chlorophenol | 4 parts by weight |
| Silica Particle (average particle size: 0.2 μm) | 0.01 part by weight |
| Polysiloxane | 0.005 parts by weight |
| $C_{15}H_{31}COOC_{40}H_{81}$/ $C_{50}H_{101}O(CH_2CH_2O)_{16}H$ = (8/2 by weight) Dispersion (average particle size: 20 μm) | 0.01 part by weight (solid content) |

(4) Heat Treatment of Support

After the undercoat layer and the back layer were coated, the support was dried, wound up and separately heat-treated under conditions shown in Tables 2 and 4 described hereinafter. All of the supports were heat-treated in the following manner. The support was wound around a core having a diameter of 30 cm in such a way that the undercoated side was positioned outward. By such a heat treatment each ANSI curl value became less than 100. In addition thereto, PEN, PET and PEN/PET=4/1 (by weight) supports which were not heat-treated were prepared.

(5) Preparation of Emulsion

Preparation of Emulsion A

While a container containing 25 g of potassium bromide, 15 g of potassium iodide, 1.9 g of potassium thiocyanate, 24 g of gelatin and 1 liter of water was kept at 60° C. with vigorously stirring, an aqueous solution of silver nitrate and an aqueous solution of potassium bromide were added thereto by double jet process in a conventional ammonia method to prepare a thick tabular silver iodobromide emulsion which was nearly relatively irregular form and had an iodide content of 10 mol % and a mean grain size of 1.0 μm. Subsequently, the temperature of the emulsion was lowered to 35° C., and soluble salts were removed by an agglomeration precipitation method. Subsequently, the temperature of the emulsion was raised to 40° C., and 82 g of gelatin was added thereto. The pH and the pAg of the emulsion were adjusted to 6.40 and 8.80, respectively, using sodium hydroxide, and sodium bromide.

After the temperature of the emulsion was raised to 61° C., 0.95 g of 2-phenoxyethanol was added thereto. Further, 213 mg of the following Sensitizing Dye-A was added thereto. After 10 minutes, 1.5 mg of sodium thiosulfate pentahydrate, 28 mg of potassium thiocyanate and 0.4 mg of chloroauric acid were added thereto. After 65 minutes, the emulsion was quenched to solidify it.

Sensitizing Dye-A

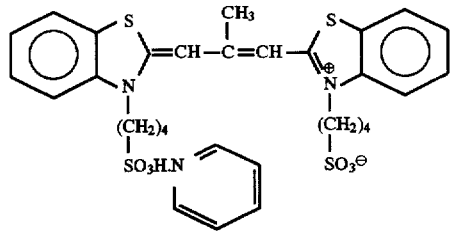

Preparation of Emulsion B

While a container containing 25 g of potassium bromide, 9 g of potassium iodide, 7.6 g of potassium thiocyanate, 24 g of gelatin and 1 liter of water was kept at 40° C. with vigorously stirring, an aqueous solution of silver nitrate and an aqueous solution of potassium bromide were added thereto by double jet process in a conventional ammonia method to prepare a thick tabular silver iodobromide emulsion which was nearly relatively irregular form and had an iodide content of 6 mol % and a mean grain size of 0.6 μm. Subsequently, the temperature of the emulsion was lowered to 35° C., and soluble salts were removed by a precipitation method. The temperature of the emulsion was raised to 40° C., and 110 g of gelatin was added thereto. The pH and the pAg of the emulsion were adjusted to 6.60 and 8.90, respectively, using sodium hydroxide, and sodium bromide. After the temperature was raised to 56° C., 0.8 mg of chloroauric acid, 9 mg of potassium thiocyanate and 4 mg of sodium thiosulfate were added thereto. After 55 minutes, 180 mg of the Sensitizing Dye-A was added thereto. After 10 minutes, the emulsion was quenched to solidify it.

(6) Coating of Light-Sensitive Layer

The following layers were coated on the support prepared above to prepare a photographic material.

| First Layer (antihalation layer) | |
|---|---|
| Gelatin | 1.2 g/m² |
| Compound-II | 210 mg/m² |
| Compound-III | 22.5 mg/m² |
| Dye-I | 30 mg/m² |
| Dye-II | 24 mg/m² |

Compound II

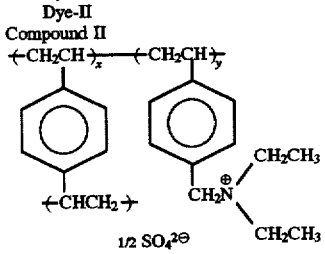

Compound III

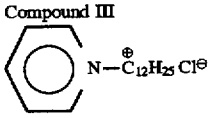

x:y = 20:80 (weight ratio)

-continued

Dye-I

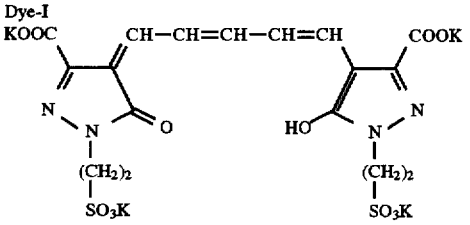

Dye-II

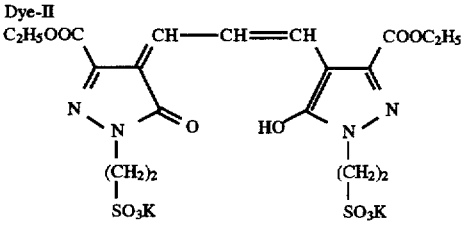

Second Layer (interlayer)

| | |
|---|---|
| Gelatin | 0.5 g/m² |
| Poly(potassium p-vinylbenzenesulfonate) | 5 mg/m² |

Third Layer (emulsion layer)

| | |
|---|---|
| Emulsion B | 1.36 g/m² (silver coated) |
| Gelatin | 2.0 g/m² |
| 4-Hydroxy-6-methyl-1,3,3a,7-tetrazaindene | 15 mg/m² |
| $C_{18}H_{35}O(CH_2CH_2O)_{25}OH$ | 12 mg/m² |
| Compound-IV | 1.5 mg/m² |
| Poly(potassium p-vinylbenzene-sulfonate) | 50 mg/m² |
| Bis(vinylsulfonylacetamido)ethane | 59 mg/m² |

Compound-IV

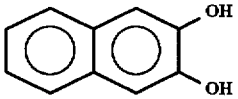

Fourth Layer (emulsion layer)

| | |
|---|---|
| Emulsion A | 4.2 g/m² (silver coated) |
| Gelatin | 5.5 g/m² |
| Dextran (average molecular weight: 150,000) | 1.8 g/m² |
| 4-Hydroxy-6-methyl-1,3,3a,7-tetraza-indene | 30 mg/m² |
| $C_{18}H_{35}O(CH_2CH_2O)_{25}OH$ | 30 mg/m² |
| Trimethylol Propane | 390 mg/m² |
| Poly(potassium p-Vinylbenzenesulfonate) | 88 mg/m² |
| Polyacrylic Acid | 54 mg/m² |

Fifth Layer (surface protective layer)

| | |
|---|---|
| Gelatin | 0.8 g/m² |
| Compound-V | 13 mg/m² |
| Compound-VI | 50 mg/m² |
| Compound-VII | 1.8 mg/m² |
| Poly(potassium p-vinylbenzenesulfonate) | 6 mg/m² |
| Fine Particles of Polymethyl Methacrylate (average particle size: 3 μm) | 24 mg/m² |
| Compound-VIII | 50 mg/m² |

Compound-V

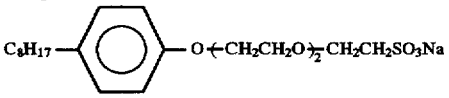

-continued

Compound-VI

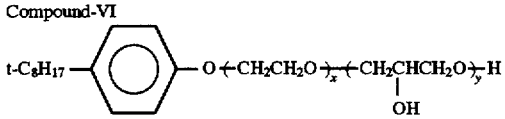

x:y = 10:3 (weight ratio)

Compound-VII

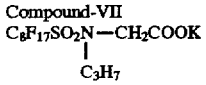

Compound-VIII

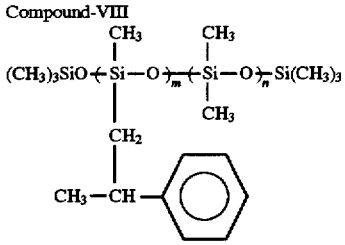

m:n = 29:46 (weight ratio)

(7) Preparation of Photographic Film Sample

The thus prepared photographic sample was slit into film samples of 1.8 m long by 35 mm width and perforated. Each of the resulting film samples was incorporated into a unit shown in FIG. 1 or 2 to prepare a film integrated camera. In this way, samples 101 to 128 were prepared.

Figure 1:
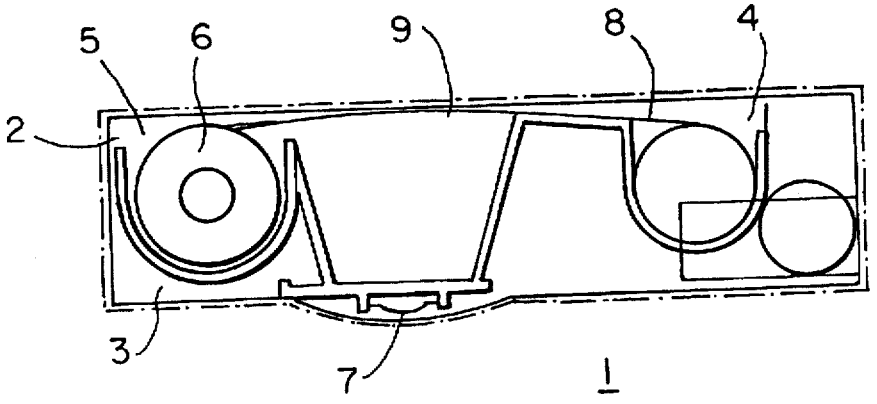
FIG. 1 is a top view of the internal structure of a film integrated camera.

FIG. 1 is a top view showing the internal structure of the film integrated camera. The camera 1 comprises a camera box 2 in which a unit 3 is housed. In the unit 3, a supply chamber 4 is located with an unexposed film 8 pulled out of a patrone 6 in a wind-up chamber 5 and rolled up. Every time photographing is made, the film is pulled out of the supply chamber 4 and rolled up in the patrone 6. Numeral 7 represents a camera lens, numeral 9 represents a film supporting plate, and numeral 8 represents a film of 1.8 m length.

FIG. 2 shows only the unit 13 of another type of a film integrated camera. The unit is provided with a spool 22 in a supply chamber 14 in addition to a spool 21 in a patrone 16 in a wind-up chamber 15 (in the illustration of FIG. 1, the explanation of the spool is omitted). Numerial 17 represents a lens unit, numeral 18 represents a film of 1.8 m length, and numeral 20 represents an exposure frame.

For the purpose of comparison, samples 129 to 132 were prepared by changing the heat treatment temperature/time of the PEN support and the spool diameter and rolled-up diameter of the film integrated camera as shown in Table 2 below.

Further, samples were prepared in the same manner as described above except that the compound-II and the compound-III used in the first layer (antihalation layer) were omitted, and the dye III-6 (100 mg/m²) of general formula (I) and the dye III-4 (40 mg/m²) of general formula (I) according to the present invention were used in place of the dye-I and the dye-II used in the first layer. In the preparation of the samples, various samples were used as described above without changing other layers.

The dye dispersions used in the preparation of these samples were prepared in the following manner.

Preparation of Dye Dispersion

Water (434 ml) and a 6.7% solution of Triton X-200 surfactant (53 g) (a product of Rohm & Hass) were put into a 1.5 liter bottle with a screw cap.

Subsequently, 20 g of the dye an zirconium oxide (ZrO) beads (800 ml) having a diameter os 2 mm were added thereto, and the cap was firmly screwed. The bottle was placed in a mill, and the content was pulverized for 4 days.

The content was added to a 12.5% aqueous solution of gelatin (160 g), and the mixture was placed in a roll mill for 10 minutes to reduce bubbles. The resulting mixture was filtered to remove ZrO beads.

Samples 133 to 164 were prepared from the resulting film samples in the same manner as in the preparation of photographic film unit described in (7) above.

The total calcium content of the thus prepared photographic material (sample) was analyzed by the above-described method. The total calcium content of the photographic material was 16.3 mg/m$^2$, and the calcium content of the first layer was 1.7 mg/m$^2$.

(8) Core Set

The film integrated cameras were heated at 40° C. for 24 hours to form winding curl. The temperature conditions are set by taking temperature conditions in the open air in summer into consideration.

(9) Drawing-out of Tip, Development, Measurement of Curl

The film integrated cameras containing the film having winding curl formed under the above-described conditions were allowed to cool in a room at 25° C. overnight, and the tip of the film was drawn out by a tool. The films were processed in an automatic processor (Minilabo FP 502). Immediately after processing, curl was measured at 25° C. and 60% RH. The measurement was made according to ANSI/ASC, pH 1.29-1985, Method A. The measured value is shown by 1/R [m] (wherein R is the radius of curl). The curl values thus obtained can be considered that the core set of the film was conducted on a roll having a diameter of 11 mm.

Separately, other samples were used to conduct another experiment. One group of the samples was stored at 5° C. 35% RH for 7 days. Another group of the samples was stored at 40° C. and 80% RH for 7 days. These samples were exposed to light (color temperature of 5400° K. obtained by passing light from a tungsten light source having a color temperature of 2854° K. through a color temperature conversion filter) through a wedge for 1/100 sec. The exposed samples were processed, and the density of each sample was measured. The sensitivity is determined by calculating the logarithm value of the reciprocal of an exposure amount providing a density of (fog+0.1). A difference in the sensitivity ($\Delta S=S_1-S_2$) and fog density ($\Delta Fog=F_2-F_1$) between the sample stored under low temperature and humidity conditions ($S_1$, $F_1$) and that stored under high temperature and humidity conditions ($S_2$, $F_2$) is determined.

The development processings used were as follows:

| | Processing Solution | Temp. | Time |
|---|---|---|---|
| Development | HPD* | 26.5° C. | 55 sec |
| Fixing | Super Fuji Fix DP2* | 26.5° C. | 76 sec |
| Rinsing | Running Water | 20° C. | 95 sec |
| Drying | | 50° C. | 69 sec |

*HPD and Super Fuji Fix DP2 are trade names of products manufactured by Fuji Photo Film Co., Ltd.

The results obtained are shown in Tables 1 to 4 below.

TABLE 1

| Sample | Support | | | Supply Chamber | | | Heat | | ANSI | Marring | | Photo- | |
|---|---|---|---|---|---|---|---|---|---|---|---|---|---|
| | | | | Rolled-up | Spool | Patrone | | | Curl | and | Rear | graphic | |
| | | Thick- | | Inner | Inner | Spool | Treat- | Drawing- | Value | Uneven | End | Charac- | |
| No. | Material | ness [μm] | Tg [°C.] | Diameter [mm] | Diameter [mm] | Diameter [mm] | ment [°C./hrs] | out of Tip | after Processing | Develop- ment | Fold- ing | teristics ΔS | ΔFog |
| 101 (Comp. Ex.) | TAC | 122 | — | — | 7.0 | 11.5 | omitted | difficult | 156 | not found | occur | 0.06 | 0.05 |
| 102 (Comp. Ex.) | " | " | — | 13.02 | — | " | " | " | 134 | " | " | " | " |
| 103 (Comp. Ex.) | " | " | — | — | 9.0 | 9.0 | " | " | 169 | " | " | " | " |
| 104 (Comp. Ex.) | " | " | — | 13.02 | — | 7.0 | " | impossible | 184 | found | " | " | " |
| 105 (Comp. Ex.) | PET | 90 | 80 | — | 7.0 | 11.5 | " | difficult | 168 | not found | occur | 0.06 | 0.05 |
| 106 (Comp. Ex.) | " | " | — | 13.02 | — | " | " | " | 152 | " | " | " | " |
| 107 (Comp. Ex.) | " | " | — | — | 9.0 | 9.0 | " | impossible | 178 | found | " | " | " |
| 108 (Comp. Ex.) | " | " | — | 13.02 | — | 7.0 | " | " | 180 | " | " | " | " |
| 109 (Comp. Ex.) | PEN | 90 | 119 | — | 7.0 | 11.5 | " | difficult | 95 | not found | occur | 0.06 | 0.05 |
| 110 (Comp. Ex.) | " | " | — | 13.02 | — | " | " | " | 82 | " | " | " | " |

TABLE 1-continued

| Sample No. | Support Material | Support Thickness [μm] | Support Tg [°C.] | Supply Chamber Rolled-up Inner Diameter [mm] | Supply Chamber Spool Inner Diameter [mm] | Supply Chamber Patrone Spool Diameter [mm] | Heat Treatment [°C./hrs] | Drawing-out of Tip | ANSI Curl Value after Processing | Marring and Uneven Development | Rear End Folding | Photographic Characteristics ΔS | Photographic Characteristics ΔFog |
|---|---|---|---|---|---|---|---|---|---|---|---|---|---|
| 111 (Comp. Ex.) | " | " | — | — | 9.0 | 9.0 | " | " | 92 | " | " | " | " |
| 112 (Comp. Ex.) | " | " | — | 13.02 | — | 7.0 | " | " | 97 | " | " | " | " |
| 113 (Comp. Ex.) | PEN/PET = 4/1 | 90 | 104 | — | 7.0 | 11.5 | " | difficult | 95 | not found | occur | 0.06 | 0.05 |
| 114 (Comp. Ex.) | PEN/PET = 4/1 | " | — | 13.02 | — | " | " | " | 82 | " | " | " | " |
| 115 (Comp. Ex.) | PEN/PET = 4/1 | " | — | — | 9.0 | 9.0 | " | " | 93 | " | " | " | " |
| 116 (Comp. Ex.) | PEN/PET = 4/1 | " | — | 13.02 | — | 7.0 | " | " | 98 | " | " | " | " |

TABLE 2

| Sample No. | Support Material | Support Thickness [μm] | Support Tg [°C.] | Supply Chamber Rolled-up Inner Diameter [mm] | Supply Chamber Spool Inner Diameter [mm] | Supply Chamber Patrone Spool Diameter [mm] | Heat Treatment [°C./hrs] | Drawing-out of Tip | ANSI Curl Value after Processing | Marring and Uneven Development | Rear End Folding | Photographic Characteristics ΔS | Photographic Characteristics ΔFog |
|---|---|---|---|---|---|---|---|---|---|---|---|---|---|
| 117 (Comp. Ex.) | PET | 90 | 80 | — | 7.0 | 11.5 | 75/24 | easy | 48 | not found | not occur | 0.05 | 0.04 |
| 118 (Comp. Ex.) | " | " | " | 13.02 | — | " | " | " | 42 | " | " occur | " | " |
| 119 (Comp. Ex.) | " | " | " | — | 9.0 | 9.0 | " | " | 51 | " | not occur | " | " |
| 120 (Comp. Ex.) | " | " | " | 13.02 | — | 7.0 | " | " | 53 | " | not occur | " | " |
| 121 (Comp. Ex.) | PEN | 90 | 119 | — | 7.0 | 11.5 | 110/48 | easy | 41 | not found | not occur | 0.05 | 0.04 |
| 122 (Comp. Ex.) | " | " | " | 13.02 | — | " | " | " | 36 | " | not occur | " | " |
| 123 (Comp. Ex.) | " | " | " | — | 9.0 | 9.0 | " | " | 42 | " | not occur | " | " |
| 124 (Comp. Ex.) | " | " | " | 13.02 | — | 7.0 | " | " | 45 | " | not occur | " | " |
| 125 (Comp. Ex.) | PEN/PET = 4/1 | 90 | 104 | — | 7.0 | 11.5 | 95/48 | easy | 41 | not found | not occur | " | " |
| 126 (Comp. Ex.) | PEN/PET = 4/1 | " | " | 13.02 | — | " | " | " | 36 | " | not occur | " | " |
| 127 (Comp. Ex.) | PEN/PET = 4/1 | " | " | — | 9.0 | 9.0 | " | " | 44 | " | not occur | " | " |
| 128 (Comp. Ex.) | PEN/PET = 4/1 | " | " | 13.02 | — | 7.0 | " | " | 47 | " | not occur | " | " |

TABLE 3

| Sample No. | Support Material | Support Thickness [μm] | Support Tg [°C.] | Supply Chamber Rolled-up Inner Diameter [mm] | Supply Chamber Spool Inner Diameter [mm] | Patrone Spool Diameter [mm] | Heat Treatment [°C./hrs] | Drawing-out of Tip | ANSI Curl Value after Processing | Marring and Uneven Development | Rear End Folding | Photographic Characteristics ΔS | Photographic Characteristics ΔFog |
|---|---|---|---|---|---|---|---|---|---|---|---|---|---|
| 129 (Comp. Ex.) | TAC | 122 | — | — | 7.0 | 11.5 | omitted | difficult | 157 | not found | occur | 0.05 | 0.04 |
| 130 (Comp. Ex.) | " | " | — | 13.02 | — | " | " | " | 135 | " | " | " | " |
| 131 (Comp. Ex.) | " | " | — | — | 9.0 | 9.0 | " | " | 170 | " | " | " | " |
| 132 (Comp. Ex.) | " | " | — | 13.02 | — | 7.0 | " | impossible | 185 | found | " | " | " |
| 133 (Comp. Ex.) | PET | 90 | 80 | — | 7.0 | 11.5 | " | difficult | 169 | not found | occur | 0.05 | 0.04 |
| 134 (Comp. Ex.) | " | " | " | 13.02 | — | " | " | " | 153 | " | " | " | " |
| 135 (Comp. Ex.) | " | " | " | — | 9.0 | 9.0 | " | impossible | 180 | found | " | " | " |
| 136 (Comp. Ex.) | " | " | " | 13.02 | — | 7.0 | " | " | 182 | " | " | " | " |
| 137 (Comp. Ex.) | PEN | 90 | 119 | — | 7.0 | 11.5 | " | difficult | 96 | not found | occur | 0.05 | 0.04 |
| 138 (Comp. Ex.) | " | " | " | 13.02 | — | " | " | " | 82 | " | " | " | " |
| 139 (Comp. Ex.) | " | " | " | — | 9.0 | 9.0 | " | " | 93 | " | " | " | " |
| 140 (Comp. Ex.) | " | " | " | 13.02 | — | 7.0 | " | " | 98 | " | " | " | " |
| 141 (Comp. Ex.) | PEN/PET = 4/1 | 90 | 104 | — | 7.0 | 11.5 | " | " | 96 | not found | occur | 0.05 | 0.04 |
| 142 (Comp. Ex.) | PEN/PET = 4/1 | " | " | 13.02 | — | " | " | " | 82 | " | " | " | " |
| 143 (Comp. Ex.) | PEN/PET = 4/1 | " | " | — | 9.0 | 9.0 | " | " | 94 | " | " | " | " |
| 144 (Comp. Ex.) | PEN/PET = 4/1 | " | " | 13.02 | — | 7.0 | " | " | 99 | " | " | " | " |

TABLE 4

| Sample No. | Support Material | Support Thickness [μm] | Support Tg [°C.] | Supply Chamber Rolled-up Inner Diameter [mm] | Supply Chamber Spool Inner Diameter [mm] | Patrone Spool Diameter [mm] | Heat Treatment [°C./hrs] | Drawing-out of Tip | ANSI Curl Value after Processing | Marring and Uneven Development | Rear End Folding | Photographic Characteristics ΔS | Photographic Characteristics ΔFog |
|---|---|---|---|---|---|---|---|---|---|---|---|---|---|
| 145 (Invention) | PET | 90 | 80 | — | 7.0 | 11.5 | 75/24 | easy | 48 | not found | not occur | 0.02 | 0.02 |
| 146 (Invention) | " | " | " | 13.02 | — | " | " | " | 42 | " | " | " | " |
| 147 | " | " | " | — | 9.0 | 9.0 | " | " | 51 | " | " | " | " |

TABLE 4-continued

| Sample No. | Support Material | Support Thickness [μm] | Support Tg [°C.] | Supply Chamber Rolled-up Inner Diameter [mm] | Supply Chamber Spool Inner Diameter [mm] | Supply Chamber Patrone Spool Diameter [mm] | Heat Treatment [°C./hrs] | Drawing-out of Tip | ANSI Curl Value after Processing | Marring and Uneven Development | Rear End Folding | Photographic Characteristics ΔS | Photographic Characteristics ΔFog |
|---|---|---|---|---|---|---|---|---|---|---|---|---|---|
| (Invention) | | | | | | | | | | | | | |
| 148 (Invention) | " | " | " | 13.02 | — | 7.0 | " | " | 53 | " | " | " | " |
| 149 (Invention) | PEN | 90 | 119 | — | 7.0 | 11.5 | 110/48 | easy | 41 | not found | not | 0.01 | 0.01 |
| 150 (Invention) | " | " | " | 13.02 | — | " | " | " | 36 | " | " | " | " |
| 151 (Invention) | " | " | " | — | 9.0 | 9.0 | " | " | 42 | " | " | " | " |
| 152 (Invention) | " | " | " | 13.02 | — | 7.0 | " | " | 45 | " | " | " | " |
| 153 (Invention) | PEN/PET = 4/1 | 90 | 104 | — | 7.0 | 11.5 | 95/48 | easy | 41 | not found | not occur | 0.01 | 0.01 |
| 154 (Invention) | PEN/PET = 4/1 | " | " | 13.02 | — | " | " | " | 36 | " | not occur | " | " |
| 155 (Invention) | PEN/PET = 4/1 | " | " | — | 9.0 | 9.0 | " | " | 44 | " | not occur | " | " |
| 156 (Invention) | PEN/PET = 4/1 | " | " | 13.02 | — | 7.0 | " | " | 47 | " | not occur | " | " |

In Tables 1 to 4 above, even-numbered samples such as the samples 102, 104, 106, 108, etc. (the rolled-up inner diameter of the supply chamber is shown) are the embodiments of the core set wherein the films are applied to the film integrated camera of FIG. 1, and odd-numbered samples such as the samples 101, 103, 105, 107, etc. (the spool inner diameter of the supply chamber is shown) are embodiments of the core set wherein the films are applied to the film integrated camera of FIG. 2.

The dye-I and the dye-II used in the first layer (antihalation layer) of the samples 101 to 128 shown in Tables 1 and 2 are fixed to the first layer by the compounds II and III (mordants). The samples 129 to 156 shown in Tables 3 and 4 correspond to the samples 101 to 128 shown in Tables 1 and 2, and the crystallite dispersions of the dyes (III-4) and (III-6) of general formula (I) according to the present invention are contained in the antihalation layer of the samples 129 to 156.

When the films obtained by using the polyester supports previously heat-treated according to the present invention are applied to the film integrated cameras, it can be seen that curl values are small even when the spool diameters are reduced to 11.5 to 7.0 μm. Accordingly, the drawing-out of the tip of the film for pulling out the film from the patrone can be easily made, and troubles such as uneven development, marring and rear end folding do not occur during the development processing of the films. On the other hand, when the support is composed of TAC or when the supports are composed of the polyesters which are heat-treated at a temperature of lower than 40° C. (outside the scope of the present invention) or are not heat-treated, all of the requirements with regard to the drawing-out of the tip of the film, uneven development, marring and rear end folding can not be met simultaneously.

When the samples 101 to 128 are compared with the samples 129 to 156, it is clear that when the crystallite dispersions of the dyes of general formula (I) are applied to the nonlight-sensitive layer of the photographic materials obtained by using the heat-treated polyester supports, a change in the photographic properties with regard to the sensitivity and fog density including residual color is small, particularly when the samples 117 to 128 are compared with the samples 145 to 156. It is believed that a change in the sensitivity and the fog density is caused by that the dyes to be fixed diffuse and have an adverse effect on the photographic performance and properties with regard to residual color when the samples 117 to 128 are stored under high temperature and humidity conditions.

When the thickness of the support is reduced to less than 50 μm, the support does not have sufficient bending elasticity for withstanding the shrinkage stress of the light-sensitive layers, and tub-form curl tends to form even when the PET and PEN supports are used, though these embodiments are not shown in Tables. Accordingly, marring often occurs during processing. When the thickness of the support is more than 130 μm, it is difficult that the film is wound around the spool and housed in the patrone or in the supply chamber. Accordingly, it will be difficult to miniaturize the camera and the patrone.

EXAMPLE 2

The following layers having the following compositions were coated on each of the PEN support which was heat-treated and the PEN support which was not heat-treated, prepared in Example 1, to prepare multi-layer color photographic materials. Further, a magnetic layer was provided on the back layer. The coating composition for the magnetic layer was coated in such an amount that the coating weight of fine crystaline powder of $\gamma$-$Fe_2O_3$ was 1.8 g/m$^2$.

Composition of Light-Sensitive Layer

The following abbreviations for the following ingredients are used.

ExC: Cyan Coupler
ExM: Magenta Coupler
ExY: Yellow Coupler
ExS: Sensitizing Dye
UV: Ultraviolet Light Absorber
HBS: High-Boiling Organic Solvent
H: Hardening Agent for Gelatin Numerals represent coating weights (g/m$^2$). The amount of the silver halide are represented by coating weights in terms of silver. The coating weights of the sensitizing dyes are represented by moles per one mole of silver halide in the same layer.

| First Layer (antihalation layer) | |
|---|---|
| Black Colloidal Silver (in terms of silver) | 0.18 |
| Gelatin | 1.60 |
| ExM-1 | 0.12 |
| ExF-1 | $2.0 \times 10^{-3}$ |
| HBS-1 | 0.15 |
| HBS-2 | 0.02 |
| **Second Layer (interlayer)** | |
| Silver Iodobromide Emulsion M (in terms of silver) | 0.065 |
| ExC-2 | 0.04 |
| Polyethyl Acrylate Latex | 0.20 (solid) |
| Gelatin | 1.04 |
| **Third Layer (low-sensitivity red-sensitive emulsion layer)** | |
| Silver Iodobromide Emulsion A (in terms of silver) | 0.25 |
| Silver Iodobromide Emulsion B (in terms of silver) | 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.050 |
| ExC-5 | 0.020 |
| ExC-6 | 0.010 |
| ExC-9 | 0.065 |
| Cpd-2 | 0.025 |
| HBS-1 | 0.010 |
| Gelatin | 0.87 |
| **Fourth Layer (intermediate sensitivity red-sensitive emulsion layer)** | |
| Silver Iodobromide Emulsion C (in terms of silver) | 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |

-continued

| | |
|---|---|
| Cpd-2 | 0.023 |
| HBS-1 | 0.10 |
| Gelatin | 0.75 |
| **Fifth Layer (high-sensitivity red-sensitive emulsion layer)** | |
| Silver Iodobromide Emulsion D (in terms of silver) | 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| **Sixth Layer (interlayer)** | |
| Cpd-1 | 0.090 |
| IP-1 | 0.70 |
| Comparative Dye (1) | 0.010 |
| HBS-1 | 0.11 (solid) |
| Polyethyl Acrylate Latex | 0.15 |
| Gelatin | 1.10 |
| **Seventh Layer (low-sensitivity green-sensitive emulsion layer)** | |
| Silver Iodobromide Emulsion E (in terms of silver) | 0.15 |
| Silver Iodobromide Emulsion F (in terms of silver) | 0.10 |
| Silver Iodobromide Emulsion G (in terms of silver) | 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.20 |
| ExM-3 | 0.086 |
| ExM-8 | 0.15 |
| ExY-1 | 0.010 |
| ExC-10 | 0.005 |
| HBS-1 | 0.25 |
| HBS-5 | 0.05 |
| Gelatin | 0.73 |
| **Eighth Layer (intermediate-sensitivity green-sensitve emulsion layer)** | |
| Silver Iodobromide Emulsion H (in terms of silver) | 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.080 |
| ExM-3 | 0.025 |
| ExM-6 | 0.020 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| **Ninth Layer (high-sensitivity green-sensitive emulsion layer)** | |
| Silver Iodobromide Emulsion I (in terms of silver) | 1.25 |
| ExS-4 | $3.7 \times 10^{-5}$ |
| ExS-5 | $8.1 \times 10^{-5}$ |
| ExS-6 | $3.2 \times 10^{-4}$ |
| ExS-1 | 0.010 |
| ExC-10 | 0.010 |
| ExM-1 | 0.010 |
| ExM-4 | 0.025 |

-continued

| | |
|---|---|
| ExM-5 | 0.040 |
| ExM-7 | 0.010 |
| Cpd-3 | 0.040 |
| HBS-1 | 0.25 |
| Polyethyl Acrylate Latex | 0.15 (solid) |
| Gelatin | 1.33 |
| Tenth Layer (yellow filter layer) | |
| Cpd-1 | 0.16 |
| L-1 | 0.70 |
| Comparative Dye (2) | 0.22 |
| HBS-1 | 0.60 |
| Gelatin | 1.10 |
| Eleventh Layer (low-sensitivity blue-sensitive emulsion layer) | |
| Silver Iodobromide Emulsion J (in terms of silver) | 0.09 |
| Silver Iodobromide Emulsion K | 0.09 |

-continued

| | |
|---|---|
| (in terms of silver) | |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.55 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer (high-sensitivity blue-sensitive emulsion layer) | |
| Silver Iodobramide Emulsion L (in terms of silver) | 1.00 |
| ExS-7 | $4.0 \times 10^{-4}$ |
| ExC-7 | $3.0 \times 10^{-3}$ |
| ExY-2 | 0.10 |
| ExY-3 | 0.11 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth Layer (first protective layer) | |
| UV-1 | 0.15 |

-continued

| | |
|---|---|
| UV-2 | 0.075 |
| UV-3 | 0.065 |
| UV-4 | 0.060 |
| HBS-1 | $5.0 \times 10^{-2}$ |
| HBS-4 | $5.0 \times 10^{-2}$ |
| Gelatin | 1.8 |
| Fourteenth Layer (second protective layer) | |
| Silver Iodobromide Emulsion M (in terms of silver) | 0.10 |
| H-1 | 0.43 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, each layer properly contained W-1 to W-4, B-4 to B-6, F-1 to F-18, an iron salt, a lead salt, a gold salt, a platinum salt, a palladium salt, an iridium salt and a rhodium salt.

TABLE 5

| | Average AgI Content (mol %) | Coefficient of Variation in AgI Content Distribution of Grains (%) | Mean Grain Size in terms of Average of Diameters of corresponding Spheres (μm) | Coefficient of Variation in Grain Size Distribution (%) | Diameters of corresponding Circles projected (μm) | Ratio of Diameter to Thickness |
|---|---|---|---|---|---|---|
| Emulsion A | 1.7 | 10 | 0.46 | 15 | 0.56 | 5.5 |
| Emulsion B | 3.5 | 15 | 0.57 | 20 | 0.78 | 4.0 |
| Emulsion C | 8.9 | 25 | 0.66 | 25 | 0.87 | 5.8 |
| Emulsion D | 8.9 | 18 | 0.84 | 26 | 1.03 | 3.7 |
| Emulsion E | 1.7 | 10 | 0.46 | 15 | 0.56 | 5.5 |
| Emulsion F | 3.5 | 15 | 0.57 | 20 | 0.78 | 4.0 |
| Emulsion G | 8.8 | 25 | 0.61 | 23 | 0.77 | 4.4 |
| Emulsion H | 8.8 | 25 | 0.61 | 23 | 0.77 | 4.4 |
| Emulsion I | 8.9 | 18 | 0.84 | 26 | 1.03 | 3.7 |
| Emulsion J | 1.7 | 10 | 0.46 | 15 | 0.50 | 4.2 |
| Emulsion K | 8.8 | 18 | 0.64 | 23 | 0.85 | 5.2 |
| Emulsion L | 14.0 | 25 | 1.28 | 26 | 1.46 | 3.5 |
| Emulsion M | 1.0 | — | 0.07 | 15 | — | 1 |

In Table 5, (1) The Emulsions J to K were reduction-sensitized during the preparation of the grains by using thiourea dioxide and thiosulfonic acid according to Examples of JP-A-2-191938 (corresponding to U.S. Pat. No. 5,061,614).

(2) The Emulsions A to I were subjected to gold sensitization, sulfur sensitization and selenium sensitization in the presence of sodium thiocyanate and spectral sensitizing dyes described in each light-sensitive layer according to Examples of JP-A-3-237450 (corresponding to EP 443,453A).

(3) The tabular grains of Emulsions A to L were prepared by using low molecular gelatin according to Examples of JP-A-1-158426.

(4) The tabular grains of Emulsion A to L had dislocation lines described in JP-A-3-237450 which were observed through a high pressure electron microscope.

(5) The emulsion L comprised double structural grains containing interior high iodide core described in JP-A-60-143331 (corresponding to U.S. Pat. No. 4,668,614).

(6) Dye-1 used in the sixth layer for comparison was used in the form of a fine oil droplet dispersion. Namely, 20.0 g of high-boiling organic solvent HBS-1 and 20 ml of ethyl acetate were added to 10.0 g of the Dye-1. The mixture was heated to obtain a solution, and the resulting solution was added to 200 g of a 10 wt % aqueous solution of gelatin containing 1.5 g of sodium dodecylbenzenesulfonate. The mixture was vigorously mechanically stirred in a homoblender to obtain a fine oil droplet dispersion of comparative Dye-1. The dispersion was coated in such an amount as to provide a coating weight of 0.010 g/m$^2$ to prepare the photographic material.

(7) Dye-2 used in tenth layer for comparison was mixed with high-boiling organic solvent HBS-1 in a weight ratio of 1:2, and a fine oil droplet dispersion of Dye-2 was prepared in the same manner as in (6) above. The resulting dispersion was used to prepare the photographic material.

ExC-1

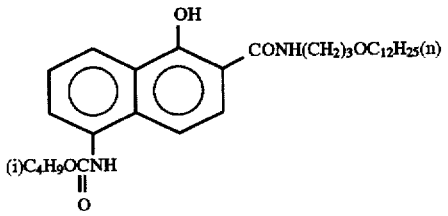

ExC-2

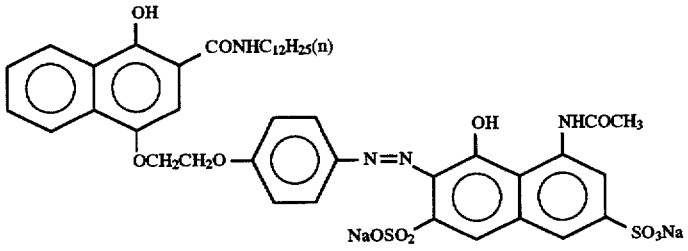

ExC-3

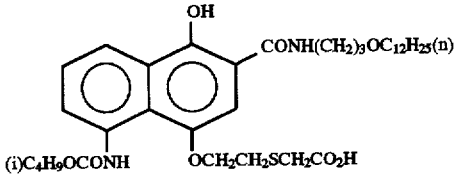

ExC-4

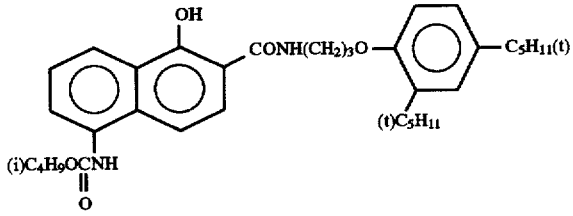

ExC-5

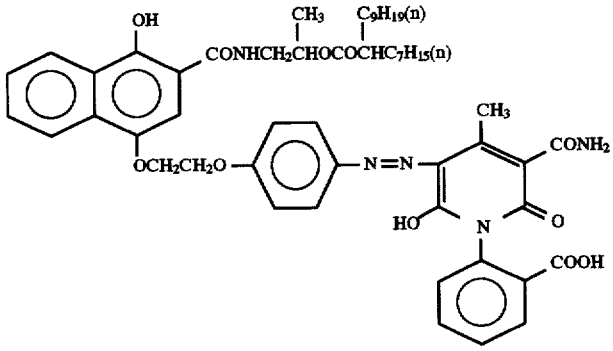

-continued
ExC-6
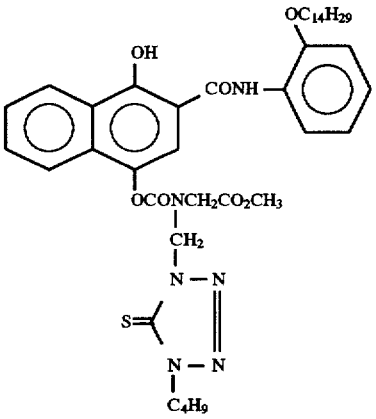
ExC-7
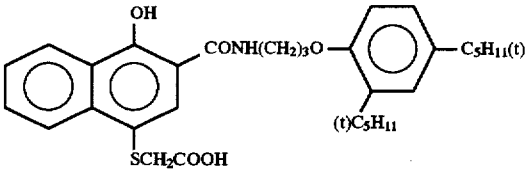
ExC-8
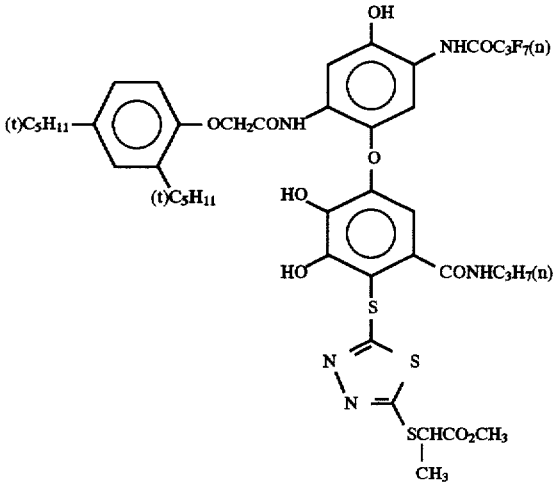
ExM-1
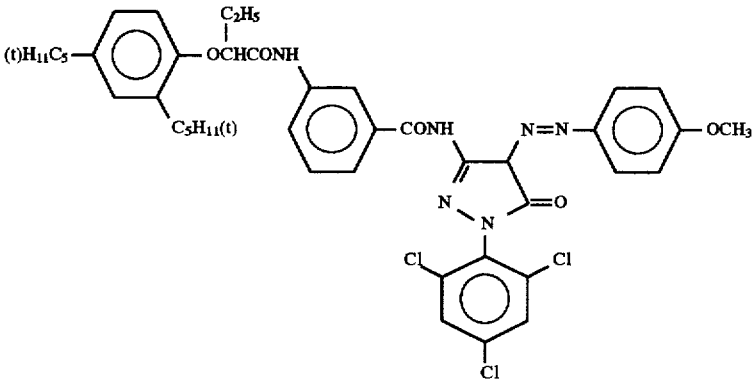

-continued
ExM-2
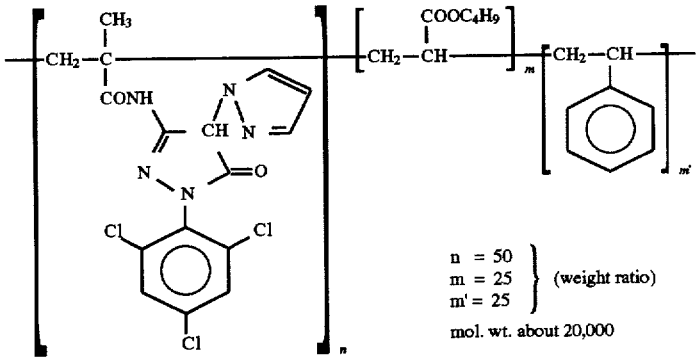
ExM-3
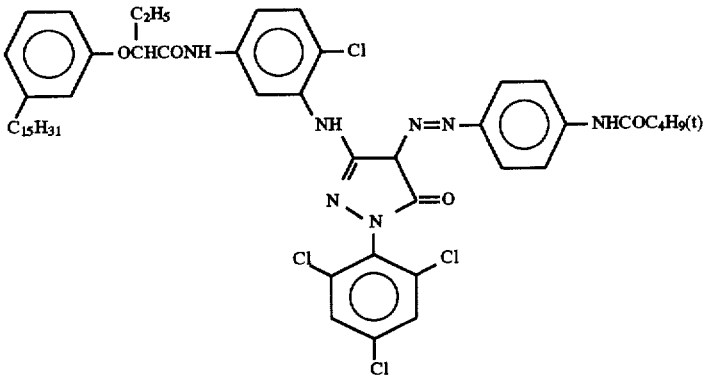
ExM-4
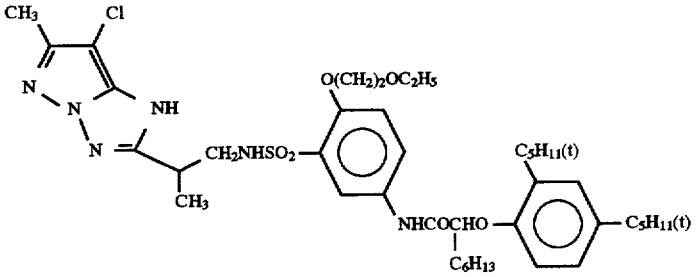
ExM-5
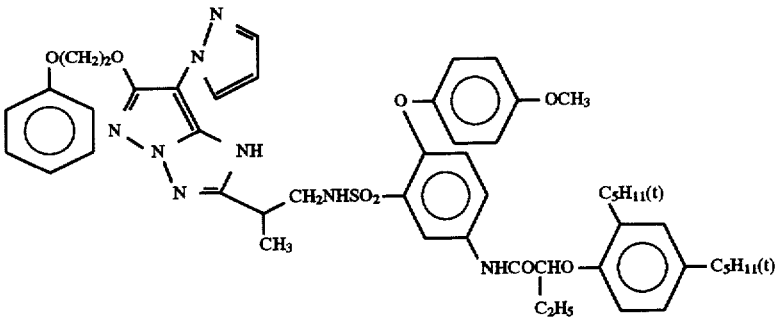

-continued
ExY-1
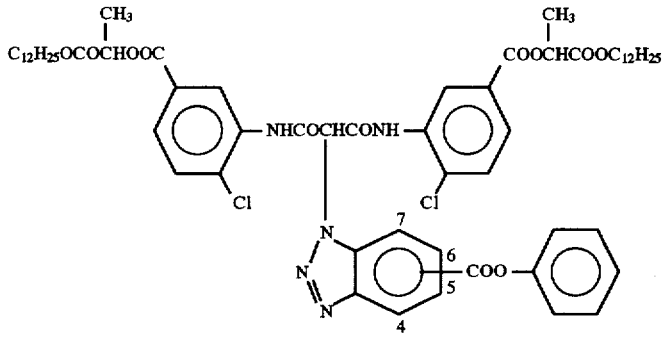
(a mixture of compounds substituted at 5- or 6- position; the same hereinafter)
ExY-2
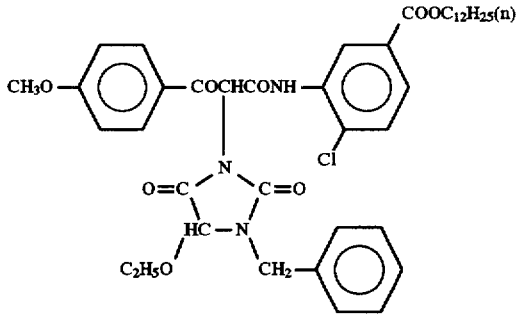
ExY-3
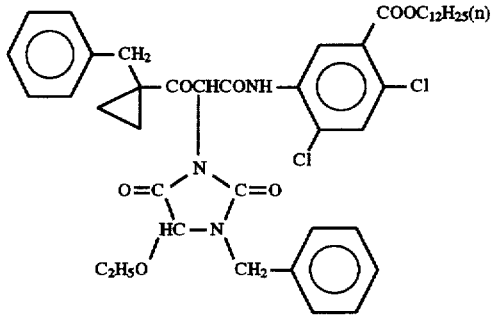
ExY-4
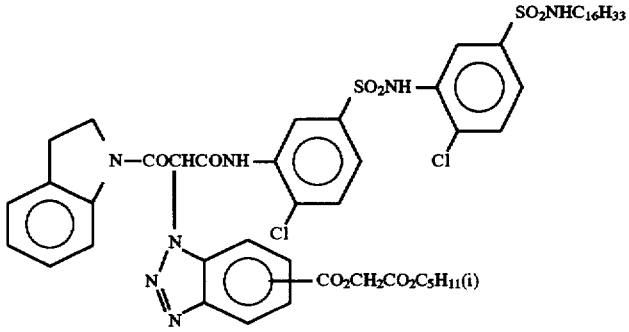

-continued
ExY-5
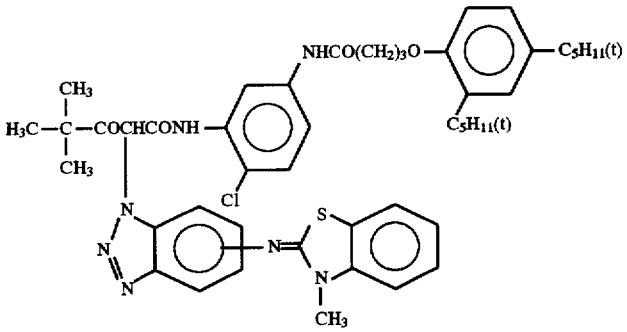
ExC-9
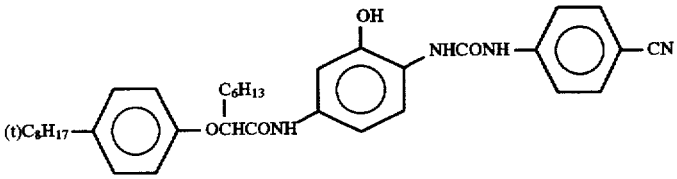
ExC-10
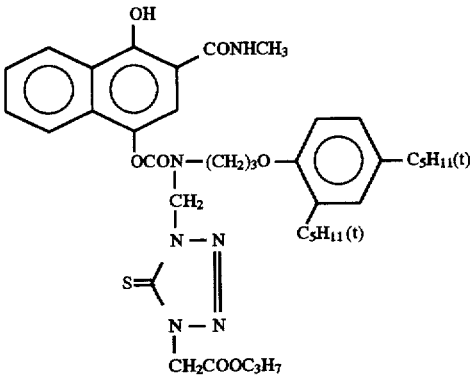
ExM-6
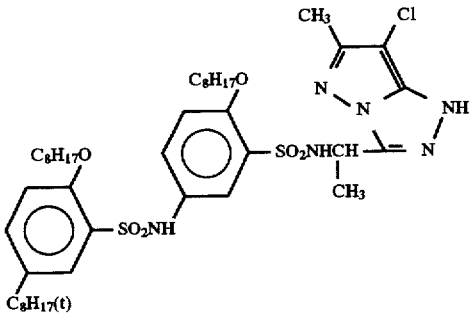
ExM-7
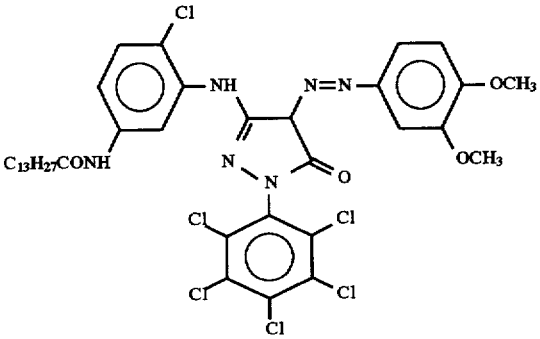

-continued
ExM-8
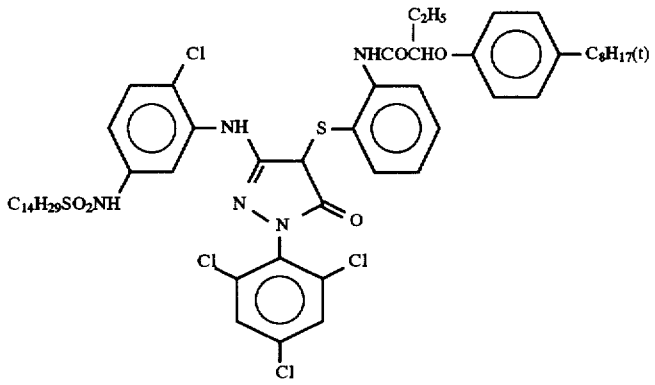
ExF-1
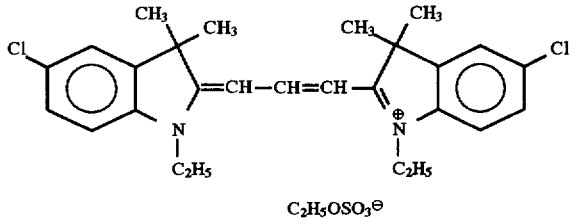
Cpd-1
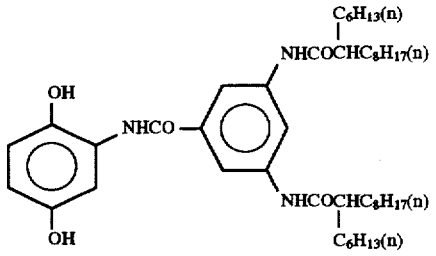
Cpd-2
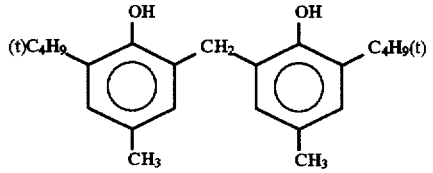
Cpd-3
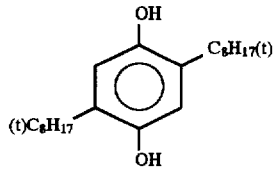
UV-1
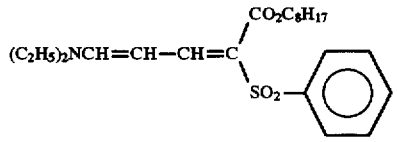
UV-2
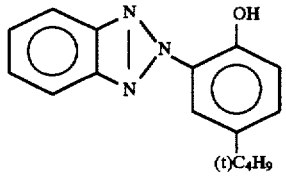

-continued
UV-3
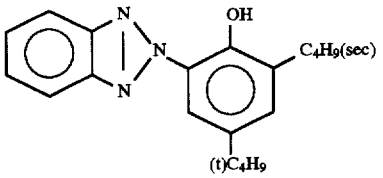
UV-4
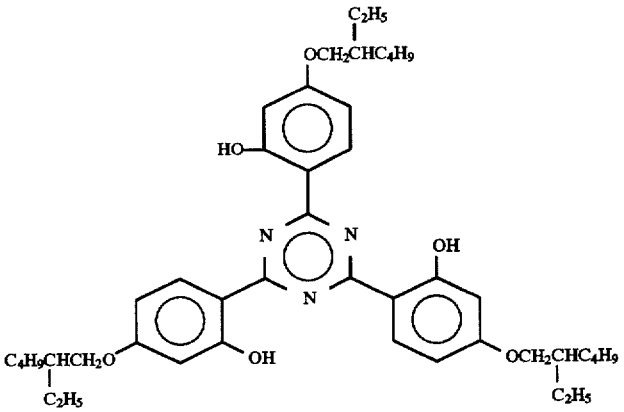
Tricresyl Phosphate HBS-1
Di (2-ethylhexyl) Phthalate HBS-2
HBS-3
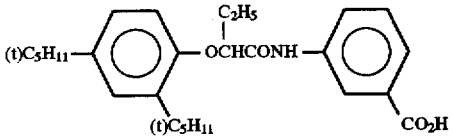
Tri (2-ethylhexyl) Phosphate HBS-4
HBS-5
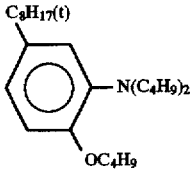
ExS-1
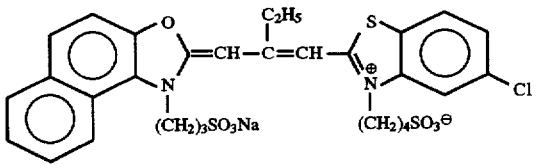
ExS-2
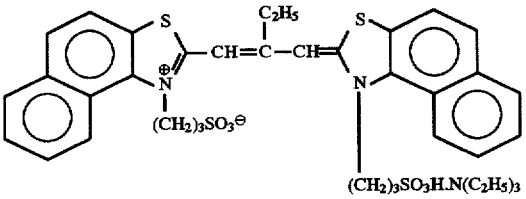
ExS-3
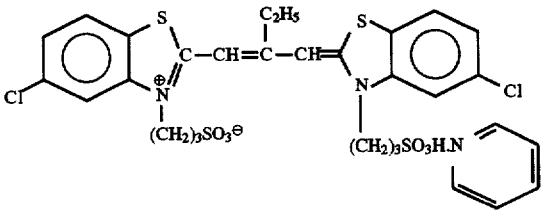

-continued
ExS-4
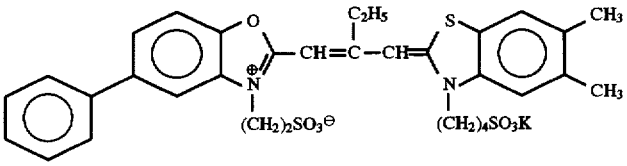
ExS-5
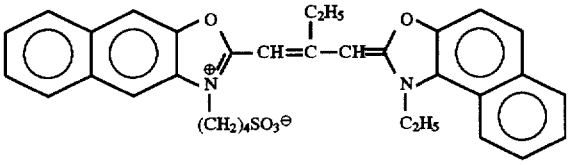
ExS-6
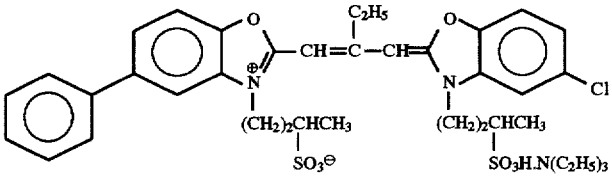
ExS-7
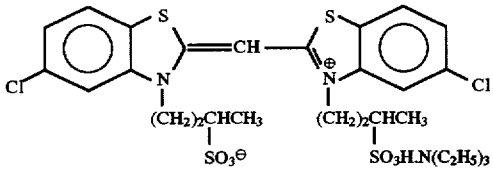
S-1
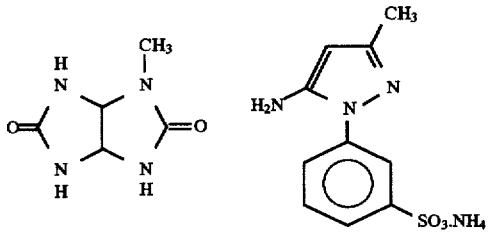
3:1 (by weight) Mixture
H-1
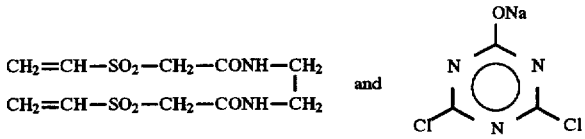
3:1 (by mol) Mixture
B-1
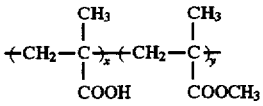
x/y = 10/90 (by weight)
B-2
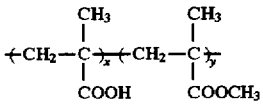
x/y = 40/60 (by weight)
B-3
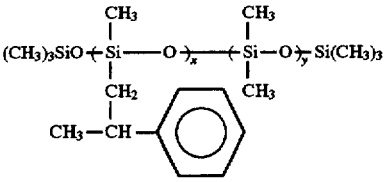
x/y = 29/46 (by weight)

-continued
B-4
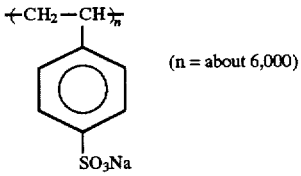
(n = about 6,000)
B-5
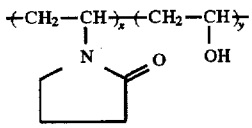
x/y = 70/30 (by weight)
B-6
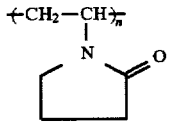
(mol. wt. about 10,000)
W-1
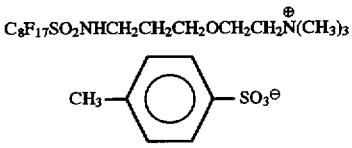
W-2
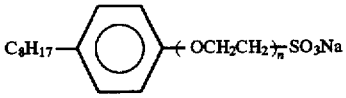
n = 2~4 (mixture)
W-3
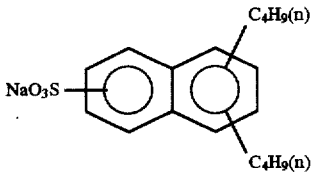
W-4
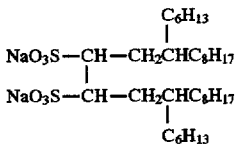
F-1
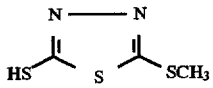
F-2
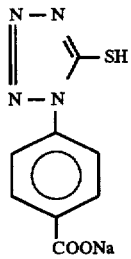
F-3
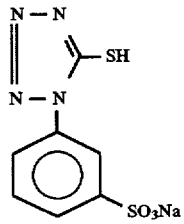

-continued
F-4
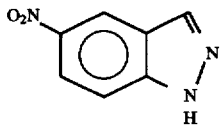
F-5
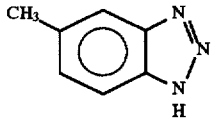
F-6
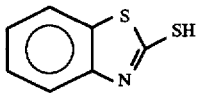
F-7
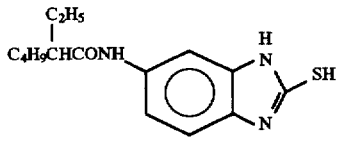
F-8
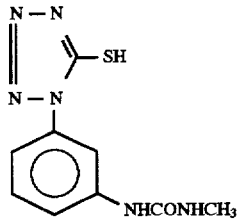
F-9
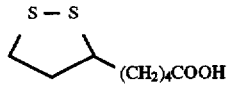
F-10
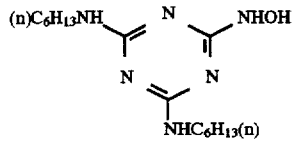
F-11
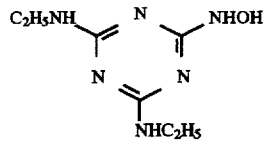
F-12
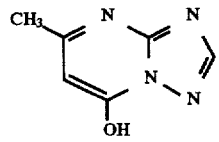
F-13
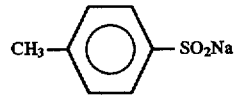
F-14
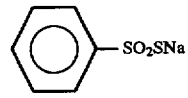
F-15
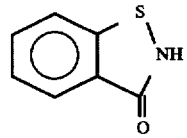

-continued

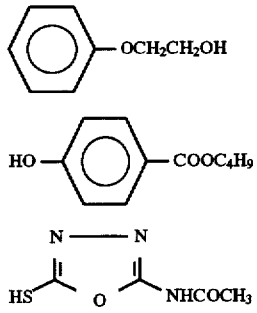

F-16

F-17

F-18

Dye (1) for Comparison
(used as an oil droplet dispersion of the dye in a high-boiling organic solvent)

Dye (18) described in JP-A-1-222257

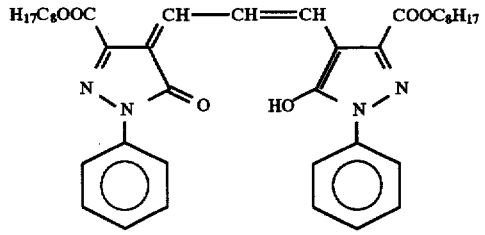

Dye (2) for Comparison
(used as an oil droplet dispersion of the dye in a high-boiling organic solvent)

Dye D-3 described in JP-A-5-53241

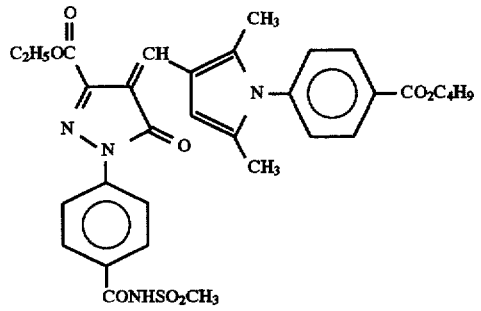

The same support as that used above was used, and photographic materials were prepared in the same manner as described above except that black colloidal silver used in the first layer (antihalation layer) was omitted, and the crystallite dispersions of the dyes (III-6) and (III-4) of general formula (I) according to the present invention were used in the first layer. The crystallite dispersions of the dyes (III-6) and (III-4) were prepared in the same manner as in Example 1, and the amounts were controlled so that the coating amount became the same as in Example 1. The first layer had the following composition in the preparation of the photographic materials.

| First Layer (antihalation layer) | Coating Weight ($g/m^2$) |
|---|---|
| Dye (III-6) | 0.10 |

-continued

| First Layer (antihalation layer) | Coating Weight ($g/m^2$) |
|---|---|
| Dye (III-4) | 0.040 |
| Gelatin | 1.60 |

Further, the same support as that used above and the first layer (antihalation layer) comprising the crystallite dispersions of the above dyes were used, and photographic materials were prepared in the same manner as described above except that the crystallite dispersion of the dye (II-5) of general formula (I) according to the present invention was used in place of comparative dye (1) used in the sixth layer (interlayer). The crystallite dispersion of the dye (II-5) was prepared in the same manner as in Example 1. The sixth layer had the following composition in the preparation of the photographic materials.

| Sixth Layer (interlayer) | Coating Weight ($g/m^2$) |
|---|---|
| Cpd-1 | 0.090 |
| HBS-1 | 0.090 |
| IP-1 | 0.70 |
| Polyethyl Acrylate Latex (solid) | 0.15 |
| Dye (II-5) | 0.030 |
| Gelatin | 1.10 |

In addition to the modification of the sixth layer as described above, the crystallite dispersion of the dye (III-12) according to the present invention was used in place of comparative dye (2) used in the tenth layer (yellow filter layer). Namely, the composition of the tenth layer was changed as shown below to prepare the photographic materials.

| Tenth Layer (yellow filter layer) | Coating Weight ($g/m^2$) |
|---|---|
| Cpd-1 | 0.16 |
| HBS-1 | 0.16 |
| L-1 | 0.70 |
| Dye (II-1) | 0.11 |
| Gelatin | 1.10 |

Further, photographic materials having the same layers as those described above were prepared by using the heat-treated PEN/PET=4/1 support and the heat-treated PET support.

The total amount of calcium contained in the entire layers of the first to fourteenth layers coated on the thus prepared photographic material was 31.5 mg/m$^2$. The calcium contents of the first layer, the sixth layer, and the tenth layer were 2.4 mg/m$^2$, 1.6 mg/m$^2$ and 1.6 mg/m$^2$, respectively.

The thus prepared photographic film samples were processed in the same manner as described in (7) of Example 1, and the measurement of curl described in (9) of Example 1 was made. The color development processing of the photographic materials was conducted by using an automatic processor (modified Minilabo FP-560B, a product of Fuji Photo Film Co., Ltd.).

Separately, one group of the photographic materials was stored at 5° C. and 35% RH for 5 days. Another group of the photographic materials was stored at 50° C. and 80% RH for 5 days. The photographic materials were exposed to white light (color temperature of the light source being 4800° K.) through a wedge and then subjected to the following color development processing.

The following processing stages and the following processing solutions having the following compositions were used.

Processing Stage

| Stage | Processing Time | Processing Temperature | Replenishment rate* | Tank capacity |
|---|---|---|---|---|
| Color development | 3 min 00 sec | 40.5° C. | 600 ml | 5 liters |
| Bleaching | 50 sec | 38.0° C. | 140 ml | 5 liters |
| Bleach-Fixing | 50 sec | 38.0° C. | — | 5 liters |
| Fixing | 50 sec | 38.0° C. | 420 ml | 5 liters |
| Rinsing with water | 30 sec | 38.0° C. | 980 ml | 3.5 liters |
| Stabilization (1) | 20 sec | 38.0° C. | — | 3 liters |
| Stabilization (2) | 20 sec | 38.0° C. | 560 ml | 3 liters |
| Drying | 1 min 30 sec | 60° C. | | |

*Replenishment rate being per m$^2$ of the photographic material.

The stabilizing solutions were allowed to flow in the countercurrent system of from (2) to (1). All of the overflow solution of rinsing water was introduced into the fixing bath. The bleach-fixing bath was replenished in such a way that each of the upper part of the bleaching tank of the automatic processor and the upper part of the fixing tank thereof was provided with a notch, and all of overflow solution produced by feeding the replenishers to the bleaching tank and the fixing tank was allowed to flow into the bleach-fixing bath. The amount of the developing solution brought over into the bleaching stage, that of the bleaching solution brought over into the bleach-fixing stage, that of the bleach-fixing solution brought over into the fixing stage and that of the fixing solution brought over into the rinsing stage were 65 ml, 50 ml, 50 ml and 50 ml, respectively, each amount being per m$^2$ of the photographic material. Crossover time was 6 seconds in any case and included in the processing time of the prestage.

The processing solutions had the following compositions.

| | Tank Solution (g) | Replenisher (g) |
|---|---|---|
| Color Developing Solution | | |
| Diethylenetriamine-pentaacetic Acid | 2.0 | 2.0 |
| 1-Hydroxyethylidene-1,1-diphosphonic Acid | 2.0 | 2.0 |
| Sodium Sulfite | 3.9 | 5.1 |

-continued

| | Tank Solution (g) | Replenisher (g) |
|---|---|---|
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| 2-Methyl-4-[N-ethyl-n-(β-hydroxyethyl)amino]aniline Sulfate | 4.5 | 6.0 |
| Add Water to make | 1.0 liter | 1.0 liter |
| pH (adjusted with potassium hydroxide and sulfuric acid) | 10.05 | 10.15 |
| Bleaching Solution | | |
| Ammonium 1,3-Diaminopropane tetraacetato Ferrate Monohydrate | 130 | 195 |
| Ammonium Bromide | 70 | 105 |
| Ammonium Nitrate | 14 | 21 |
| Hydroxyacetic Acid | 25 | 38 |
| Acetic Acid | 40 | 60 |
| Add Water to make | 1.0 liter | 1.0 liter |
| pH (adjusted with ammonia water) | 4.4 | 4.0 |

Bleach-Fixing Solution

A 15:85 (by volume) mixed solution of the bleaching solution (tank solution) shown above and the fixing solution (tank solution) shown below.

| Fixing Solution | Tank Solution (g) | Replenisher (g) |
|---|---|---|
| Ammonium Sulfite | 19 | 57 |
| Aqueous Solution of Ammonium Thiosulfate (700 g/l liter) | 280 ml | 840 ml |
| Imidazole | 15 | 45 |
| Ethylenediaminetetraacetic Acid | 15 | 45 |
| Add Water to make | 1.0 liter | 1.0 liter |
| pH (adjusted with ammonia water and acetic acid) | 7.4 | 7.45 |

Rinsing Water

Tap water was passed through a mixed bed column packed with an H type strongly acidic cation exchange resin (Amberlite IR-120B, a product of Rohm & Hass Co.) and an OH type strongly basic anion exchange resin (Amberlite IR-400) to reduce the concentration of each of calcium ion and magnesium ion to 3 mg/liter or below. Subsequently, sodium dichlorinated isocyanurate (20 mg/liter) and sodium sulfate (150 mg/liter) were added thereto. The pH of the solution was in the range of 6.5 to 7.5.

Stabilizing Solution

Tank solution and replenisher being the same.

| | Amount (g) |
|---|---|
| Sodium p-Toluenesulfinate | 0.03 |
| Polyoxyethylene p-Monononylphenyl Ether (Average degree of polymerization: 10) | 0.2 |
| Disodium Ethylenediaminetetraacetate | 0.05 |
| 1,2,4-Triazole | 1.3 |
| 1,4-Bis(1,2,4-triazole-1-ylmethyl)-piperazine | 0.75 |

-continued

| | Amount (g) |
|---|---|
| Add Water to make | 1.0 liter |
| pH | 8.5 |

The R-G-B density of each of the processed samples was measured to obtain the characteristic curve of each sample. The sensitivity is determined by calculating the logarithm value of the reciprocal of an exposure amount providing a density of (minimum density+0.2). Differences of the sensitivity ($\Delta S=S_2-S_1$) and the minimum density ($\Delta Dmin=D_2-D_1$) between the sample stored under low temperature and humidity conditions ($S_1$ and $D_1$) and the sample stored under high temperature and humidity conditions ($S_2$ and $D_2$) were determined. Among the values determined, the values obtained with regard to R and G density are shown in Tables 6 to 8 below.

TABLE 6

| Sample No. | Support: Material | Support: Thickness [μm] | Support: Tg [°C.] | Supply Chamber: Rolled-up Inner Diameter [mm] | Supply Chamber: Spool Inner Diameter [mm] | Supply Chamber: Patrone Spool Diameter [mm] | Heat Treatment [°C./hrs] | Dispersion of Dye: 1st Layer | Dispersion of Dye: 6th Layer | Dispersion of Dye: 10th Layer | ANSI Curl Value after Processing | Photographic Characteristics: G ΔDmin | Photographic Characteristics: G ΔS | Photographic Characteristics: R ΔDmin | Photographic Characteristics: R ΔS |
|---|---|---|---|---|---|---|---|---|---|---|---|---|---|---|---|
| 201 (Comp. Ex.) | PEN | 90 | 119 | — | 9.0 | 11.5 | omitted | colliodal silver | High-boiling org. solvent-dispersed comparative Dye (1) | High-boiling org. solvent-dispersed comparative Dye (2) | 94 | 0.05 | 0.07 | 0.06 | 0.09 |
| 202 (Comp. Ex.) | " | " | " | — | 7.0 | " | " | | | | 100 | 0.05 | 0.07 | 0.06 | 0.09 |
| 203 (Comp. Ex.) | " | " | " | 13.02 | — | " | " | | | | 87 | 0.05 | 0.07 | 0.06 | 0.09 |
| 204 (Comp. Ex.) | " | " | " | — | 9.0 | 9.0 | " | | | | 98 | 0.05 | 0.07 | 0.06 | 0.09 |
| 205 (Comp. Ex.) | " | " | " | — | 7.0 | 7.0 | " | | | | 109 | 0.05 | 0.08 | 0.06 | 0.10 |
| 206 (Comp. Ex.) | " | " | " | 13.02 | — | " | " | | | | 94 | 0.05 | 0.07 | 0.06 | 0.09 |
| 207 (Comp. Ex.) | " | " | " | — | 9.0 | 11.5 | 110/48 | | | | 42 | 0.05 | 0.06 | 0.06 | 0.08 |
| 208 (Comp. Ex.) | " | " | " | — | 7.0 | " | " | | | | 44 | G.05 | 0.06 | 0.06 | 0.08 |
| 209 (Comp. Ex.) | " | " | " | 13.02 | — | " | " | | | | 39 | 0.05 | 0.06 | 0.06 | 0.08 |
| 210 (Comp. Ex.) | " | " | " | — | 9.0 | 9.0 | " | | | | 45 | 0.05 | 0.06 | 0.06 | 0.08 |
| 211 (Comp. Ex.) | " | " | " | — | 7.0 | 7.0 | " | | | | 45 | 0.05 | 0.07 | 0.06 | 0.09 |
| 212 (Comp. Ex.) | " | " | " | 13.02 | — | " | " | | | | 47 | 0.05 | 0.06 | 0.06 | 0.08 |
| 213 (Comp. Ex.) | " | " | " | — | 9.0 | 11.5 | omitted | crystallite dispersion of III-6/III-4 | High-boiling org. solvent-dispersed comparative Dye (1) | High-boiling org. solvent-dispersed comparative Dye (2) | 94 | 0.05 | a.07 | 0.05 | 0.08 |
| 214 (Comp. Ex.) | " | " | " | — | 7.0 | " | " | | | | 100 | 0.05 | 0.07 | 0.05 | 0.08 |
| 215 (Comp. Ex.) | " | " | " | 13.02 | — | " | " | | | | 87 | 0.05 | 0.07 | 0.05 | 0.08 |
| 216 (Comp. Ex.) | " | " | " | — | 9.0 | 9.0 | " | | | | 98 | 0.05 | 0.07 | 0.05 | 0.08 |

TABLE 7

| Sample No. | Support: Material | Support: Thickness [μm] | Support: Tg [°C.] | Supply Chamber: Rolled-up Inner Diameter [mm] | Supply Chamber: Spool Inner Diameter [mm] | Supply Chamber: Patrone Spool Diameter [mm] | Heat Treatment [°C./hrs] | Dispersion of Dye: 1st Layer | Dispersion of Dye: 6th Layer | Dispersion of Dye: 10th Layer | ANSI Curl Value after Processing | Photographic Characteristics: G ΔDmin | Photographic Characteristics: G ΔS | Photographic Characteristics: R ΔDmin | Photographic Characteristics: R ΔS |
|---|---|---|---|---|---|---|---|---|---|---|---|---|---|---|---|
| 217 (Comp. Ex.) | PEN | 90 | 119 | — | 7.0 | 7.0 | omitted | crystallite dispersion of III-6/III-4 | High-boiling org. solvent-dispersed comparative dye (1) | High-boiling org. solvent-dispersed comparative dye (2) | 108 | 0.05 | 0.08 | 0.05 | 0.09 |
| 218 (Comp. Ex.) | " | " | " | 13.02 | — | " | " | | | | 94 | 0.05 | 0.07 | 0.05 | 0.08 |
| 219 (Invention) | " | " | " | — | 9.0 | 11.5 | 110/48 | | | | 42 | 0.04 | 0.04 | 0.03 | 0.04 |
| 220 (Invention) | " | " | " | — | 7.0 | " | " | | | | 44 | 0.04 | 0.04 | 0.03 | 0.04 |
| 221 (Invention) | " | " | " | 13.02 | — | " | " | | | | 39 | 0.04 | 0.04 | 0.03 | 0.04 |
| 222 (Invention) | " | " | " | — | 9.0 | 9.0 | " | | | | 45 | 0.04 | 0.04 | 0.03 | 0.04 |
| 223 (Invention) | " | " | " | — | 7.0 | 7.0 | " | | | | 45 | 0.04 | 0.04 | 0.03 | 0.04 |
| 224 (Invention) | " | " | " | 13.02 | — | " | " | | | | 47 | 0.04 | 0.04 | 0.03 | 0.04 |
| 225 (Comp. Ex.) | " | " | " | — | 9.0 | 11.5 | omitted | crystallite dispersion of III-6/III-4 | crystallite dispersion of II-5 | crystallite dispersion of III-12 | 95 | 0.04 | 0.05 | 0.04 | 0.06 |
| 226 (Comp. Ex.) | " | " | " | — | 7.0 | " | " | | | | 101 | 0.04 | 0.05 | 0.04 | 0.06 |
| 227 (Comp. Ex.) | " | " | " | 13.02 | — | " | " | | | | 88 | 0.04 | 0.05 | 0.04 | 0.06 |
| 228 (Comp. Ex.) | " | " | " | — | 9.0 | 9.0 | " | | | | 99 | 0.04 | 0.05 | 0.04 | 0.06 |
| 229 (Comp. Ex.) | " | " | " | — | 7.0 | 7.0 | " | | | | 109 | 0.04 | 0.05 | 0.04 | 0.06 |
| 230 (Comp. Ex.) | " | " | " | 13.02 | — | 7.0 | " | | | | 100 | 0.04 | 0.05 | 0.04 | 0.06 |
| 231 (Invention) | " | " | " | — | 9.0 | 11.5 | 110/48 | | | | 43 | 0.01 | 0.02 | 0.01 | 0.02 |
| 232 (Invention) | " | " | " | — | 7.0 | " | " | | | | 45 | 0.01 | 0.02 | 0.01 | 0.02 |

TABLE 8

| Sample No. | Support: Material | Support: Thickness [μm] | Support: Tg [°C.] | Supply Chamber: Rolled-up Inner Diameter [mm] | Supply Chamber: Spool Inner Diameter [mm] | Supply Chamber: Patrone Spool Diameter [mm] | Heat Treatment [°C./hrs] | Dispersion of Dye: 1st Layer | Dispersion of Dye: 6th Layer | Dispersion of Dye: 10th Layer | ANSI Curl Value after Processing | Photographic Characteristics: G ΔDmin | Photographic Characteristics: G ΔS | Photographic Characteristics: R ΔDmin | Photographic Characteristics: R ΔS |
|---|---|---|---|---|---|---|---|---|---|---|---|---|---|---|---|
| 233 (Invention) | PEN | 90 | 119 | 13.02 | — | 11.5 | 110/48 | crystallite dispersion of III-6/III-4 | crystallite dispersion of II-5 | crystallite dispersion of III-12 | 40 | 0.01 | 0.02 | 0.01 | 0.02 |
| 234 (Invention) | " | " | " | — | 9.0 | 9.0 | " | | | | 46 | 0.01 | 0.02 | 0.01 | 0.02 |
| 235 (Invention) | " | " | " | — | 7.0 | 7.0 | " | | | | 46 | 0.01 | 0.02 | 0.01 | 0.02 |
| 236 (Invention) | " | " | " | 13.02 | — | " | " | | | | 48 | 0.01 | 0.02 | 0.01 | 0.02 |
| 237 (Invention) | PET | 90 | 80 | — | 9.0 | 11.5 | 75/24 | The above crystallite dispersion | The above crystallite dispersion | The above crystallite dispersion | 50 | 0.02 | 0.03 | 0.02 | 0.03 |
| 238 (Invention) | " | " | " | — | 7.0 | " | " | | | | 52 | 0.02 | 0.03 | 0.02 | 0.03 |
| 239 (Invention) | " | " | " | 13.02 | — | " | " | | | | 46 | 0.02 | 0.03 | 0.02 | 0.03 |
| 240 (Invention) | " | " | " | — | 9.0 | 9.0 | " | | | | 60 | 0.02 | 0.03 | 0.02 | 0.03 |
| 241 (Invention) | " | " | " | — | 7.0 | 7.0 | " | | | | 60 | 0.02 | 0.03 | 0.02 | 0.03 |
| 242 (Invention) | " | " | " | 13.02 | — | " | " | | | | 59 | 0.02 | 0.03 | 0.02 | 0.03 |
| 243 (Invention) | PEN/PET = 4/1 | 90 | 104 | — | 9.0 | 11.05 | 95/48 | The above crystallite dispersion | The above crystallite dispersion | The above crystallite dispersion | 43 | 0.01 | 0.02 | 0.01 | 0.02 |
| 244 (Invention) | " | " | " | — | 7.0 | " | " | | | | 45 | 0.01 | 0.02 | 0.01 | 0.02 |
| 245 (Invention) | " | " | " | 13.02 | — | " | " | | | | 41 | 0.01 | 0.02 | 0.01 | 0.02 |
| 246 (Invention) | " | " | " | — | 9.0 | 9.0 | " | | | | 47 | 0.01 | 0.02 | 0.01 | 0.02 |
| 247 (Invention) | " | " | " | — | 7.0 | 7.0 | " | | | | 48 | 0.01 | 0.02 | 0.01 | 0.02 |
| 248 (Invention) | " | " | " | 13.02 | — | " | " | | | | 51 | 0.01 | 0.02 | 0.01 | 0.02 |

It can be seen from the results shown in Tables 6 to 8 that the color photographic materials comprising the heat-treated polyester support having thereon silver halide light-sensitive layers and the nonlight-sensitive layers wherein at least one layer of the nonlight-sensitive layers contains the crystallite dispersion of the dye of general formula (I) according to the present invention hardly cause an increase in $D_{min}$ and a fluctuation in the sensitivity in comparison with comparative samples, said increase in $D_{min}$ being caused by the fog of the silver halide light-sensitive layers due to residual color after processing and dyes to be applied or the method of use thereof.

Further, it is clear that when the heat-treated polyester supports are applied to the color photographic materials, curl value is still kept small without an increase, and the substantially same results as those obtained in Example 1 can be obtained.

Furthermore, when the heat-treated polyesters are applied to the color photographic materials, the films can be easily handled, and the problems with regard to uneven development, marring and the rear end folding of the films caused during color development are not found, though these results are not specially shown in Tables 6 to 8.

EXAMPLE 3

Samples were prepared by using gelatin having a low calcium content, each of TAC support and the heat-treated PEN support and changing the calcium content of each layer of the photographic material wherein the first layer, the sixth layer and the tenth layer contain the crystallite dispersion of the dye described in Example 2. The calcium content was changed by adding an aqueous solution of calcium chloride into each of coating solutions of these layers. Other layers than the first, sixth and tenth layers contained calcium in proportion to the coating weight of gelatin.

Further, photographic materials were prepared by using the heat-treated PEN support in the same manner as described above except that the crystallite dispersions of dyes shown in Table 10 below were used in the first layer, the sixth layer and the tenth layer in place of the dyes used in Example 2. An equimolar amount of each dye shown in Table 10 below was used in place of each dye shown in Table 9 below. The crystallite dispersions of the dyes were prepared in the same manner as in Example 1.

One group of the thus prepared photographic materials was stored at 5° C. and 35% RH for 5 days, and another group thereof was stored at 50° C. an 80% RH for 5 days as described in Example 2. The photographic materials were then exposed to white light through a wedge. The R-G-B density of each sample was measured to obtain the characteristic curve thereof. Differences in the sensitivity and the minimum density (ΔDmin) between the sample stored under low temperature and humidity conditions and the sample stored under high temperature and humidity conditions were determined from the characteristic curve in the same manner as in Example 2.

The results obtained are shown in Tables 9 and 10 below.

TABLE 9

| | | Calcium Content (mg/m²) | | | | Dye | | | Photographic Characteristics | | | | | |
|---|---|---|---|---|---|---|---|---|---|---|---|---|---|---|
| | | | | | | | | | $\Delta D_{min}$ | | | $\Delta S$ | | |
| Sample No. | Support | 1st Layer | 6th Layer | 10th Layer | Total Content | 1st Layer | 6th Layer | 10th Layer | R | G | B | R | G | B |
| 301 (Comp. Ex.) | TAC | 0.2 | 0.1 | 0.1 | 2.0 | III-6/ III-4 | II-5 | III-12 | 0.04 | 0.04 | 0.03 | 0.05 | 0.06 | 0.06 |
| 302 (Comp. Ex.) | " | 0.5 | 0.4 | 0.4 | 5.0 | III-6/ III-4 | " | " | 0.04 | 0.04 | 0.03 | 0.05 | 0.06 | 0.06 |
| 303 (Comp. Ex.) | " | 2.0 | 1.5 | 1.5 | 20 | III-6/ III-4 | " | " | 0.04 | 0.04 | 0.03 | 0.05 | 0.06 | 0.06 |
| 304 (Comp. Ex.) | " | 3.0 | 2.0 | 2.0 | 55 | III-6/ III-4 | " | " | 0.04 | 0.04 | 0.03 | 0.05 | 0.06 | 0.06 |
| 305 (Comp. Ex.) | " | 3.0 | 2.0 | 2.0 | 65 | III-6/ III-4 | " | " | 0.04 | 0.04 | 0.03 | 0.05 | 0.06 | 0.06 |
| 306 (Comp. Ex.) | " | 5.0 | 3.0 | 3.0 | 65 | III-6/ III-4 | " | " | 0.05 | 0.05 | 0.04 | 0.06 | 0.07 | 0.07 |
| 307 (Comp. Ex.) | " | 5.0 | 5.0 | 7.0 | 65 | III-6/ III-4 | " | " | 0.06 | 0.06 | 0.07 | 0.07 | 0.09 | 0.09 |
| 308 (Comp. Ex.) | " | 5.0 | 3.0 | 3.0 | 70 | III-6/ III-4 | " | " | 0.09 | 0.08 | 0.08 | 0.08 | 0.10 | 0.10 |
| 309 (Invention) | PEN heat-treated | 0.2 | 0.1 | 0.1 | 2.0 | III-6/ III-4 | " | " | 0.02 | 0.02 | 0.01 | 0.03 | 0.03 | 0.04 |
| 310 (Invention) | PEN heat-treated | 0.5 | 0.4 | 0.4 | 5.0 | III-6/ III-4 | " | " | 0.02 | 0.02 | 0.01 | 0.93 | 0.03 | 0.04 |
| 311 (Invention) | PEN heat-treated | 2.0 | 1.5 | 1.5 | 20 | III-6/ III-4 | " | " | 0.02 | 0.02 | 0.01 | 0.03 | 0.03 | 0.04 |
| 312 (Invention) | PEN heat-treated | 3.0 | 2.0 | 2.0 | 55 | III-6/ III-4 | " | " | 0.02 | 0.02 | 0.01 | 0.03 | 0.03 | 0.04 |
| 313 (Invention) | PEN heat-treated | 3.0 | 2.0 | 2.0 | 65 | III-6/ III-4 | " | " | 0.02 | 0.02 | 0.01 | 0.03 | 0.03 | 0.04 |
| 314 (Invention) | PEN heat-treated | 5.0 | 3.0 | 3.0 | 65 | III-6/ III-4 | " | " | 0.02 | 0.02 | 0.01 | 0.03 | 0.03 | 0.04 |

TABLE 9-continued

| | | Calcium Content (mg/m²) | | | | Dye | | | Photographic Characteristics | | | | | |
|---|---|---|---|---|---|---|---|---|---|---|---|---|---|---|
| | | 1st | 6th | 10th | Total | 1st | 6th | 10th | $\Delta D_{min}$ | | | $\Delta S$ | | |
| Sample No. | Support | Layer | Layer | Layer | Content | Layer | Layer | Layer | R | G | B | R | G | B |
| 315 (Invention) | PEN heat-treated | 5.0 | 5.0 | 7.0 | 65 | III-6/ III-4 | " | " | 0.03 | 0.03 | 0.02 | 0.03 | 0.04 | 0.04 |
| 316 (Invention) | PEN heat-treated | 5.0 | 3.0 | 3.0 | 7.0 | III-6/ III-4 | " | " | 0.04 | 0.04 | 0.03 | 0.04 | 0.04 | 0.05 |

15

TABLE 10

| | | Calcium Content (mg/m²) | | | | Dye | | | Photographic Characteristics | | | | | |
|---|---|---|---|---|---|---|---|---|---|---|---|---|---|---|
| | | 1st | 6th | 10th | Total | 1st | 6th | 10th | $\Delta D_{min}$ | | | $\Delta S$ | | |
| Sample No. | Support | Layer | Layer | Layer | Content | Layer | Layer | Layer | R | G | B | R | G | B |
| 301 (Comp. Ex.) | TAC | 0.2 | 0.1 | 0.1 | 2.0 | III-6/ | II-5 | III-12 | 0.04 | 0.04 | 0.03 | 0.05 | 0.06 | 0.06 |
| 317 (Invention) | PEN heat-treated | 0.2 | 0.1 | 0.1 | 2.0 | I-1/ IV-1 | II-10 | III-5 | 0.02 | 0.02 | 0.01 | 0.03 | 0.03 | 0.04 |
| 318 (Invention) | PEN heat-treated | 0.5 | 0.4 | 0.4 | 5.0 | I-1 IV-1 | " | " | 0.02 | 0.02 | 0.01 | 0.03 | 0.03 | 0.04 |
| 319 (Invention) | PEN heat-treated | 2.0 | 1.5 | 1.5 | 20 | I-1 IV-1 | " | " | 0.02 | 0.02 | 0.01 | 0.03 | 0.03 | 0.04 |
| 320 (Invention) | PEN heat-treated | 3.0 | 2.0 | 2.0 | 55 | I-1 IV-1 | " | " | 0.02 | 0.02 | 0.01 | 0.03 | 0.03 | 0.04 |
| 321 (Invention) | PEN heat-treated | 3.0 | 2.0 | 2.0 | 65 | I-1 IV-1 | " | " | 0.02 | 0.02 | 0.01 | 0.03 | 0.03 | 0.04 |
| 322 (Invention) | PEN heat-treated | 5.0 | 3.0 | 3.0 | 65 | I-1 IV-1 | " | " | 0.02 | 0.02 | 0.01 | 0.03 | 0.03 | 0.04 |
| 323 (Invention) | PEN heat-treated | 5.0 | 5.0 | 7.0 | 65 | I-1 IV-1 | " | " | 0.03 | 0.03 | 0.02 | 0.03 | 0.04 | 0.04 |
| 324 (Invention) | PEN heat-treated | 5.0 | 3.0 | 3.0 | 70 | I-1 IV-1 | " | " | 0.04 | 0.04 | 0.03 | 0.04 | 0.04 | 0.05 |
| 325 (Invention) | PEN heat-treated | 0.2 | 0.1 | 0.1 | 2.0 | III-3/ II-23 | III-2 | II-3 V-1 | 0.02 | 0.02 | 0.01 | 0.03 | 0.03 | 0.04 |
| 326 (Invention) | PEN heat-treated | 0.5 | 0.4 | 0.4 | 5.0 | III-3/ II-23 | " | II-3 V-1 | 0.02 | 0.02 | 0.01 | 0.03 | 0.03 | 0.04 |
| 327 (Invention) | PEN heat-treated | 2.0 | 1.5 | 1.5 | 20 | III-3/ II-23 | " | II-3 V-1 | 0.02 | 0.02 | 0.01 | 0.03 | 0.03 | 0.04 |
| 328 (Invention) | PEN heat-treated | 3.0 | 2.0 | 2.0 | 55 | III-3/ II-23 | " | II-3 V-1 | 0.02 | 0.02 | 0.01 | 0.03 | 0.03 | 0.04 |
| 329 (Invention) | PEN heat-treated | 3.0 | 2.0 | 2.0 | 65 | III-3/ II-23 | " | II-3 V-1 | 0.02 | 0.02 | 0.01 | 0.03 | 0.03 | 0.04 |
| 330 (Invention) | PEN heat-treated | 5.0 | 3.0 | 3.0 | 65 | III-3/ II-23 | " | II-3 V-1 | 0.02 | 0.02 | 0.01 | 0.03 | 0.03 | 0.04 |
| 331 (Invention) | PEN heat-treated | 5.0 | 5.0 | 7.0 | 65 | III-3/ II-23 | " | II-3 V-1 | 0.03 | 0.03 | 0.02 | 0.03 | 0.04 | 0.04 |
| 332 (Invention) | PEN heat-treated | 5.0 | 3.0 | 3.0 | 70 | III-3/ II-23 | " | II-3 V-1 | 0.04 | 0.04 | 0.03 | 0.04 | 0.05 | 0.05 |

It can be seen from the results shown above that when the heat-treated polyester PEN according to the present invention is used as the support and the crystallite dispersion of the dye according to the present invention is added to the non-sensitive layer, a fluctuation in photographic characteristics such as the sensitivity and $D_{min}$ of the photographic material stored under high temperature and humidity conditions is smaller, when the total amount of calcium contained in the first to fifteenth layers of the photographic material is lower. It can be seen that it is preferred that the total content of calcium is not higher than 65 mg/m$^2$. Further, it can be seen that it is preferred from the standpoint of the long-term storage of the photographic material that the calcium content of the non-sensitive layer containing the crystallite dispersion of the dye is 5 mg/m$^2$.

It is believed that a fluctuation in the photographic characteristics the photographic materials stored under high temperature and humidity conditions is caused by that the crystallite dispersion of the dye is partially dissolved out and diffuses under high temperature and humidity conditions and as a result, the silver halide light-sensitive layers adjacent to the nonlight-sensitive layer are affected thereby, or that the dye molecule dissolved out forms a salt or a complex salt with calcium, and the dye is hardly decolorized or difficultly flows into the processing solutions and hence the photographic characteristics such as the sensitivity and $D_{min}$ are deteriorated.

Further, it can be seen that when the support is composed of TAC outside the scope of the present invention, the sensitivity and $D_{min}$ are greatly fluctuated irrespective of the content of calcium, and the fluctuation in the photographic characteristics is increased with an increase in the content of calcium even when the photographic materials contain the crystallite dispersions of the dyes according to the present invention. This can be seen when the samples 301 to 308 are compared with the samples 309 to 316. The unfavorable results caused by the use of TAC is thought to be due to the fact that the TAC support has water absortivity, and the dye is partially dissolved out and diffuse into the molecular chain of triacetyl cellulose under high temperature and humidity conditions, and the dye is fixed thereto. This fact can be confirmed when the gelatin films of the photographic material is peeled off after processing, and the support is examined.

EXAMPLE 4

Seven materials of P-5, P-6, P-7, P-9, P-13, P-16 and P-19 were used as the polyester supports, and biaxial orientation and heat setting were carried out according to the preparation of the PEN support of Example 1 to prepare each of film supports. The undercoat layer and the back layer were coated on each of the films. The films were heat-treated at a temperature of lower by 10° C. than the glass transition temperature (Tg) for 48 hours to obtain the supports.

The crystallite dispersions of the dyes (III-6) and (III-4) were used in the first layer (antihalation layer), and the same compositions as those used in the second to fifth layers of Example 1 were used for the second to fifth layers of this Example. The first to fifth layers were coated on each of seven supports according to the method described in (6) Coating of Light-Sensitive Layer of Example 1. Film samples were prepared from the resulting photographic materials according to the method described in (7) Preparation of Photographic Film Sample of Example 1. The properties of the samples were examined according to the methods described in (8) Core Set and (9) Drawing-out of Tip, Development, Measurement of Curl of Example 1. The substantially same results as those of the samples 149 to 152 shown in Table 4 were obtained. Accordingly, there can be obtained such good results that the films can be easily handled, troubles with regard to uneven development during processing, marring and rear end folding are not caused, and a fluctuation in the photographic characteristics is small.

Photographic materials having the same layer structures as those of the samples 231 to 236 of Example 2 were prepared by using the above seven supports. Film samples were prepared in the same manner as described above. The properties of the samples were examined in the same manner as described above. The substantially same results as those of the samples 231 to 236 shown in Tables 7 and 8 were obtained. It can be confirmed that when the poly(alkylene aromatic dicarboxylate) heat-treated according to the present invention are used as the supports and the crystallite dispersions of the dyes according to the present invention are contained in the nonlight-sensitive layer, the handleability, processability and preservability of the films can be improved.

EXAMPLE 5

The samples 301 to 332 prepared in Example 3 were used. The samples were exposed to white light through a wedge and subjected to color development processing described in Example 2 (sensitivity:$S_1$; density:$D_1$). Another group of the samples was subjected to the same exposure as described above and then color development processing in the same manner as described above except that the color development time was 3 min 5 sec and the color development temperature was 38.0° C. (sensitivity:$S_2$; density:$D_2$).

The density of each of the processed samples was measured to obtain the characteristic curve. The sensitivity and $D_{min}$ were determined from the characteristic curve. A difference ($\Delta S_1=S_1-S_2$) in the sensitivity between the same samples and a difference ($\Delta D_1=D_2-D_1$) in $D_{min}$ therebetween were calculated.

Further, color development was carried out under such conditions that the color development time was 2 min 30 sec and the temperature was 45° C. (sensitivity:$S_3$; density:$D_3$). A difference ($\Delta S_2=S_3-S_2$) in the sensitivity between the sample and a sample processed under such conditions that the development time was 3 min 5 sec and the temperature was 38.0° C. (sensitivity:$S_2$; density:$D_2$) was determined. A difference ($\Delta D_2=D_2-D_3$) in $D_{min}$ therebetween was also determined.

The results obtained are shown in Table 11 below. Any of the numerical values shown in Table represents a difference between the value obtained at 38° C. for 3 min 5 sec and the value obtained under high temperature and short time conditions when the value obtained at 38° C. for 3 min 5 sec was referred to as the standard. Accordingly, a larger numerical value means that $D_{min}$ under high temperature and short time processing conditions is smaller, and the sensitivity is higher.

TABLE 11

| | | $\Delta D_1$ | | | $\Delta D_2$ | | | $\Delta S_1$ | | | $\Delta S_2$ | | |
|---|---|---|---|---|---|---|---|---|---|---|---|---|---|
| Sample No. | Support | R | G | B | R | G | B | R | G | B | R | G | B |
| 301 (Comp. Ex.) | TAC | 0.02 | 0.02 | 0.02 | 0.03 | 0.03 | 0.03 | 0.00 | 0.00 | 0.00 | 0.00 | 0.00 | 0.00 |
| 302 (Comp. Ex.) | " | 0.02 | 0.02 | 0.02 | 0.03 | 0.03 | 0.03 | 0.00 | 0.00 | 0.00 | 0.00 | 0.00 | 0.00 |
| 303 (Comp. Ex.) | " | 0.02 | 0.02 | 0.02 | 0.02 | 0.03 | 0.03 | 0.00 | 0.00 | 0.00 | 0.00 | 0.00 | 0.00 |
| 304 (Comp. Ex.) | " | 0.01 | 0.01 | 0.01 | 0.01 | 0.02 | 0.02 | −0.01 | −0.01 | −0.01 | −0.02 | −0.02 | −0.02 |
| 305 (Comp. Ex.) | " | 0.01 | 0.01 | 0.01 | 0.01 | 0.02 | 0.02 | −0.01 | −0.01 | −0.01 | −0.02 | −0.02 | −0.02 |
| 306 (Comp. Ex.) | " | 0.00 | 0.01 | 0.01 | 0.00 | 0.01 | 0.01 | −0.02 | −0.01 | −0.01 | −0.03 | −0.02 | −0.02 |
| 307 (Comp. Ex.) | " | 0.00 | 0.00 | 0.00 | 0.00 | 0.00 | 0.00 | −0.02 | −0.02 | −0.02 | −0.03 | −0.03 | −0.03 |
| 308 (Comp. Ex.) | " | 0.00 | 0.00 | 0.00 | 0.00 | 0.00 | 0.00 | −0.02 | −0.02 | −0.02 | −0.04 | −0.04 | −0.04 |
| 309 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 310 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 311 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 312 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 313 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 314 (Invention) | PEN heat-treated | 0.03 | 0.04 | 0.04 | 0.06 | 0.07 | 0.07 | 0.02 | 0.02 | 0.02 | 0.02 | 0.02 | 0.02 |
| 315 (Invention) | PEN heat-treated | 0.03 | 0.03 | 0.03 | 0.06 | 0.06 | 0.06 | 0.02 | 0.01 | 0.01 | 0.02 | 0.01 | 0.01 |
| 316 (Invention) | PEN heat-treated | 0.03 | 0.03 | 0.03 | 0.06 | 0.06 | 0.06 | 0.01 | 0.01 | 0.01 | 0.01 | 0.01 | 0.01 |

TABLE 12

| | | $\Delta D_1$ | | | $\Delta D_2$ | | | $\Delta S_1$ | | | $\Delta S_2$ | | |
|---|---|---|---|---|---|---|---|---|---|---|---|---|---|
| Sample No. | Support | R | G | B | R | G | B | R | G | B | R | G | B |
| 317 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 318 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 319 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 320 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 321 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 322 (Invention) | PEN heat-treated | 0.03 | 0.03 | 0.03 | 0.06 | 0.06 | 0.06 | 0.02 | 0.02 | 0.02 | 0.01 | 0.01 | 0.01 |
| 323 (Invention) | PEN heat-treated | 0.03 | 0.03 | 0.03 | 0.06 | 0.06 | 0.06 | 0.02 | 0.02 | 0.02 | 0.01 | 0.01 | 0.01 |
| 324 (Invention) | PEN heat-treated | 0.03 | 0.03 | 0.03 | 0.06 | 0.06 | 0.06 | 0.02 | 0.01 | 0.01 | 0.01 | 0.01 | 0.01 |
| 325 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 326 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 327 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 328 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 329 (Invention) | PEN heat-treated | 0.04 | 0.04 | 0.04 | 0.07 | 0.07 | 0.07 | 0.02 | 0.02 | 0.02 | 0.02 | 0.02 | 0.02 |
| 330 (Invention) | PEN heat-treated | 0.03 | 0.03 | 0.03 | 0.06 | 0.06 | 0.06 | 0.02 | 0.02 | 0.02 | 0.01 | 0.01 | 0.01 |
| 331 (Invention) | PEN heat-treated | 0.03 | 0.03 | 0.03 | 0.06 | 0.06 | 0.06 | 0.02 | 0.02 | 0.02 | 0.01 | 0.01 | 0.01 |
| 332 (Invention) | PEN heat-treated | 0.03 | 0.03 | 0.03 | 0.06 | 0.06 | 0.06 | 0.02 | 0.01 | 0.01 | 0.01 | 0.01 | 0.01 |

It can be seen from the results shown in Table 11 that the $D_{min}$ values of the photographic materials containing the crystallite dispersions of the dyes according to the present invention obtained by using the heat-treated PEN support according to the present invention are low even when processing is carried out with the color developing solution having the same composition and the processing temperature is elevated (thereby the development time is shortened to meet the photographic properties) and the processing time is shortend. It can be seen from the results that it is preferred that high-temperature rapid processing is carried out in the present invention to prevent high $D_{min}$ from being provided.

Further, it can be seen that a low calcium content of the photographic materials is effective in lowering $D_{min}$ and improving photographic sensitivity when high-temperature rapid processing is carried out.

EXAMPLE 6

The samples prepared in Example 2 were used, and the color developing solution wherein an equimolar amount of 2-methyl-4-[N,N-bis(δ-hydroxybutyl)amino]aniline sulfate was used in place of 2-methyl-4-[N-ethyl-N-(β-hydroxyethyl)amino]aniline sulfate used in Example 2 was used. The measurement of the curl value was made according to the method described in Example 2. Further, development processability, the curl value, and the preservability of the samples with regard to a fluctuation in $D_{min}$ and the sensitivity were examined according to the method described in Example 2. The photographic materials meeting the requirements of the present invention had good development processability substantially equal to those of Example 2 and provided good results substantially the same as those shown in Tables 6 to 8 as compared with comparative samples.

It will be understood from the above disclosure that the photographic materials obtained by using the heat-treated poly(alkylene aromatic dicarboxylate) having a reduced thickness (as compared with conventional supports) and adding the crystallite dispersions of the dyes of general formula (I) can be easily handled, do not cause troubles with regard to uneven development during processing, marring and rear end folding, and have an effect of reducing the fluctuation of $D_{min}$, the sensitivity and photographic performance during long-term storage.

Further, when the calcium content of the photographic material is reduced, the fluctuation of the photographic characteristics can be further reduced.

EXAMPLE 7

Samples 401 to 412 were prepared in the same manner as Samples 145 to 150, in Example 1, respectively, except that each support was preheated at a temperature shown in Table 12, and then heat-treated at a temperature the same as in Example 1 for a period of time indicated in Table 12.

TABLE 12

| Sample No. | Support Material | Tg (°C.) | Preheat-treatment (°C./min) | Heat-treatment (°C./hrs) | Heat-treatment in corresponding Sample in Example 1 (°C./hrs) | |
|---|---|---|---|---|---|---|
| 401 | PET | 80 | 110/10 | 75/12 | (Sample 145) | 75/24 |
| 402 | PET | 80 | 110/10 | 75/12 | (Sample 146) | 75/24 |
| 403 | PET | 80 | 110/10 | 75/12 | (Sample 147) | 75/24 |
| 404 | PET | 80 | 110/10 | 75/12 | (Sample 148) | 75/24 |
| 405 | PEN | 119 | 150/10 | 110/20 | (Sample 149) | 110/48 |
| 406 | PEN | 119 | 150/10 | 110/20 | (Sample 150) | 110/48 |
| 407 | PEN | 119 | 150/10 | 110/20 | (Sample 151) | 110/48 |
| 408 | PEN | 119 | 150/10 | 110/20 | (Sample 152) | 110/48 |
| 409 | PEN/PET = 1/4 | 104 | 130/10 | 95/20 | (Sample 153) | 95/48 |
| 410 | PEN/PET = 1/4 | 104 | 130/10 | 95/20 | (Sample 154) | 95/48 |
| 411 | PEN/PET = 1/4 | 104 | 130/10 | 95/20 | (Sample 155) | 95/48 |
| 412 | PEN/PET = 1/4 | 104 | 130/10 | 95/20 | (Sample 156) | 95/48 |

Each Sample of Samples 401 to 412 was tested in the same manner as in Example 1 and substantially the same results as those of the corresponding Samples 145 to 156, respectively, were obtained.

By comparing the heat-treating time (at a temperature lower than Tg) of Samples 401 to 412 necessary to obtain characteristics the same as those of Samples 145 to 156, respectively, it is evident that by subjecting the support to the preheat-treatment for a short time, the time of the heat-treatment (at a temperature lower than Tg) can be reduced to an extremely short time.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one silver halide light-sensitive layer, at least one light-insensitive layer wherein at least one light insensitive layer is an antihalation layer, wherein the support comprises a poly(alkylene aromatic dicarboxylate) polymer having a glass transition temperature of from 50° C. to 200° C. and is heat-treated at a temperature of not lower than 40° C., but lower than the glass transition temperature, for 0.1 to 1500 hours after molding the polymer into the support and before coating the silver halide light-sensitive layer, and said at least one light-insensitive layer comprises a dispersion of crystallites of at least one dye represented by formula (I):

$$D—(X)_y \quad (I)$$

wherein D represents a moiety having a chromophoric group;

X represents a dissociable proton or a group having a dissociable proton which is bonded to D either directly or through a bivalent bonding group; and y represents an integer of 1 to 7.

2. The silver halide photographic material as in claim 1, wherein the thickness of the support is from 50 to 300 μm.

3. The silver halide photographic material as in claim 1, wherein the heat treatment is carried out at a temperature lower by at least 30° C. than the glass transition temperature.

4. The silver halide photographic material as in claim 1, wherein the heat treatment is carried out at a temperature lower by at least 15° C. than the glass transition temperature.

5. The silver halide photographic material as in claim 1, wherein said support is heat-treated at a temperature of not higher than the temperature lower by 3° C. than the glass transition temperature.

6. The silver halide photographic material as in claim 1, wherein said support is heat-treated at a temperature of not higher than the temperature lower by 5° C. than the glass transition temperature.

7. The silver halide photographic material as in claim 1, wherein at least one under coat layer is provided on the support.

8. The silver halide photographic material as in claim 1, wherein said moiety is derived from a compound selected from the group consisting of oxonol dyes, merocyanine dyes, cyanine dyes, arylidene dyes, azomethine dyes, triphenylmethane dyes, azo dyes, anthraquinone dye and indoaniline dyes.

9. The silver halide photographic material as in claim 1, wherein X is selected from the group consisting of a carboxyl group, a sulfonamido group, an alkylsulfamoyl group, an arylsulfamoyl group, a sulfonylcarbamoyl group, a carbonylsulfamoyl group, an enol group of oxonol dyes, and a phenolic hydroxyl group.

10. The silver halide photographic material as in claim 1, wherein said dye represented by formula (I) is represented by formula (II), (III), (IV) or (V):

$$A^1=L^1\left(L^2=L^3\right)_m Q \quad \text{(II)}$$

$$A^1=L^1\left(L^2=L^3\right)_n A^2 \quad \text{(III)}$$

$$A^1\left(L^1-L^2\right)_p B^1 \quad \text{(IV)}$$

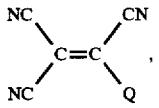

(V)

wherein $A^1$ and $A^2$ each represents an acid nucleus; $B^1$ represents a basic nucleus; Q represents an aryl group or a heterocyclic group; $L^1$, $L^2$ and $L^3$ each represents a methine group; m represents 0, 1 or 2; n and p each represents 0, 1, 2 or 3 provided that the compounds of general formulas (II) to (V) have at least one group selected from the group consisting of a carboxyl group, a sulfonamido group, an alkylsulfamoyl group, an arylsulfamoyl group, a sulfonylcarbamoyl group, a carbonylsulfamoyl group, an enol group of oxonol dyes, and a phenolic hydroxyl group and do not have other water-soluble group.

11. The silver halide photographic material as in claim 1, wherein said dye is not soluble in water at a pH of 5 to 7 at 25° C.

12. The silver halide photographic material as in claim 1, wherein said dye crystallites has an average particle size of from 0.005 to 10 μm.

13. The silver halide photographic material as in claim 1, wherein the amount of said dye is from $5.0\times10^{-5}$ to 5.0 g per $m^2$ of the photographic material.

14. The silver halide photographic material as in claim 1, wherein the silver halide photographic material comprises at least one red-sensitive silver halide light-sensitive layer containing at least one cyan coupler, at least one green-sensitive silver halide light-sensitive layer containing at least one magenta coupler, at least one blue-sensitive light-sensitive layer containing at least one yellow coupler.

15. The silver halide photographic material as claimed in claim 1, wherein said material also comprises a dye light-insensitive layer which is a yellow filter layer or a magenta filter layer.

16. The silver halide photographic material as in claim 1, wherein the total amount of calcium contained in the silver halide light-sensitive layer(s) and the light-insensitive layer (s) is not more than 65 mg/$m^2$.

17. The silver halide photographic material as in claim 1, wherein the amount of calcium contained in the layer containing the dye crystallites is not more than 5 mg per $m^2$ of the layer.

18. The silver halide photographic material as in claim 1, wherein the support is heat-treated for at least 0.2 hours.

19. The silver halide photographic material as in claim 1, wherein prior to the heat-treatment the support is heat-treated at a temperature higher by 20° to 100° C. than the glass transition temperature for 5 minutes to 3 hours.

20. The silver halide photographic material as in claim 1, wherein the support is heat-treated in the state of a roll.

21. A method for processing a silver halide photographic material comprising the steps of:

(1) imagewise exposing a silver halide photographic material comprising a support having theren at least one silver halide light-sensitive layer, at least one light-insensitive layer, wherein at least one light-insensitive is an anti-halation layer, wherein the support comprises a poly(alkylene aromatic dicarboxylate) polymer having a glass transition temperature of from 50° C. to 200° C. and is heat-treated at a temperature of not lower than 40° C., but lower than the glass transition temperature, for 0.1 to 1500 hours after molding the polymer into the support and before coating the silver halide light-sensitive layer, and said at least one light-insensitive layer comprises a dispersion of crystallites of at least one dye represented by formula (I):

$$D-(X)_y \quad \text{(I)}$$

wherein D represents a moiety having a chromophoric group; X represents a dissociable proton or a group having a dissociable proton which is bonded to D either directly or through a bivalent bonding group; and y represents an integer of 1 to 7; and (2) color development processing the resulting imagewise exposed material at a temperature of from 40° C. to 60° C.

22. The silver halide photographic material as in claim 1, wherein at least one light insensitive layer is a yellow filter layer, wherein said yellow filter layer comprises a dispersion of crystallites of at least one dye represented by formula (I).

* * * * *

UNITED STATES PATENT AND TRADEMARK OFFICE

CERTIFICATE OF CORRECTION

PATENT NO. : 5,719,015

DATED : February 17, 1998

INVENTOR(S) : Keiji MIHAYASHI, Kiyoshi NAKAZYO

It is certified that error appears in the above-indentified patent and that said Letters Patent is hereby corrected as shown below:

On the Cover Page, under section [30] Foreign Application Priority Date, change "Sep. 30, 1993 [JP] Japan ..... 5-224717" to -- Sep. 30, 1993 [JP] Japan ..... 5-244717 --.

Signed and Sealed this

FourthDay of August, 1998

Bruce Lehman

*Attest:*

BRUCE LEHMAN

*Attesting Officer*

*Commissioner of Patents and Trademarks*